US009586402B2

(12) United States Patent
Komatsu et al.

(10) Patent No.: US 9,586,402 B2
(45) Date of Patent: Mar. 7, 2017

(54) LIQUID EJECTING HEAD, LIQUID EJECTING APPARATUS, AND METHOD OF MANUFACTURING LIQUID EJECTING HEAD

(71) Applicant: Seiko Epson Corporation, Shinjuku-ku (JP)

(72) Inventors: Yuko Komatsu, Chiryu (JP); Ryota Kinoshita, Matsumoto (JP); Fumiya Takino, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/645,948

(22) Filed: Mar. 12, 2015

(65) Prior Publication Data

US 2015/0273826 A1 Oct. 1, 2015

(30) Foreign Application Priority Data

Mar. 31, 2014 (JP) ..... 2014-072629

(51) Int. Cl.
*B41J 2/14* (2006.01)
*B41J 2/16* (2006.01)
*B41J 2/155* (2006.01)

(52) U.S. Cl.
CPC ..... *B41J 2/1433* (2013.01); *B41J 2/14209* (2013.01); *B41J 2/155* (2013.01); *B41J 2/162* (2013.01); *B41J 2/1623* (2013.01); *B41J 2002/14491* (2013.01); *B41J 2202/20* (2013.01); *Y10T 29/49401* (2015.01)

(58) Field of Classification Search
CPC ..... B41J 2/175; B41J 2/17513; B41J 2/1752; B41J 2002/14491; B41J 2002/14362
See application file for complete search history.

(56) References Cited

U.S. PATENT DOCUMENTS 8,235,501 B2 8/2012 Oguchi
2007/0008385 A1* 1/2007 Akahane ..... B41J 2/14274 347/65

FOREIGN PATENT DOCUMENTS

JP 2009-137176 A 6/2009
JP 2010-194899 A 9/2010
JP 2011-056920 A 3/2011
JP 2011-068037 A 4/2011

* cited by examiner

*Primary Examiner* — Henok Legesse
(74) *Attorney, Agent, or Firm* — Kilpatrick Townsend & Stockton LLP

(57) ABSTRACT

A liquid ejecting head comprising: a head body that ejects liquid droplets from a liquid ejecting surface; a wiring substrate electrically connected to the head body; a holder member to which the head bodies are fixed, and that includes a flow channel to the head bodies, and a wiring through hole through which the wiring substrate passes; a circuit substrate that includes a connection portion electrically connected to the wiring substrate, and a substrate that arranges the connection portion on both surfaces thereof and stands in a direction intersecting the liquid ejecting surface; a set of a first correction plate facing each other with respect to each of both surfaces of the substrate of the circuit substrate for correcting the holder member; and a cover member that accommodates the circuit substrate fixed to the holder member and the first correction plate.

19 Claims, 29 Drawing Sheets

LIQUID EJECTING HEAD, LIQUID EJECTING APPARATUS, AND METHOD OF MANUFACTURING LIQUID EJECTING HEAD

CROSS REFERENCES TO RELATED APPLICATIONS

This application claims priority to Japanese Patent Application No. 2014-072629 filed on Mar. 31, 2014. The entire disclosure of Japanese Patent Application No. 2014-072629 is hereby incorporated herein by reference.

BACKGROUND

1. Technical Field

The present invention relates to a liquid ejecting head, a liquid ejecting apparatus, and a method of manufacturing a liquid ejecting head, and in particular relates to an ink jet recording head that ejects ink as a liquid, an ink jet recording apparatus, and a method of manufacturing an ink jet recording head.

2. Related Art

The liquid ejecting apparatus represented by an ink jet recording apparatus, such as an ink jet printer or plotter, includes a liquid ejecting head able to eject a liquid such as ink stored in a cartridge, tank or the like. Such a liquid ejecting head includes a plurality of head main bodies that eject a liquid and a flow channel member (corresponds to a holder member of the invention) that holds the head main bodies, and includes a flow channel for ink supplied to the head main bodies (for example, JP-A-2011-056920).

Insertion holes in which a flexible cable of a COF substrate or the like connected to the head main body held in the flow channel member are inserted are formed in the flow channel member. Such a flow channel member achieves a cost reduction by being molded with a resin material. A guide portion for guiding the COF substrate is provided in the insertion hole.

The guide portion is formed on the inner surface of the insertion hole and is formed in a rib state so as to project to the center side of the insertion hole. It is possible to achieve both cost reductions and improvement in the rigidity of the flow channel member by providing such a guide portion.

However, there is concern of deformation such as warping arising during manufacturing or heating of the flow channel member formed with a resin material. When a flow channel in which warping arises in this way is used, the liquid ejecting surfaces of the head main bodies held in the flow channel member are not gathered in the same plane and there is concern of shifting of the landing positions of ink on the recording medium such as a recording sheet. When a material for correcting such warping is simply provided, the size of the ink jet recording head increases.

Such a problem is present for not only an ink jet recording head that discharges ink but also for a liquid ejecting head and liquid ejecting apparatus that eject a liquid other than ink and a method of manufacturing a liquid ejecting head.

SUMMARY

An advantage of some aspects of the invention is to provide a liquid ejecting head and liquid ejecting apparatus in which size increases are suppressed and in which the ejection quality of the liquid is improved by suppressing deformation of the holder member that holds the head main bodies, and a method or manufacturing the liquid ejecting head.

Aspect 1

According to this aspect of the invention, there is provided a liquid ejecting head including a head main body that ejects liquid droplets from a liquid ejecting surface; a wiring substrate electrically connected to the head main body; a holder member to which a plurality of head main bodies is fixed, and that includes a flow channel to the head main bodies, and a wiring through hole through which the wiring substrate passes; a circuit substrate that includes a connection portion electrically connected to the wiring substrate, and a substrate that arranges the connection portions on both surfaces thereof and stands in a direction intersecting to the liquid ejecting surface of the head main body; a set of a first correction plate facing each other with respect to each of both surfaces of the substrate of the circuit substrate for correcting the holder member; and a cover member that accommodates the circuit substrate fixed to the holder member and the first correction plate.

In this case, it is possible to correct warping in a direction perpendicular to the liquid ejecting surface of the holder member by providing the first correction plate in the holder member. In other words, even if warping occurs during manufacturing or during heating of the holder member, it is possible to maintain a state in which warping the holder member is corrected by bonding the first correction plate to the holder member in a state in which the warping of the holder member is corrected. In so doing, the liquid ejecting surface of the head main bodies held by the holder member is made flush, the landing position precision of the liquid on the recording medium is improved, and a liquid ejecting head with improved ejection quality is obtained. The cover member accommodates both the circuit substrate and the first correction plate. Compared to a case where only the circuit substrate is accommodated by the cover member, it is possible to reduce the size of the liquid ejecting head. Since the circuit substrate is erected perpendicular with respect to the liquid ejecting surface, it is possible for the region occupied by the circuit substrate to be reduced in the surface direction of the liquid ejecting surface. In so doing, it is possible for the size of the liquid ejecting head to be reduced in the surface direction of the liquid ejecting surface.

Aspect 2

In the liquid ejecting head according to Aspect 1, it is preferable that the first correction plate include a correction main body portion that extends over the connection portion in a direction perpendicular to the liquid ejecting surface, and an opening portion provided in the correction main body portion and through which the wiring substrate passes. In so doing, it is possible to strengthen the correction of the holder member.

Aspect 3

In the liquid ejecting head according to Aspects 1 and 2, it is preferable that each head main body include a nozzle row following a first direction on the liquid ejecting surface, the plurality of head main bodies be an arrangement in which a first head main body group arranged spaced with a first interval in the first direction and a second head main body group arranged spaced with a second interval in the first direction are arranged at different positions in a second direction orthogonal to the first direction on the liquid ejecting surface, and be an arrangement in which any of the head main bodies of the first head main body group is arranged at a position at which the second interval is provided in the first direction and any of the head main bodies of the second head main body group is arranged at a position at which the first interval is provided in the first direction, the first correction plate include a leg portion that is a leg portion arranged on both sides of the opening portion in the first direction, and is fixed to the holder member, the connection portion include a first connection portion connected to the head main body that configures the first head main body group and a second connection portion connected to the head main body that configures the second head main body group, the leg portion of one first correction plate of the set of first correction plates be arranged at a position that overlaps the second connection portion and does not overlap the first connection portion in the first direction, and the leg portion of another first correction plate of the set of first correction plates be arranged at a position that overlaps the first connection portion and does not overlap the second connection portion in the first direction. Thereby, since it is possible for the size in the first direction of the first correction plate to be reduced in size, it is possible to reduce the size of the liquid ejecting head in the first direction.

Aspect 4

In the liquid ejecting head according to Aspect 3, it is preferable that the first connection portion and the second connection portion overlap one another in plan view of the circuit substrate, and the width of the leg portion in the first direction be narrower than the width of the opening portion in the first direction. Thereby, since the first connection portion and the second connection portion provided in parallel in the first direction of the circuit substrate overlap one another in plan view of the circuit substrate, it is possible for the size of the circuit substrate in the first direction to be reduced by that much, and it is possible to reduce the size in the first direction of the liquid ejecting head.

Aspect 5

In the liquid ejecting head according to Aspects 1 to 4, it is preferable that a second correction plate that is a planar shaped second correction plate parallel to the liquid ejecting surface, is more rigid than the holder member, and is adhered to the holder be provided, in which the second correction plate has a size that covers all of the liquid ejecting surface of the head main body on the surface parallel to the liquid ejecting surface. Thereby, since the second correction plate is adhered to the holder member that holds all of the head main bodies, it is possible to more reliably correct distortion or torsion during manufacturing or the like. It is possible for the rigidity of the liquid ejecting head to be further improved by the second correction plate.

Aspect 6

In the liquid ejecting head according to Aspect 5, it is preferable that a fixing plate that is a fixing plate to which the plurality of head main bodies is adhered, and is adhered to the holder member be provided, in which the head main body and the second correction plate are separated. Thereby, since it is possible for the dimensional tolerance to be reduced in the direction perpendicular to the liquid ejecting surface by the amount the second correction plate as an article that directly contacts the holder member and the fixing plate is reduced, it is possible to achieve size reductions in the liquid ejecting head in this direction.

Aspect 7

In the liquid ejecting head according to Aspects 5 and 6, it is preferable that the head main bodies include a liquid introduction port arranged at different position to one another in the second direction, the holder member include a first connection flow channel that intersects the liquid ejecting surface and that communicates with the introduction port, and a second connection flow channel extend in a direction perpendicular to the liquid ejecting surface, and the second correction plate include an opening that is an opening that passes through both of the first connection flow channel and the second connection flow channel and penetrates in a direction orthogonal to the liquid ejecting surface. Thereby, since an opening is preferably formed as a through hole in the second correction plate along a direction perpendicular to the liquid ejecting surface, working of the second correction plate is easy.

Aspect 8

In the liquid ejecting head according to Aspect 7, it is preferable that the first correction plate and the circuit substrate be fixed to the holder member so as to follow the first connection flow channel. Thereby, it is possible for the circuit substrate to be more deeply inserted and fixed with respect to the holder member without interfering with the first connection flow channel. In so doing, since the connection portion of the circuit substrate approaches the head main body side, it is possible for the wiring substrate connected to the connection portion to be shortened.

Aspect 9

In the liquid ejecting head according to Aspect 5, it is preferable that the second correction plate configure a flow channel, and a liquid be grounded via the second correction plate. Thereby, it is possible for the liquid to be grounded via the second correction plate. Since it is possible for correction of the holder member of the liquid ejecting head and charging of the liquid to be realized with the second correction plate, it is possible to achieve cost reductions by reducing the number of components.

Aspect 10

In the liquid ejecting head according to Aspects 1 to 9, it is preferable that the circuit substrate include an electronic component with a larger dimension than the interval between the circuit substrate and the first correction plate in a direction in which the set of first correction plates face each other, and the electronic component be arranged at a position at which the first correction plate from the circuit substrate is not opposed. Thereby, it is possible for the circuit substrate and the first correction plate to approach one another without interfering with the electronic components. In so doing, it is possible to reduce the size of the liquid ejecting head in the second direction.

Aspect 11

According to this aspect of invention, there is provided a liquid ejecting apparatus including the liquid ejecting head disclosed in Aspects 1 to 10.

In this case, a liquid ejecting apparatus provided with a liquid ejecting head in which size increases are suppressed and the liquid ejection quality is improved by suppressing deformation of the holder member that holds the head main bodies is provided.

Aspect 12

According to this aspect of the invention, there is provided a method of manufacturing liquid ejecting head that includes a head main body that ejects liquid droplets from a liquid ejecting surface; a wiring substrate electrically connected to the head main body; a holder member to which a plurality of head main bodies is fixed, and that includes a flow channel to the head main bodies, and a wiring through hole through which the wiring substrate passes; a circuit substrate that includes a connection portion electrically connected to the wiring substrate, and a substrate that is arranged on both surfaces of the connection portions and follows a direction perpendicular to the liquid ejecting surface of the head main body; a first correction plate that is a set of planar shaped first correction plates facing each other with respect to each of both surfaces of the substrate of the circuit substrate for correcting the holder member; and a cover member that accommodates the circuit substrate fixed to the holder member and the accommodation plate, the method including fixing the first correction plate while pressing against the holder member.

In this case, a liquid ejecting head is provided in which size increases are suppressed and the liquid ejection quality is improved by suppressing deformation of the holder member that holds the head main bodies.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment 1

Figure 1:
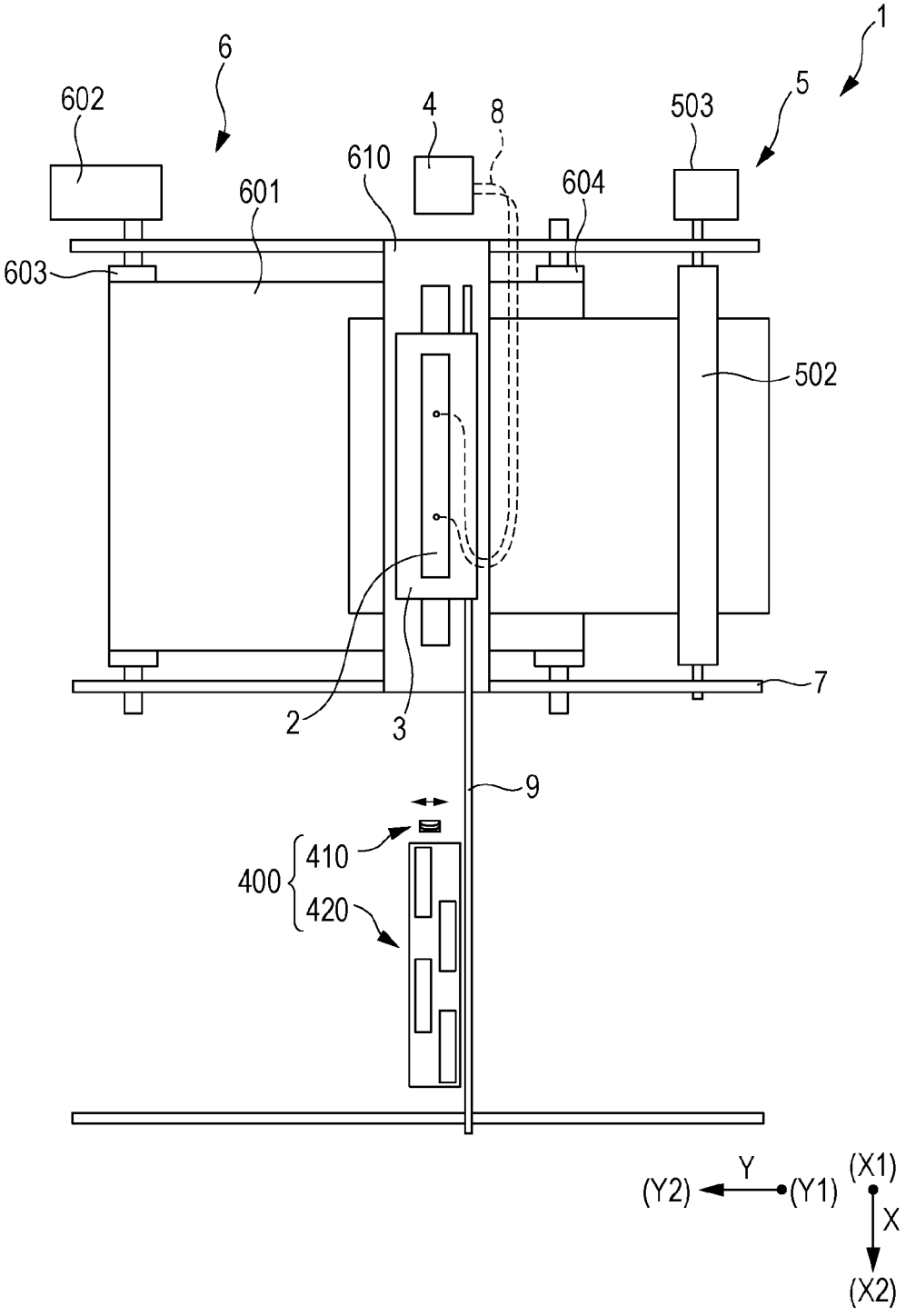
FIG. 1 is a plan view of an ink jet recording apparatus.
Figure 2A:
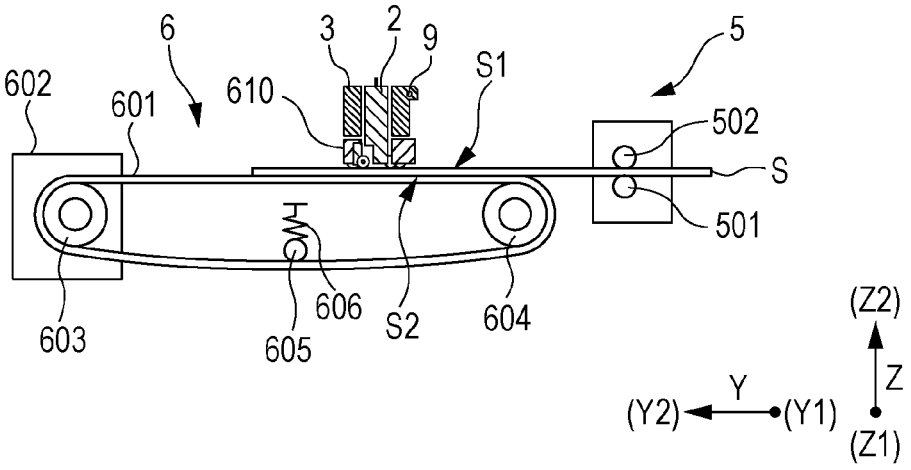
FIGS. 2A and 2B are a side view and an expanded view of the ink jet recording apparatus.
Figure 2B:
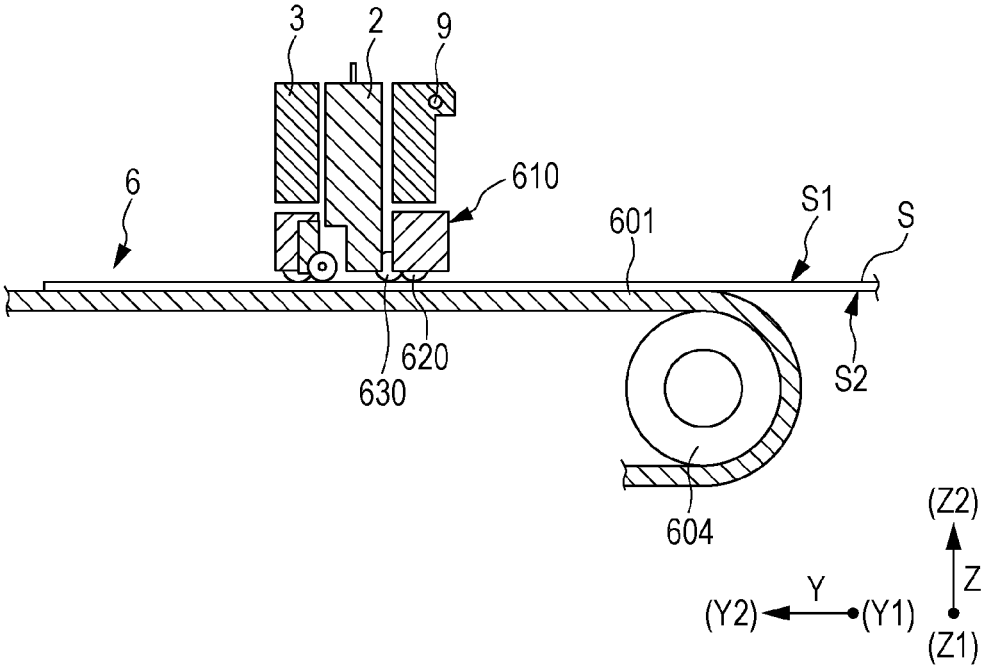

Detailed description will be provided based in the embodiments of the invention. The ink jet recording head is an example of a liquid ejecting head and is also simply referred to as a recording head. The ink jet recording apparatus is an example of a liquid ejecting apparatus. FIG. 1 is a plan view schematically showing an ink jet recording apparatus according to Embodiment 1 and FIGS. 2A and 2B are a side view and an enlarged view of the ink jet recording apparatus.

The ink jet recording apparatus 1 is a so-called line-type ink jet recording apparatus 1 that performs printing by transporting only the recording sheet S that is a recording medium.

The transport direction of the recording sheet S is referred to as the second direction Y and the direction orthogonal to the second direction Y in the in plane direction of the landing plane S1 of the recording sheet S on which the ink lands is referred to as the first direction X. A direction orthogonal to both the first direction X and the second direction Y, that is, a direction orthogonal to the landing surface S1 of the recording sheet S is referred to as the third direction Z. In the embodiment, although each direction (X, Y, Z) is shown as being orthogonal to one another, the directions are not necessarily limited thereto.

The ink jet recording apparatus 1 includes a recording head 2, a carriage 3 to which the recording head 2 is mounted, a liquid storage unit 4, such as an ink tank, in which ink is stored, a first transport unit 5, a second transport unit 6, an apparatus main body 7, and a maintenance unit 400.

The recording head 2 extends along the first direction X. In the embodiment, although described in detail later, in the recording head 2, a plurality of head main body groups 202 in which a plurality of head main bodies 200 (refer to FIG. 8) is arranged in parallel along the first direction X is provided as a plurality of rows, in the embodiment, two rows, in the second direction Y. Naturally, the number of head main body groups 202 of the head main bodies 200 is not particularly limited thereto and the number is preferably three rows or more. Such head main bodies 200 are arranged so that the liquid ejecting surface 20*a* that ejects the ink is the Z1 side.

The liquid storage unit 4 supplies ink to the recording head 2 and, in the embodiment, is fixed to the apparatus main body 7. Ink is supplied from the liquid storage unit 4 fixed to the apparatus main body 7 to the recording head 2 via a supply pipe 8 such as a tube. In a form in which the head unit 2 includes the liquid storage unit 4, for example, the head unit 2 preferably has the liquid storage unit 4 mounted above the recording head 2 in the third direction Z, that is, the opposite side to the recording sheet S.

The first transport unit 5 is provided on one side in the second direction Y of the head 2, in the embodiment, the Y1 side. In the embodiment, the one side in the second direction Y with respect to recording head 2 is referred to as the Y1 side and the other side is referred to as the Y2 side.

The first transport unit 5 is provided with a first transport roller 501 and a first driven roller 502 that follows the first transport roller 501. The first transport roller 501 is provided on the rear surface S2 side of opposite side to the landing surface S1 of the recording sheet S and is driven by the driving force of a first driving motor 503. The first driven roller 502 is provided on the landing surface S1 side of the recording sheet S, and the recording sheet S is pinched between the first driven roller 502 and the first transport roller 501. The first driven roller 502 presses the recording sheet S towards the first transport roller 501 side by a biasing member such as a spring, not shown.

The second transport unit 6 is provided with a transport belt 601, a second driving motor 602, a second transport roller 603, a second driven roller 604, a tension roller 605, and a roller unit 610.

The second transport roller 603 is driven by the driving force of the second driving motor 602. The transport belt 601 is formed from an endless belt, and is suspended on the outer periphery of the second transport roller 603 and the second driven roller 604. The transport belt 601 is provided on the rear surface S2 side of the recording sheet S. The tension roller 605 is provided between the second transport roller 603 and the second driven roller 604, comes in contact with the inner peripheral surface of the transport belt 601, and applies tension to the transport belt 601 with the biasing force of the biasing member 606 such as a spring. In so doing, the surface of the transport belt 601 opposing the recording head 2 becomes flat between the second transport roller 603 and the second driven roller 604.

The roller unit 610 is provided on the landing surface S1 side of the recording sheet S, and includes a plurality of head-internal rollers and head-external rollers on the landing surface S1 side of the recording sheet S. The roller unit 610 pinches the recording sheet S between the head-internal rollers and the head-external rollers and the transport belt 601. The roller unit 610 will be described in detail later.

In the ink jet recording apparatus 1, ink is ejected from each ink jet recording head of the recording head 2 while transporting the recording sheet S with the first transport unit 5 and the second transport unit 6 from the Y1 to Y2 sides in the second direction Y with respect to the recording head 2, and the ejected ink is landed on the landing surface S1 of the recording sheet S, that is, printing is performed.

The carriage 3 of the ink jet recording apparatus 1 has a plurality of recording heads 2 mounted, and is provided to be movable in the axial direction of the carriage shaft 9. The carriage shaft 9 is arranged such that the axial direction matches the first direction X and the carriage 3 is moved in the axial direction of the carriage shaft 9 by the driving force of the driving motor, not shown, being transferred to the carriage 3 via gears or a belt. The carriage 3 or the carriage shaft 9 is provided to be movable in a direction orthogonal to the landing surface S1 with respect to the apparatus main body 7, that is, the third direction Z, by a lifting unit, not shown. In the embodiment, the movement of the recording head 2 in a direction orthogonal to the landing surface S1 of the recording sheet S during printing is referred to as lifting and lowering. That is, the recording head 2 moving in the third direction Z from the Z1 side that is the recording sheet S side to the Z2 side separating from the recording sheet S during printing is called "raising" and the recording head 2 moving from the Z2 side separating from the recording sheet S to the Z1 side that is the recording sheet S side during printing is called "lowering."

The carriage 3 moves to the maintenance position not facing the recording sheet S or the transport belt 601 by moving in the first direction X that is the axial direction of the carriage shaft 9, after being lifted from the landing position on which ink is ejected by the recording head 2 facing the transport belt 601 and landed on the recording sheet S to the Z2 side in the third direction Z by the lifting unit, not shown. A maintenance unit 400 that performs maintenance on the recording head 2 is provided at the maintenance position. In the embodiment, in the first direction X, the side on which the second transport unit 6 such as the transport belt 601 in the apparatus main body 7 is referred to as the X1 side, and the maintenance position side on which the maintenance unit 400 is provided is referred to as the X2 side.

In the embodiment, the maintenance unit 400 is provided with a wiping unit 410 that includes a blade that wipes the liquid ejecting surface and a capping unit 420 that includes a cap that covers the liquid ejecting surface.

The wiping unit 410 is a member that wipes the liquid ejecting surfaces 20*a* of each head main body 200 of the recording head 2, and is provided in the apparatus main body 7 so as to be able to relatively move in the second direction Y. The wiping unit 410 contacts the liquid ejecting surface 20*a* of the head main body 200 with respect to the recording head 2 that is moved to the maintenance position, and, by being moved in the second direction Y, is able to wipe the liquid ejecting surface 20*a* of the head main body 200.

The capping unit 420 is provided with caps formed from rubber or the like provided for each head main body 200, and a cap holding unit that holds the caps. The cap comes in contact with the liquid ejecting surface 20*a* of each head main body 200, and is provided at a size that covers all of the plurality of nozzle openings. When the cap covers the liquid ejecting surface 20*a*, a sealing space is formed there between. A suction path, not shown, is provided in the inner portion of the cap holding unit. One end of the suction path communicates with the sealing space and the other end communicates with a suction device, such as a suction pump. A suction operation is performed by the suction device with the capping unit 420 in a state of covering the liquid ejecting surface 20*a* of the head main body 200 with the cap. Through the suction operation, the interior of the sealed space formed by the cap is negatively pressurized, and ink in the flow channel is suctioned from the nozzle opening 21 along with foreign materials such as bubbles. By covering the liquid ejecting surface 20*a* with a cap when not printing, drying of the ink in the vicinity of the nozzle opening 21 is preferably suppressed.

Only the wiping unit 410 or only the capping unit 420 is preferably provided as the maintenance unit 400 at the maintenance position. Furthermore, a mechanism that moves the recording head 2 to the maintenance position or the maintenance position itself is preferably not provided in the ink jet recording apparatus 1.

Figure 3:
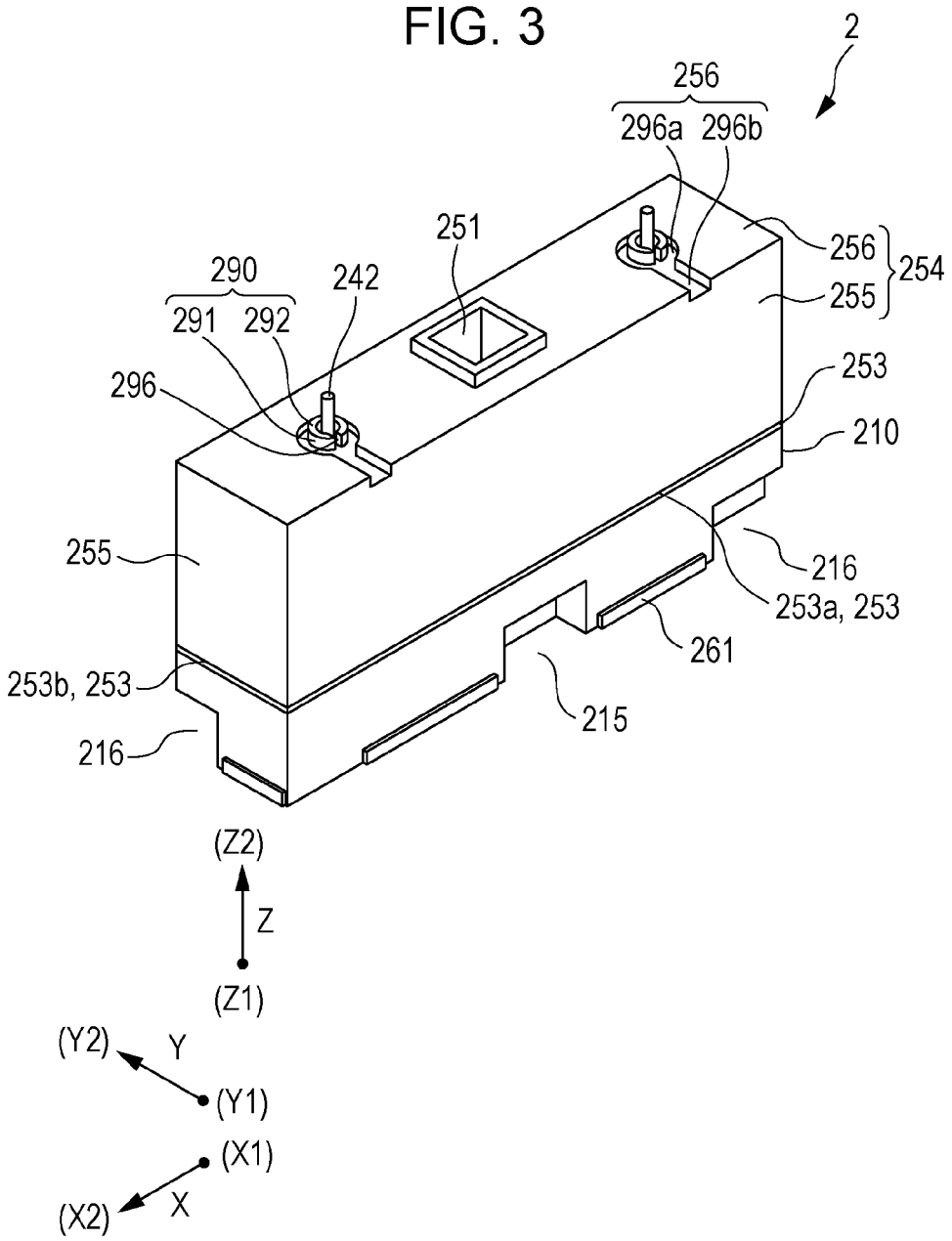
FIG. 3 is a perspective view of the recording head according to Embodiment 1.
Figure 4:
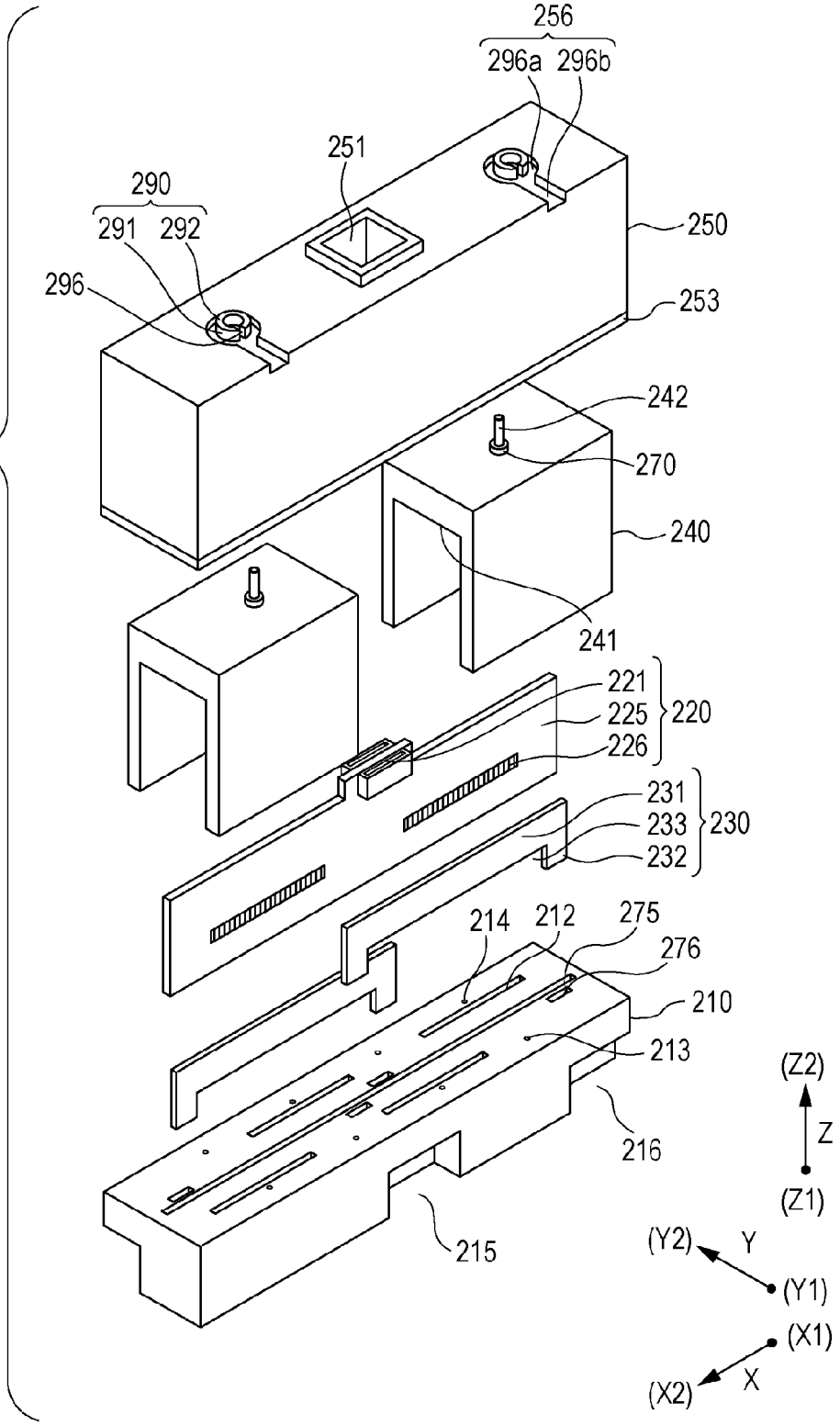
FIG. 4 is an exploded perspective view of the recording head according to Embodiment 1.
Figure 5:
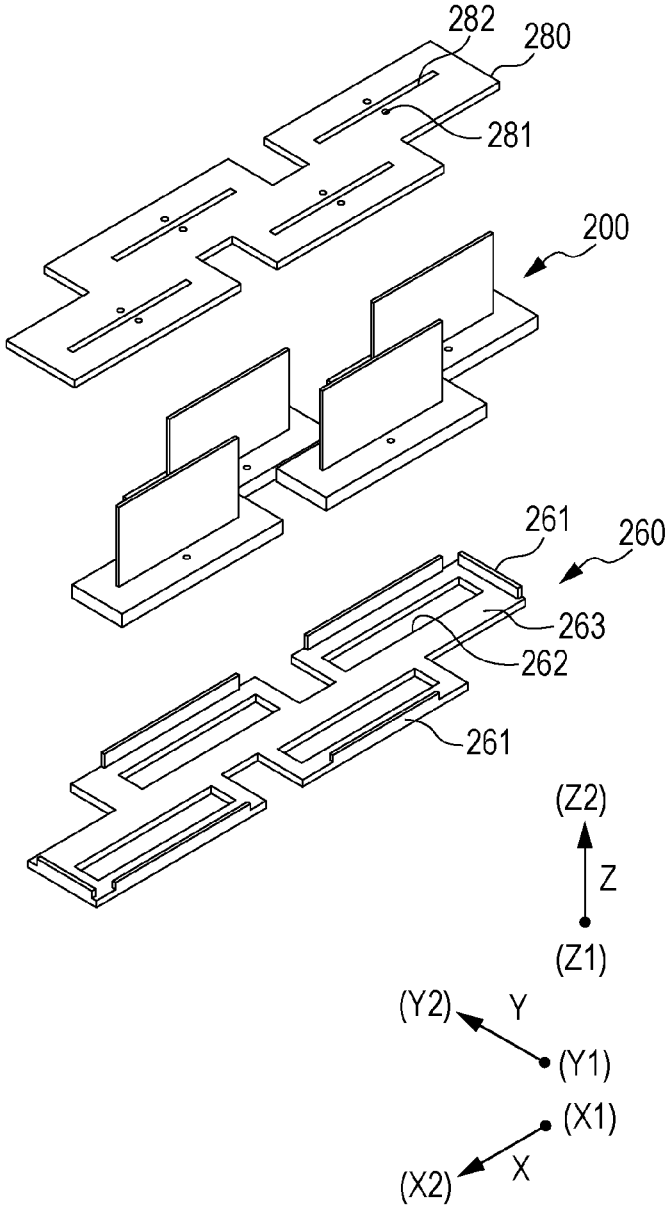
FIG. 5 is an exploded perspective view of the recording head according to Embodiment 1.
Figure 6:
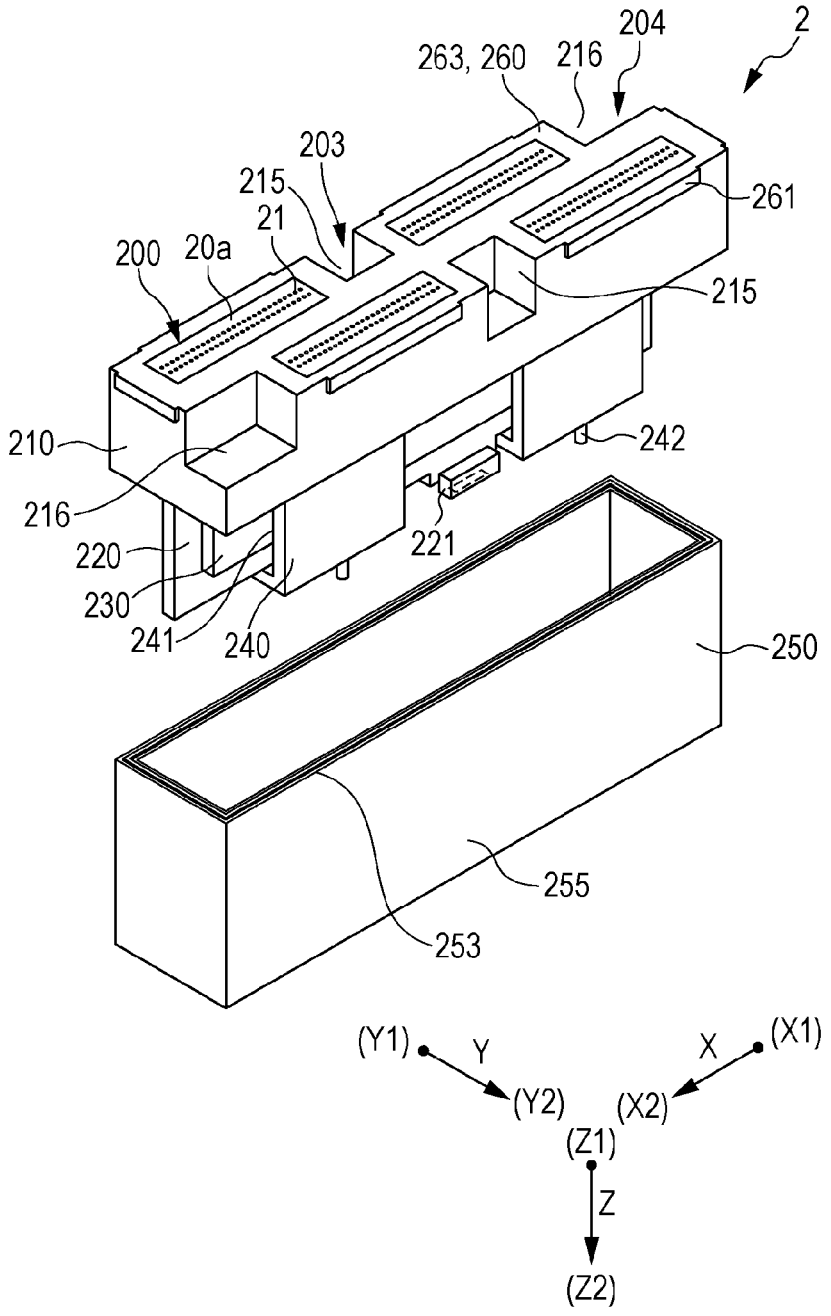
FIG. 6 is an exploded perspective view of the recording head according to Embodiment 1.

FIG. 3 is a perspective view of the recording head according to the embodiment, FIG. 4 is an exploded perspective view of the recording head, FIG. 5 is an exploded perspective view of the recording head, and FIG. 6 is an exploded perspective view of the recording head.

As shown in the drawings, the above-described recording head 2 is provided with a plurality of head main bodies 200, a holder member 210 that holds the plurality of head main bodies 200 on the Z1 side that is one surface side in the third direction Z, a circuit substrate 220 fixed to the surface of the Z2 side in the third direction Z of the holder member 210, a first correction plate 230 fixed to the surface of the Z2 side of the holder member 210, a second correction plate 280 fixed to the surface of the Z1 side of the holder member 210, a flow channel member 240 fixed to the surface of the Z2 side of the holder member 210, a cover member 250 that accommodates the head main bodies 200, the circuit substrate 220, the first correction plate 230, and the flow channel member 240 on the inner portion by being fixed to the surface of the Z2 side of the holder member 210, and a fixing plate 260 that fixes the plurality of head main bodies 200.

Figure 26:
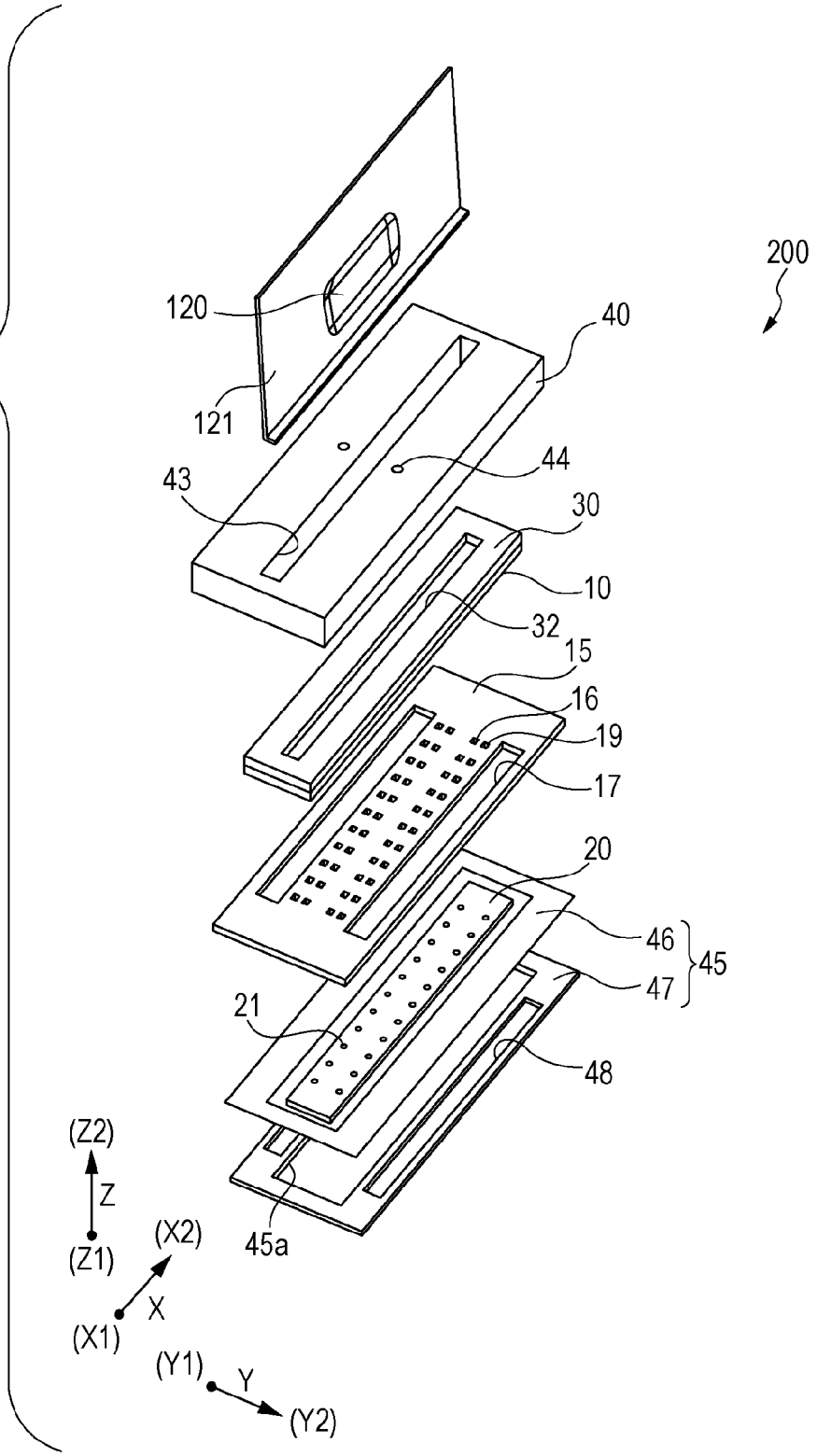
FIG. 26 is an exploded perspective view of a head main body.
Figure 27:
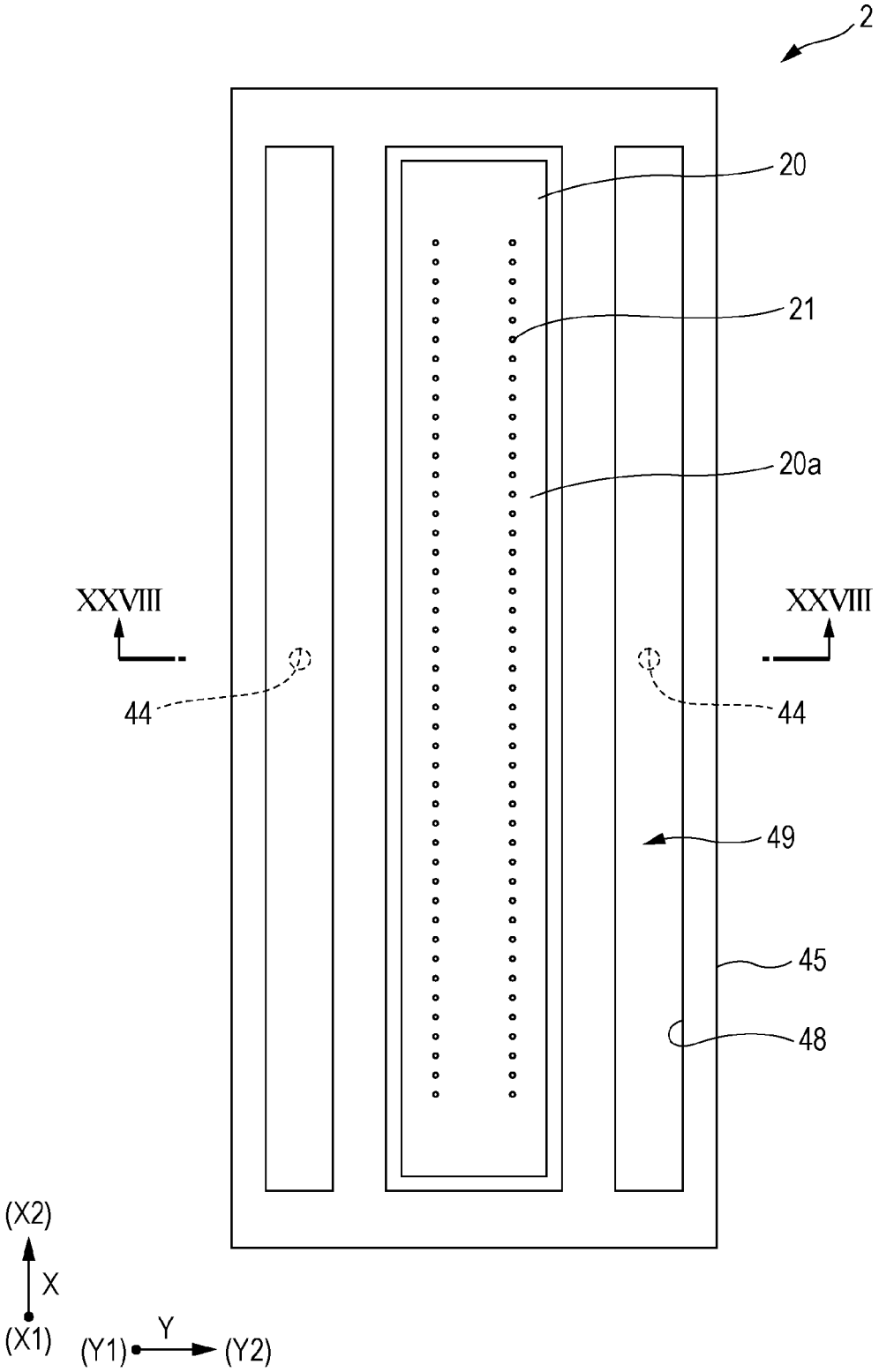
FIG. 27 is a plan view of the liquid ejecting surface side of the head main body.
Figure 28:
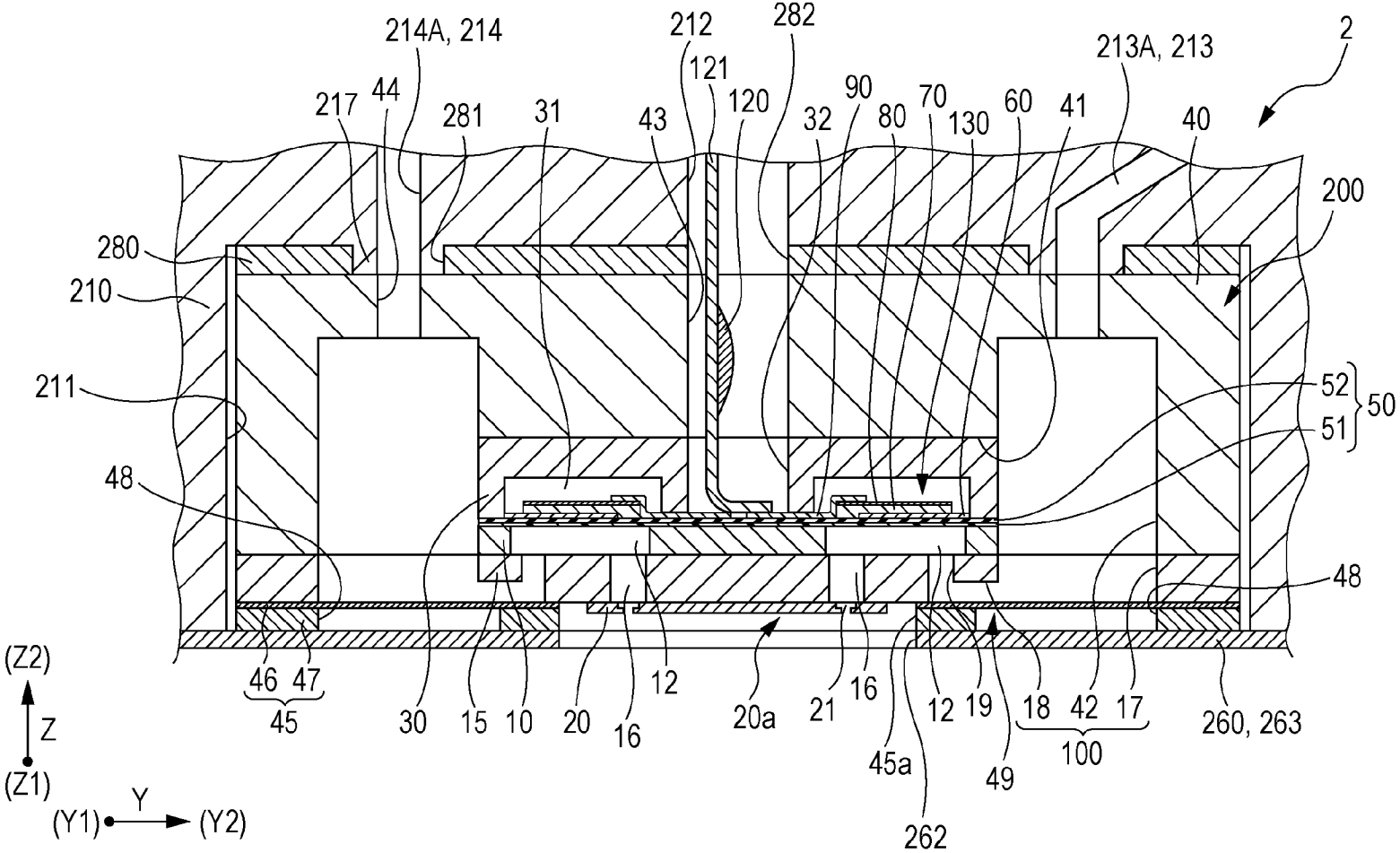
FIG. 28 is a cross-sectional view taken along the line XXVIII-XXVIII in FIG. 26.

The head main body 200 that ejects ink droplets as an example of the liquid droplets is described with reference to FIGS. 26 to 28. FIG. 26 is an exploded perspective view of the head main body, FIG. 27 is a plan view of the liquid ejecting surface side of the head main body, and FIG. 28 is a cross-sectional view taken along line XXVIII-XXVIII in FIG. 27.

The head main body 200 is configured by a plurality of members, such as a flow channel-forming substrate 10, a communication plate 15, a nozzle plate 20, a protective substrate 30, a compliance substrate 45, and a case member 40.

Pressure generating chambers 12 divided by a plurality of dividing walls are arranged in parallel on the flow channel-forming substrate 10. The recording head 2 is mounted to the ink jet recording apparatus 1 so that the arrangement direction of the pressure generating chambers 12 of the head main bodies 200 is the first direction X. Hereinafter, the arrangement direction of the pressure generating chambers 12 is also referred to as the first direction X. On the flow channel-forming substrate 10, a plurality of rows, in the embodiment, 2 rows, in which the pressure generating chambers 12 are arranged in parallel in the first direction X is arranged in parallel in the second direction Y orthogonal to the first direction X.

It is possible for the flow channel-forming substrate 10 to use a metal, such as stainless steel or Ni, a ceramic material represented by $ZrO_2$ or $Al_2O_3$, a glass ceramic material, or an oxide such as MgO and $LaAlO_3$. In the embodiment, the flow channel-forming substrate 10 is formed from a single crystal silicon substrate. By subjecting the flow channel-forming substrate 10 to anisotropic etching from one surface side, the pressure generating chambers 12 partitioned by a plurality of partition walls are provided in parallel along the direction in which the plurality of nozzle openings 21 that discharge ink is provided in parallel.

The communication plate 15 and the nozzle plate 20 are sequentially layered on the Z1 side in the third direction Z of the flow channel-forming substrate 10. That is, the communication plate 15 provided on the Z1 side in the third direction Z of the flow channel-forming substrate 10 and the nozzle plate 20 having nozzle openings 21 provided on the opposite side of the communication plate 15 to the flow channel-forming substrate 10, that is, on the surface of the Z1 side of the communication plate 15 are provided.

A nozzle communication path 16 that communicates the pressure generating chamber 12 and the nozzle openings 21 is provided in the communication plate 15. The communication plate 15 has a larger area than the flow channel-forming substrate 10 and the nozzle plate 20 has smaller area than the flow channel-forming substrate 10. Because the nozzle openings 21 in the nozzle plate 20 and the pressure generating chamber 12 are separated by providing the communication plate 15 in this way, ink in the pressure generating chamber 12 is not easily influenced by the increased viscosity due to evaporation of the water content in ink arising in the ink in the vicinity of the nozzle opening 21. Since the nozzle plate 20 preferably only covers the openings of the nozzle communication path 16 that communicates with the pressure generating chamber 12 and the nozzle openings 21, it is possible for the area of the nozzle plate 20 to be comparatively reduces, and possible to achieve reductions in cost.

A first manifold portion 17 that configure a portion of the manifold 100 and a second manifold portion 18 (restricted flow channel, orifice flow channel) are provided on the communication plate 15.

The first manifold 17 is provided penetrating the communication plate 15 in the thickness direction. Here, the thickness direction is the third direction Z in which the communication plate 15 and the flow channel-forming substrate 10 are stacked. The second manifold portion 18 is provided opened to the nozzle plate 20 side of the communication plate 15 without penetrating the communication plate 15 in the thickness direction.

A supply communication path 19 that communicates with one end portion of the pressure generating chamber 12 in the second direction Y is independently provided for each pressure generating chamber 12 in the communication plate 15. The supply communication path 19 communicates the second manifold 18 and the pressure generating chamber 12.

It is possible for a metal such as stainless steel or nickel (Ni) or a ceramic such as zirconium (Zr) or the like to be used as the communication plate 15. It is preferable that the communication plate 15 be a material with the same coefficient of linear expansion as the flow channel-forming substrate 10. That is, in a case of using a material with coefficient of linear expansion significantly different to the flow channel-forming substrate 10 as the communication plate 15, warping arises in the flow channel-forming substrate 10 and the communication plate 15 by being heated or cooled. In the embodiment, by using the same material as the flow channel-forming substrate 10, that is, a single crystal silicon substrate, for the communication plate 15, it is possible to suppress the occurrence warping due to heating or cracks, peeling or the like due to heating.

Nozzle openings 21 that communicate with each pressure generating chamber 12 via the nozzle communication path 16 are formed in the nozzle plate 20. Such nozzle openings 21 are arranged in parallel in the first direction X, and two rows of nozzle openings 21 arranged in parallel in the first direction X are formed in the second direction Y. The surface that discharges ink droplets from both surfaces of the nozzle plate 20, that is, the surface of the opposite side to the pressure generating chamber 12 is referred to as the liquid ejecting surface 20*a*.

It is possible to use a metal such as stainless steel (SUS), an organic material such as a polyimide resin or a single crystal silicon substrate or the like as the nozzle plate 20. By using the single crystal silicon substrate as the nozzle plate 20, the coefficients of linear expansion of the nozzle plate 20 and the communication plate 15 are the same, and it is possible to suppress the occurrence warping due to heating or cooling or cracks, peeling or the like due to heating.

Meanwhile, a diaphragm 50 is formed on the opposite surface side to the communication plate 15 of the flow channel-forming substrate 10. In the embodiment, an elastic film 51 formed from silicon oxide provided on the flow channel-forming substrate 10 side and an insulating film 52 formed from zirconium oxide provided on the elastic film 51 are provided as the diaphragm 50. The liquid flow channel of the pressure generating chamber 12 or the like is formed by anisotropic etching of the flow channel-forming substrate 10 from one surface side (surface side to which the nozzle plate 20 is bonded) and the other surface of the liquid flow channel of the pressure generating chamber 12 is defined by the elastic film 51.

A piezoelectric actuator 130, which is the pressure generating unit of the embodiment, including a first electrode 60, a piezoelectric layer 70, and a second electrode 80 is provided on the diaphragm 50 of the flow channel-forming substrate 10. Here, the piezoelectric actuator 130 refers to a portion including the first electrode 60, the piezoelectric layer 70, and the second electrode 80. Generally, any one of the electrodes in the piezoelectric actuator 130 forms a common electrode, and the other electrode is configured by being patterned for each of the pressure generating chambers 12. In the embodiment, by providing the first electrode 60 continuously providing a plurality of piezoelectric actuators 130, a common electrode is formed, and by providing the second electrode 80 independently for each piezoelectric actuator 130, individual electrodes are formed. Naturally, there is no impediment to reversing these for the convenience of the driving circuit or in wiring. In the above-described example, although a diaphragm 50 configured by an elastic film 51 and an insulating film 52 is given as an example, naturally, there is no limitation thereto, and, for example, either one of the elastic film 51 and the insulating film 52 is preferably provided as the diaphragm 50 or the first electrode 60 only preferably acts as the diaphragm without providing the elastic film 51 and the insulating film 52 as the diaphragm 50. The piezoelectric actuator 130 itself preferably substantially serves as the diaphragm.

It is possible for the piezoelectric layer 70 to be formed from a piezoelectric material of an oxide having a polarization structure, for example, formed from a perovskite oxide represented by general formula $ABO_3$, and it is possible for a lead-based piezoelectric material that includes lead or a non-lead based piezoelectric material that does not included lead to be used.

One end portion of a lead electrode 90 formed from a metal such as gold (Au) drawn from the vicinity of the end portion of the opposite side to the supply communication path 19 and extended up to the diaphragm 50 is connected to each of the second electrodes 80 that are the individual electrodes of the piezoelectric actuator 130.

The wiring substrate 121 on which the driving circuit 120 for driving the piezoelectric actuator 130 is provided is connected to the other end portion of the lead electrode 90. The wiring substrate 121 is sheet shaped and is flexible and, for example, a COF substrate or the like may be used. The driving circuit 120 is preferably not provided on the wiring substrate 121. In other words, the wiring substrate 121 is not limited to the COF substrate, and is preferably FFC, FPC, or the like.

A protective substrate 30 having approximately the same size as the flow channel-forming substrate 10 is bonded to the surface of the piezoelectric actuator 130 side of the flow channel-forming substrate 10. The protective substrate 30 includes a holding portion 31 that is a space for protecting the piezoelectric actuator 130. The holding portion 31 has a concave shape open to the flow channel-forming substrate 10 side without penetrating in the third direction Z that is the thickness direction of the protective substrate 30. The holding portion 31 is provided independently for each row configured by the plurality of piezoelectric actuators 130 arranged in parallel in the first direction X. The holding portion 31 is provided so as to accommodate rows arranged in parallel in the first direction X of the piezoelectric actuator 130, and provided for each row of piezoelectric actuators 130, that is, two are provided in parallel in the second direction Y. The holding portion 31 preferably includes a space that does not hinder movement of the piezoelectric actuator 130, and the space may or may not be sealed.

The protective substrate 30 has through holes 32 penetrating in the third direction Z that is the thickness direction. The through holes 32 are provided spanning the first direction X that is the arrangement direction of the plurality of piezoelectric actuators 130 between the two holding portions 31 arranged in parallel in the second direction Y. In other words, the through holes 32 are openings having a long side in the arrangement direction of the plurality of piezoelectric actuators 130. The other end portion of the lead electrode 90 is extended so as to be exposed in the through hole 32, and is electrically connected to the lead electrode 90 and the wiring substrate 121 in the through hole 32.

It is preferable that materials having substantially the same coefficient of thermal expansion as the flow channel-forming substrate 10, for example, such as glass, and ceramic materials, be used as the protective substrate 30 and the protective substrate is formed using a silicon single crystal substrate of the same material as the flow channel-forming substrate 10 in the present embodiment. The method of bonding the flow channel-forming substrate 10 and the protective substrate 30 is not particularly limited, and, in the embodiment, the flow channel-forming substrate 10 and the protective substrate 30 are bonded via an adhesive (not shown).

The case member 40 has substantially the same shape as the communication plate 15 described above seen in plan view and is bonded to the above-described communication plate 15 along with being bonded to the protective substrate 30. Specifically, the case member 40 has a concavity 41 with a depth in which the flow channel-forming substrate 10 and the protective substrate 30 are accommodated in the protective substrate 30 side. The concavity 41 has a wider opening area than the surface bonded to the flow channel-forming substrate 10 of the protective substrate 30. The opening surface on the nozzle plate 20 side of the concavity 41 is sealed by the communication plate 15 in a state in which the flow channel-forming substrate 10 or the like is accommodated in the concavity 41. In so doing, a third manifold portion 42 is defined on the outer peripheral portion of the flow channel-forming substrate 10 by the case member 40. The manifold 100 of the embodiment is configured by the first manifold portion 17 and the second manifold portion 18 provided on the communication plate 15 and the third manifold portion 42 defined by the case member 40. That is, the manifold 100 is provided with the first manifold portion 17, the second manifold portion 18, and the third manifold portion 42.

The manifold 100 of the embodiment is arranged on both outer sides of the two rows of pressure generating chambers 12 in the second direction Y, and the two manifolds 100 provided on both outer sides of the two rows of pressure generating chambers 12 are provided independently so as not to communicate in the head main body 200. That is, one manifold 100 is provided in communication for each row of pressure generating chambers 12 of the embodiment. In other words, the manifold 100 is provided for each nozzle group. Naturally, the two manifolds 100 preferably communicate.

The case member 40 has an introduction port 44 communicating with the manifold 100. Ink is introduced from the introduction port 44 to the manifold 100. Although described in detail later, the introduction port 44 communicates the first connection flow channel 213 and the second connection flow channel 214 formed in the holder member 210, and ink is supplied from the first connection flow channel 213 and the second connection flow channel 214 to the introduction port 44.

A connection port 43 in which the wiring substrate 121 is inserted by communicating with the through hole 32 of the protective substrate 30 is provided in the case member 40. Although described later in detail, the connection port 43 communicates the first wiring insertion hole 212 formed in the holder member 210 and the second wiring insertion hole 282 formed in the second correction plate 280 that reinforces the holder member 210. That is, the connection port 43, the first wiring insertion hole 212, and the second wiring insertion hole 282 form one insertion hole by communicating, and the wiring substrate 121 is inserted in the insertion hole.

It is possible for a resin, a metal, or the like to be used as the material of the case member 40. Naturally, by forming a resin material as the case member 40, mass production is possible at a low cost.

A compliance substrate 45 is provided on the surface in which the first manifold portion 17 and the second manifold portion 18 of the communication plate 15 are opened. The compliance substrate 45 has approximately the same size as the above-described communication plate 15 in plan view, and a first exposure opening portion 45*a* that exposes the nozzle plate 20 is provided. In a state in which the compliance substrate 45 exposes the nozzle plate 20 by the first exposure opening portion 45*a*, the opening of the liquid ejecting surface 20*a* of the first manifold portion 17 and the second manifold portion 18 is sealed. That is, the compliance substrate 45 defines a portion of the manifold 100.

The compliance substrate 45 according to the embodiment is provided with a sealing film 46 and the fixing substrate 47. The sealing film 46 is formed from a film-like thin film (for example, a thin film with a thickness of 20 μm or less formed with polyphenylene sulfide (PPS) or the like) having flexibility, and the fixing substrate 47 is formed from a hard material such as a metal such as stainless steel (SUS). Because the region facing the manifold 100 of the fixing plate 47 forms an opening portion 48 that is completely removed in the thickness direction, one surface of the manifold 100 is a compliance portion 49 that is a flexible portion sealed by the sealing film 46 having flexibility only. In the embodiment, one compliance portion 49 is provided corresponding to one manifold 100. That is, in the embodiment, because two manifolds 100 are provided, two compliance portions 49 are provided on both sides in the second direction Y with the nozzle plate 20 interposed.

In the head main body 200 with such a configuration, when ink is ejected; ink is removed from the storage unit via the introduction port 44, and the interior of the flow channel is filled from the manifold 100 up to the nozzle opening 21 with ink. Thereafter, by applying a voltage to each piezoelectric actuator 130 corresponding to the pressure generating chamber 12 according to signals from the driving circuit 120, the diaphragm 50 is flexurally deformed along with the piezoelectric actuator 130. In so doing, the pressure in the pressure generating chamber 12 increases and ink droplets are ejected from a predetermined nozzle opening 21.

Figure 7:
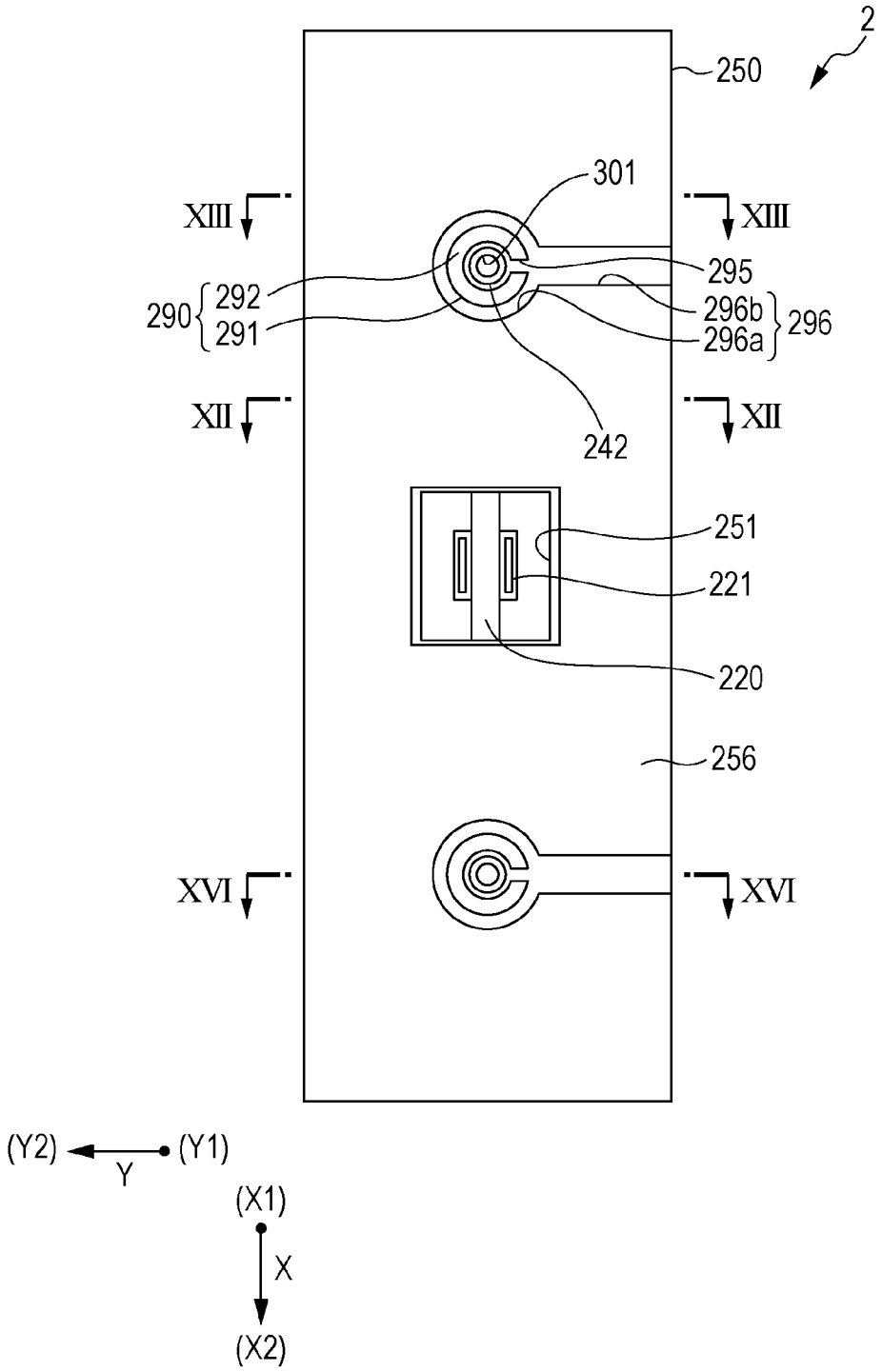
FIG. 7 is a plan view of the recording head according to the Embodiment 1.
Figure 8:
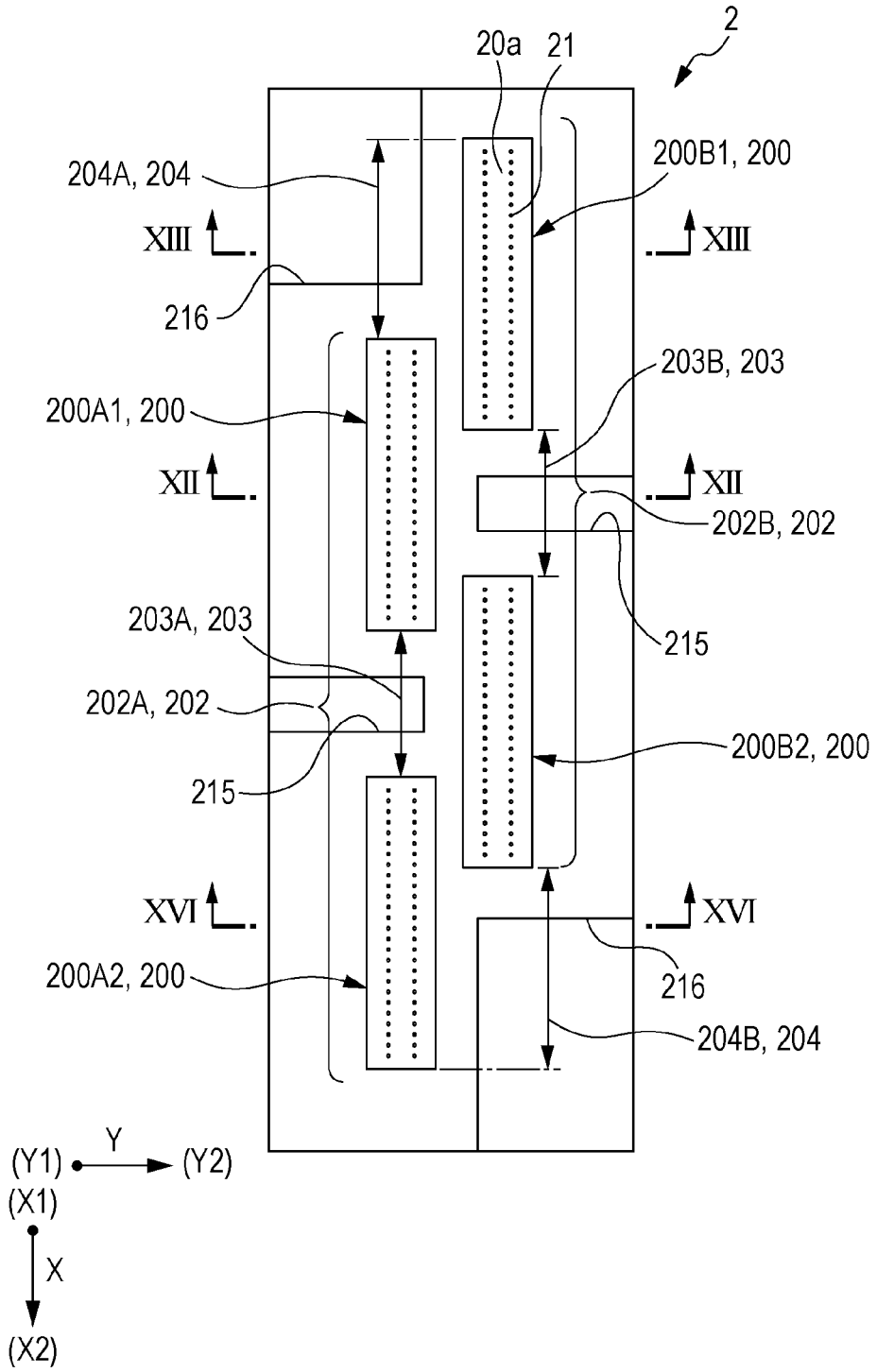
FIG. 8 is a bottom view of the recording head according to Embodiment 1.
Figure 9:
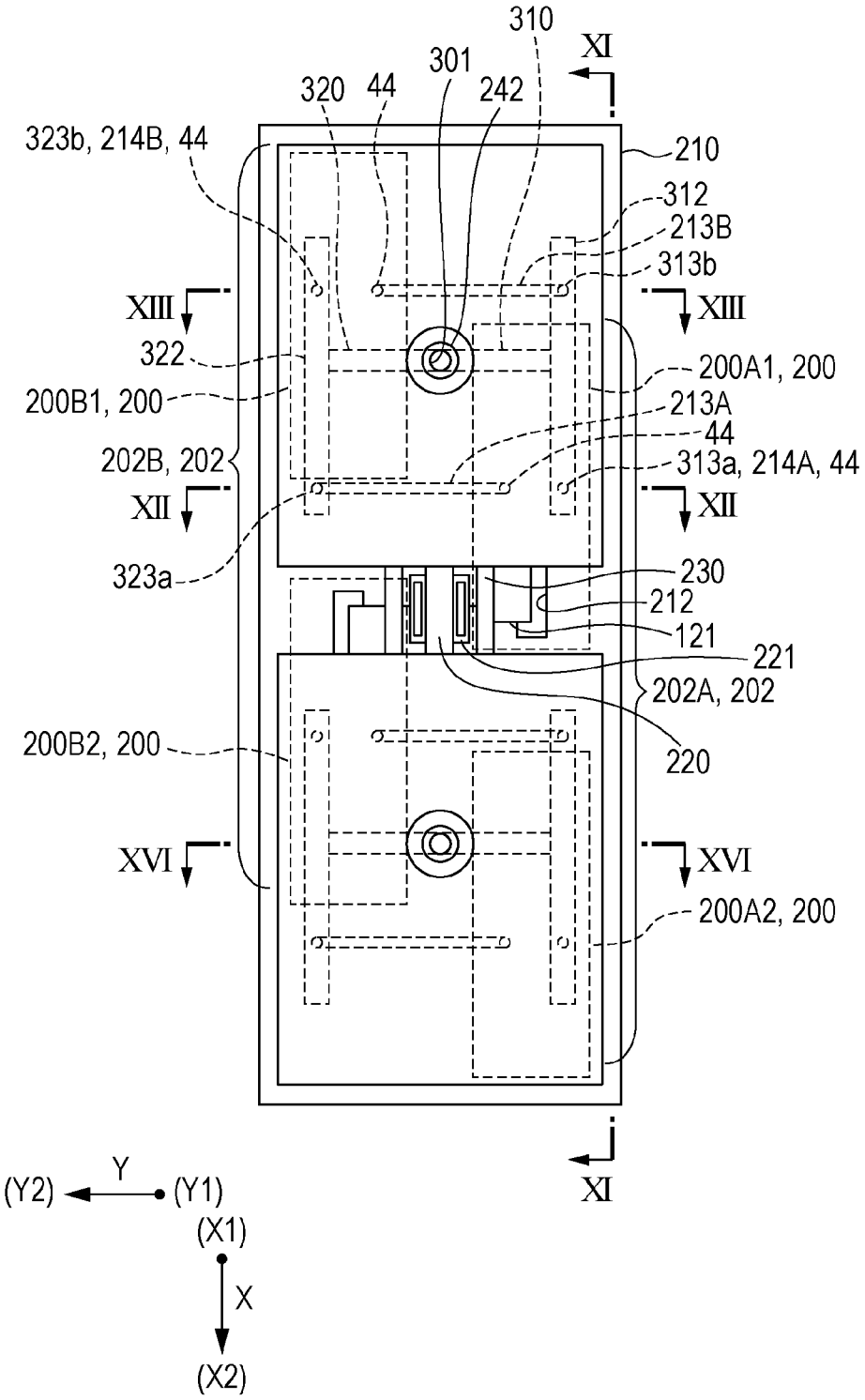
FIG. 9 is a plan view of the recording head with the cover member removed.
Figure 10:
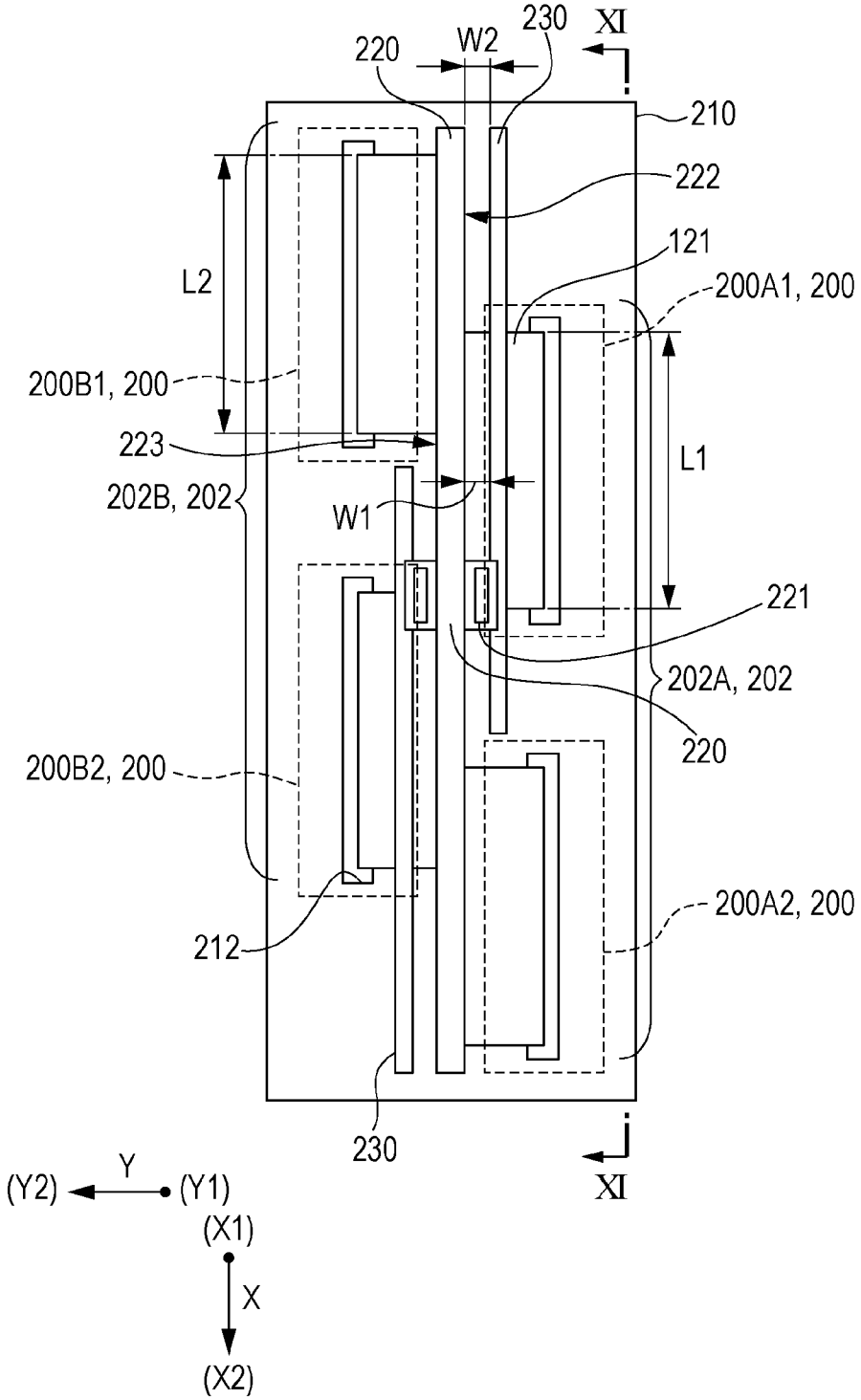
FIG. 10 is a plan view of the recording head with the cover member and the flow channel member removed.
Figure 11:
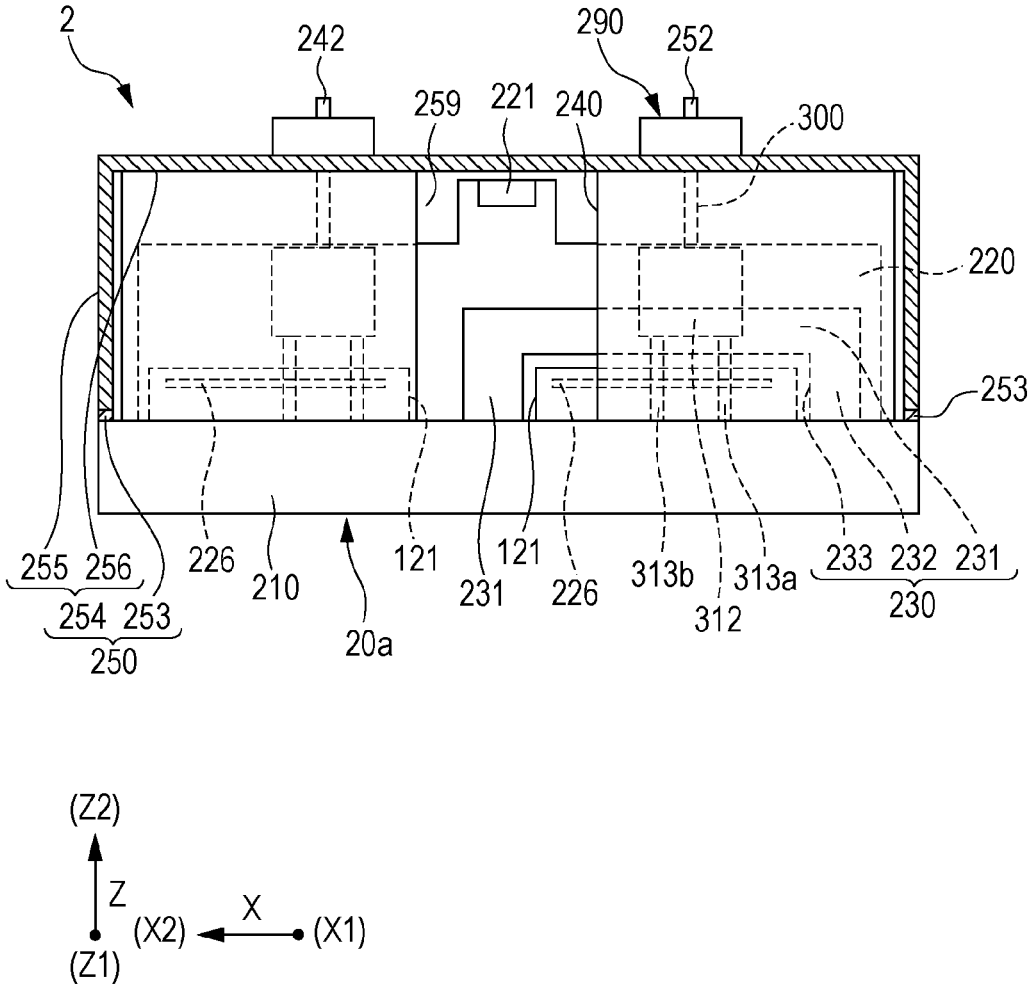
FIG. 11 is a cross-sectional view taken along the line XI-XI in FIGS. 9 and 10.
Figure 12:
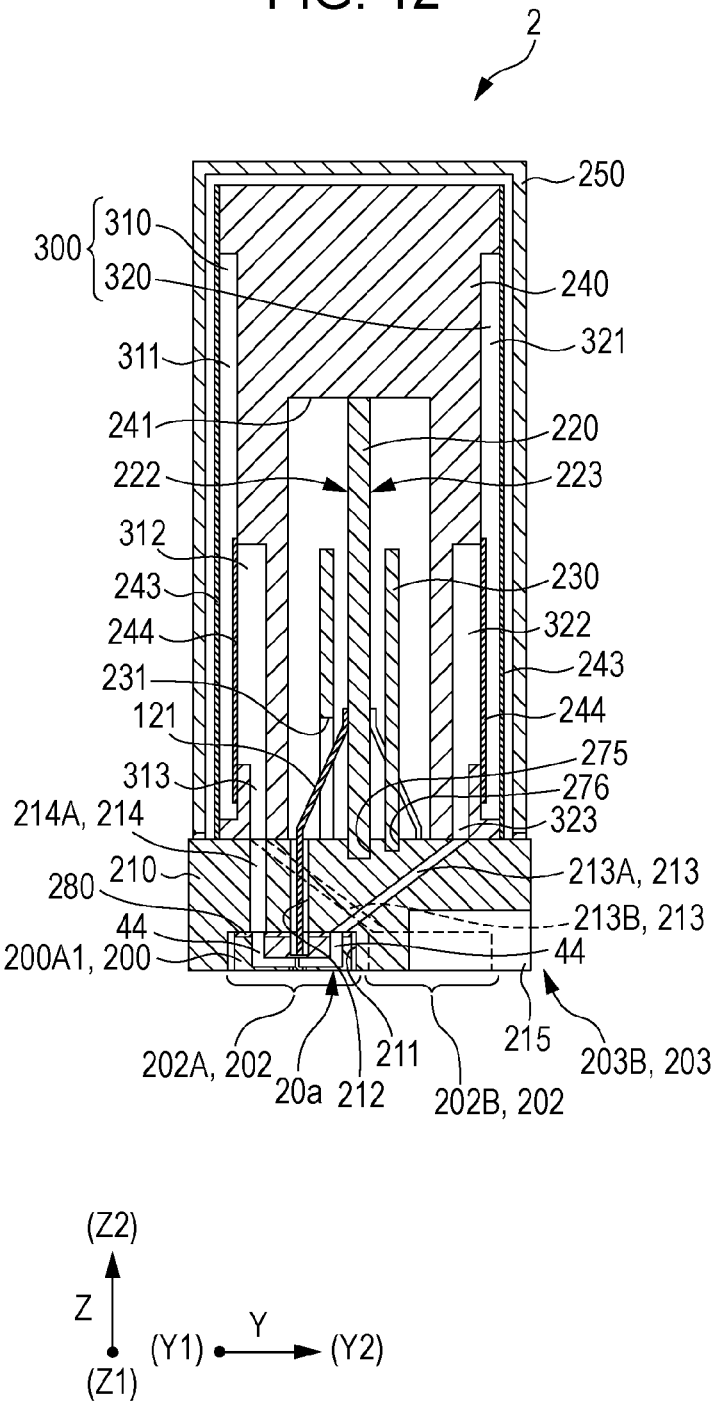
FIG. 12 is a cross-sectional view taken along the line XII-XII in FIGS. 7 to 9.
Figure 14A:
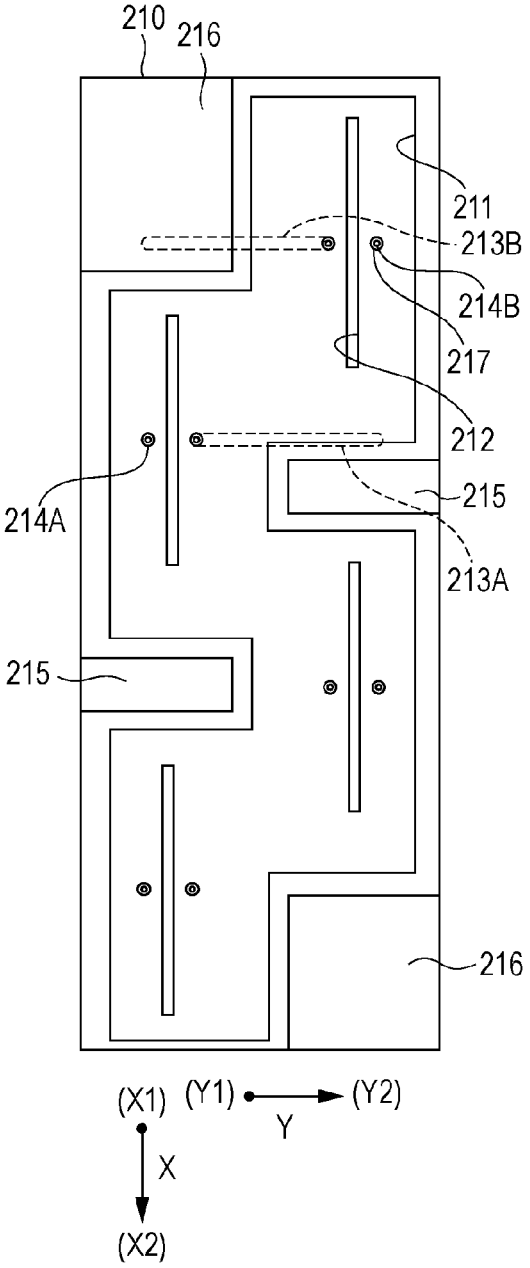
FIGS. 14A and 14B are bottom views of a holder member.
Figure 14B:
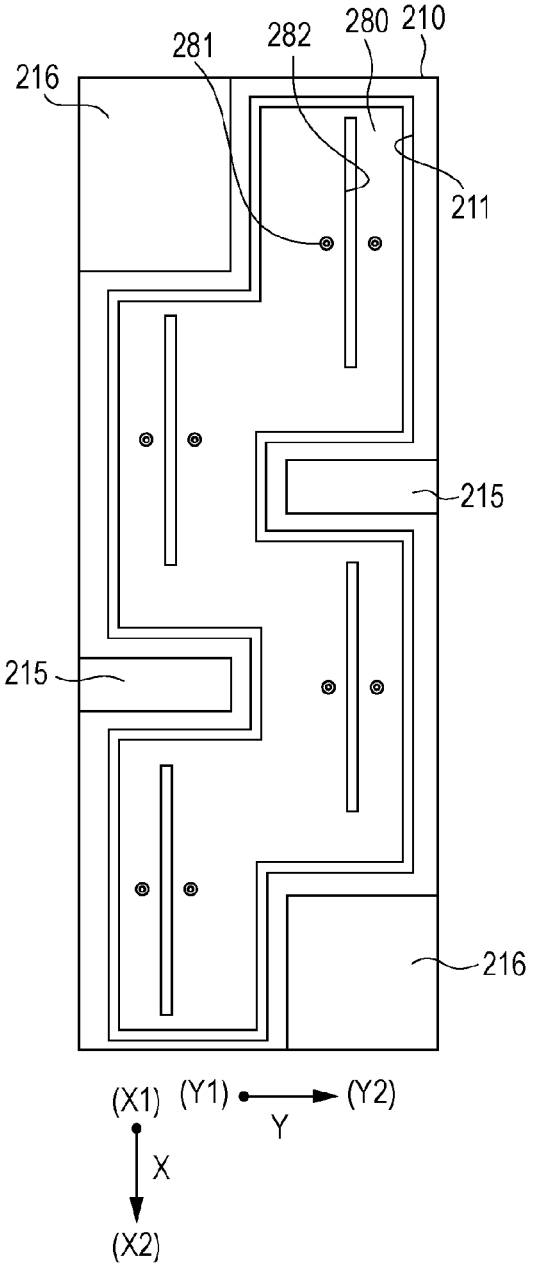
Figure 15:
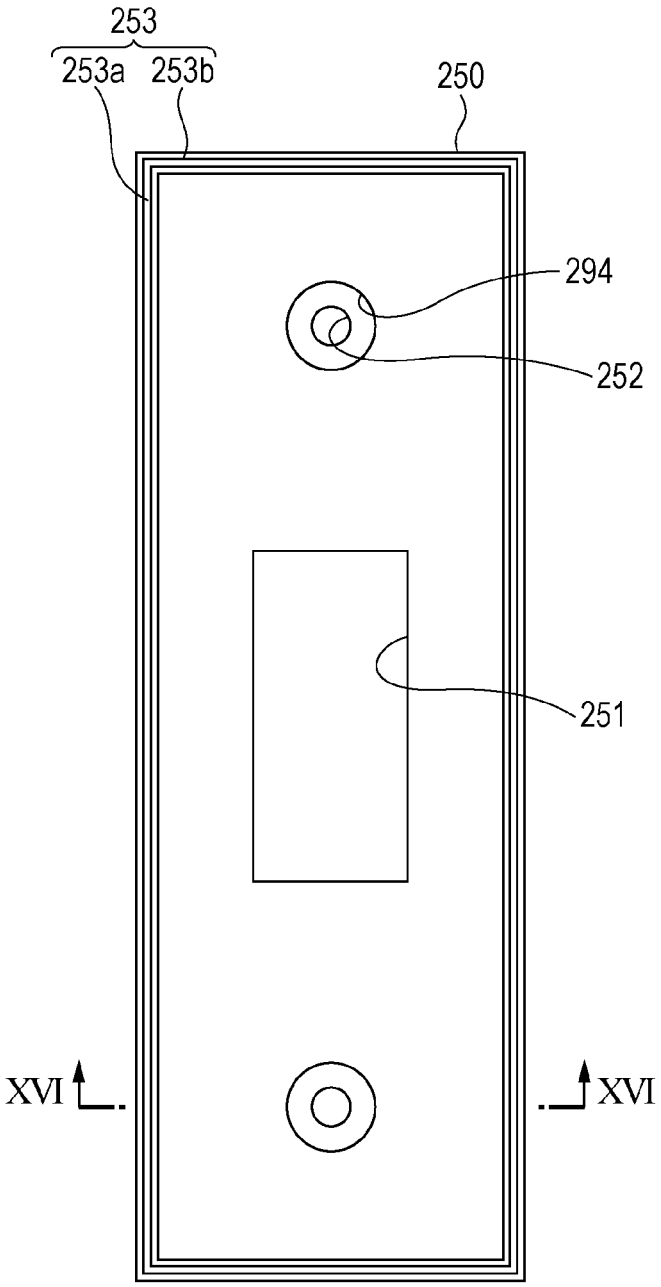
FIG. 15 is a bottom view of a cover member.
Figure 15:
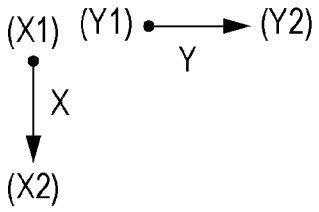
Figure 16:
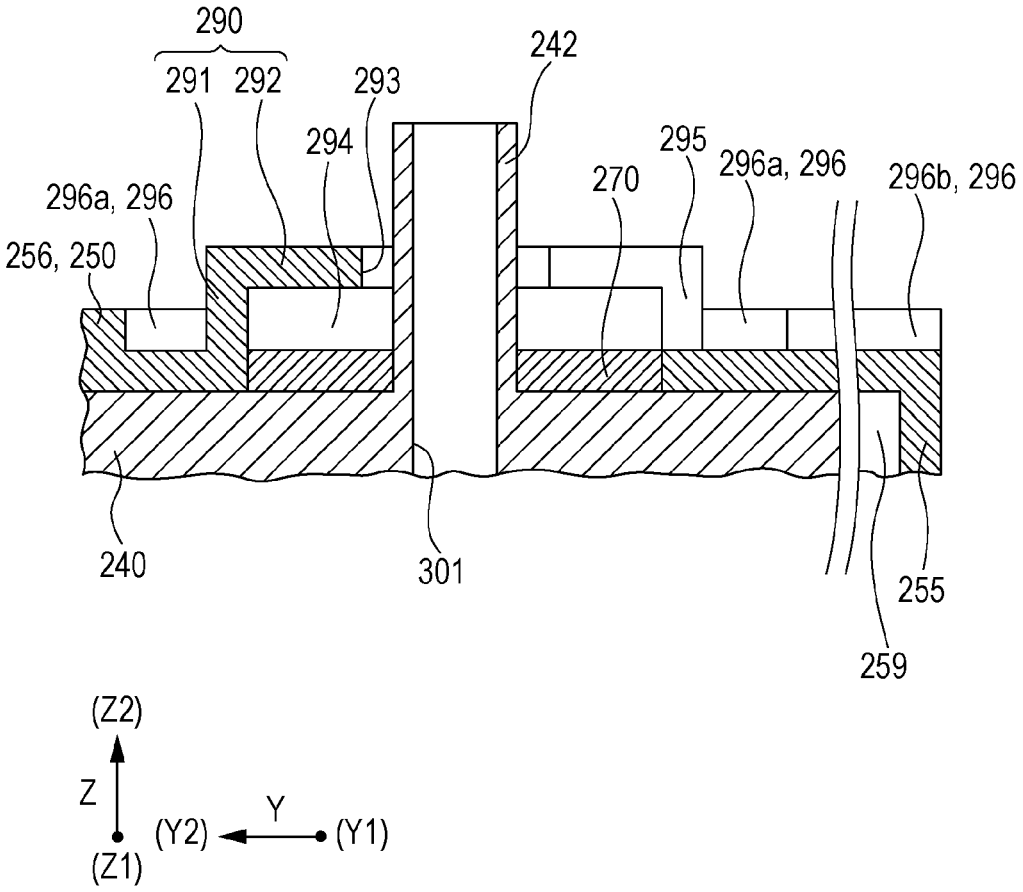
FIG. 16 is a cross-sectional view taken along line XVI-XVI in FIGS. 7 to 9, and FIG. 15.

The head main body 200 described above is held in the recording head 2. The recording head 2 will be described with reference to FIGS. 3 to 6, and, additionally, FIGS. 7 to 17E. FIG. 7 is a plan view of the recording head, FIG. 8 is a bottom view of the recording head, FIG. 9 is a plan view of the recording head with the cover member removed, FIG. 10 is a plan view of the recording head with the cover member and the flow channel member removed, FIG. 11 is a cross-sectional view taken along the line XI-XI in FIGS. 9 and 10, FIG. 12 is a cross-sectional view taken along the line XII-XII in FIGS. 7 to 9, FIG. 13 is a cross-sectional view taken along line XIII-XIII in FIGS. 7 to 9 and 15, FIG. 14A is a bottom view of a holder member to which the second correction plate is fixed, FIG. 14B is a bottom view of the holder member, FIG. 15 is a bottom view of a cover member, FIG. 16 is a cross-sectional view taken along line XVI-XVI in FIGS. 7 to 9, and FIGS. 17A to 17E are main portion cross-sectional views showing the rigid parts of the cover member. The plane of FIGS. 7, 9, and 10 is the surface of the Z2 side in the third direction Z, and the bottom surface in FIGS. 8, 14A, 14B, and 15 is the surface of the Z1 side in the third direction Z.

As shown in FIGS. 5, 6, and 8, in the embodiment, four head main bodies 200 are arranged in a zig-zag pattern along the first direction X in one recording head 2. Specifically, a first head main body group 202A arranged spaced with a first interval 203A in the first direction X and a second head main body group 202B arranged spaced by a second interval 203B in the first direction X are included. Each head main body 200 is held such that the arrangement direction of the nozzle openings 21 is the first direction X of the recording head 2.

The head main body group 202 provided on the Y1 side is referred to as the first head main body group 202A, and head main body group 202 provided on the Y2 side is referred to as the second head main body group 202B. The head main body 200 on the X1 side of the first head main body group 202A is referred to as the head main body 200A1, and the head main body 200 on the X2 side is referred to as the head main body 200A2. The head main body 200 on the X1 side of the second head main body group 202B is referred to as the head main body 200B1 and the head main body 200 on the X2 side is referred to the head main body 200B2.

In each head main body 200, the first head main body group 202A and the second head main body 202B are arranged at different positions in the second direction Y orthogonal to the first direction X, and any of the head main bodies 200 in the first head main body group 202A is arranged at the position in the first direction X at which the second interval 203B is provided, and any of the head main bodies 200 in the second head main body group 202B is arranged at a position at which the first interval 203A is provided.

That is, the first head main body group 202A and the second head main body group 202B are arranged shifted from one another in the first direction X. The amount of shift in the first direction X of the first head main body group 202A and the second head main body group 202B is half the pitch of the head main body 200 that configures the head main body group 202. In the embodiment, the first head main body group 202A is arranges shifted to the X2 side with respect to the second head main body group 202B. That is, the first interval 203A of the head main bodies 200 adjacent to one another in the first direction X in the first head main body group 202A is provided facing the head main body 200 that configures the second head main body group 202B, in the embodiment, the head main body 200B2 in the second direction Y. The second interval 203B of the head main bodies 200 adjacent to one another in the first direction X in the second head main body group 202B is provided opposing the head main body 200 that configures the first head main body group 202A, in the embodiment, the head main body 200A1 in the second direction Y. By providing the first head main body group 202A and the second head main body group 202B in this way, it is possible for the nozzle openings 21 to be continuously arranged spanning the first direction X at a uniform pitch with four head main bodies 200.

As shown in FIGS. 9 to 14B and 28, the holder member 210 holds the plurality of head main bodies 200 to the surface opposing the recording sheet S, that is, the surface of the Z1 side in the third direction Z. Specifically, a head holding portion 211 having a concave shape open to the Z1 side in the surface of the Z1 side of the holder member 210 is provided. The head holding portion 211 accommodates the second correction plate 280, described later, and further accommodates the plurality of head main bodies 200 fixed by the fixing plate 260. The opening of the head holding portion 211 is sealed by the fixing plate 260. That is, the head main bodies 200 and the second correction plate 280 are accommodated in the inner portion formed by the head holding portion 211 and the fixing plate 260.

The head holding portion 211 has a shape able to accommodate each head main body 200 arranged so as to configure the first head main body group 202A and the second head main body group 202B. In the embodiment, the head holding portion 211 by four concavities having a rectangular opening slightly larger than each head main body 200 being communicated so as to face the position of the head main bodies 200 that configure the first head main body group 202A and the second head main body group 202B is provided. In other words, the head holding portion 211 is formed by providing the concavity in a region outside the first accommodation portion 215 and the second accommodation portion 216, described later, on the surface of the Z1 side of the holder member 210 having a substantially rectangular external shape.

Although described in detail later, the first connection flow channels 213A and 213B and the second connection flow channels 214A and 214B are provided in the holder member 210 as an example of the first flow channel. The first flow channel is a flow channel provided in the holder member 210, and is a flow channel to which ink is supplied from the flow channel member 240 and that supplies ink to the head main body 200.

The first connection flow channel 213 is a flow channel provided in the holder member 210 inclined with respect to the third direction Z. In the embodiment, two first connection flow channels 213A and first connection flow channels 213B are provided in the holder member 210 as the first connection flow channel 213 with respect to the flow channel member 240, head main body 200A1 and head main body 200B1 on the X1 side. Two first connection flow channels 213A and first connection flow channels 213B are provided in the holder member 210 as the first connection flow channel 213 similarly to the flow channel member 240, head main body 200A2, and head main body 200B2 on the X2 side.

The first connection flow channel 213A communicates the second supply path 323 of the flow channel member 240 (second supply path 323*a* on the X2 side from the two present) with the introduction port 44 on the Y2 side of the head main body 200A1 on the X1 side of the first head row 202A. The first connection flow channel 213B communicates the first supply path 313 of the flow channel member 240 (first supply path 313*b* on the X1 side from the two present) with the introduction port 44 on the Y1 side of the head main body 200B1 on the X1 side of the second head row 202B. The same applies to the first connection flow channel that connects the flow channel member 240 on the X2 side with the head main body 200A2 and the head main body 200B2.

A protrusion 217 projected to the Z1 side in the third direction Z is provided on the bottom surface of the head holding portion 211, and the opening in the Z1 side of the first connection flow channels 213A and 213B open in the top surface of the protrusion 217. The opening in the Z2 side of the first connection flow channel 213A is opened at a position facing the second supply path 323*b* of the flow channel member 240, described later. The opening in the Z2 side of the first connection flow channel 213B is opened at a position facing the first supply path 313*a* of the flow channel member 240, described later. The same applies to the first connection flow channel that connects the flow channel member 240 on the X2 side with the head main body 200A2 and the head main body 200B2.

The second connection flow channel 214 is a flow channel extended to the holder member 210 along the third direction Z. In the embodiment, two second connection flow channels 214A and second connection flow channels 214B are provided in the holder member 210 as the second connection flow channel 214 with respect to the flow channel member 240, head main body 200A1 and head main body 200B1 on the X1 side. Two second connection flow channels 214A and second connection flow channels 214B are provided in the holder member 210 as the second connection flow channel 214 similarly to the flow channel member 240, head main body 200A2, and head main body 200B2 on the X2 side.

The second connection flow channel 214A communicates the first supply path 313 of the flow channel member 240 (first supply path 313*a* on the X2 side from the two present) with the introduction port 44 on the Y1 side of the head main body 200A1 on the X1 side of the first head row 202A. The second connection flow channel 214B communicates the second supply path 323 of the flow channel member 240 (second supply path 323*b* on the X1 side from the two present) and the introduction port 44 on the Y2 side of the head main body 200B1 on the X1 side of the second head row 202B. The same applies to the second connection flow channel that connects the flow channel member 240 on the X2 side with the head main body 200A2 and the head main body 200B2.

A protrusion 217 projected to the Z1 side in the third direction Z is provided on the bottom surface of the head holding portion 211, and the opening in the Z1 side of the second connection flow channels 214A and 214B open in the top surface of the protrusion 217. The opening in the Z2 side of the second connection flow channel 214A is opened at a position facing the first supply path 313*a* of the flow channel member 240, described later. The opening in the Z2 side of the second connection flow channel 214B is opened at a position facing the second supply path 323*b* of the flow channel member 240, described later. The same applies to the first connection flow channel that connects the flow channel member 240 on the X2 side with the head main body 200A2 and the head main body 200B2.

The first wiring insertion hole 212 opened in the bottom surface of the head holding portion 211 is provided in the holder member 210. The first wiring insertion hole 212 is a wiring insertion hole formed in the member as the holder of the aspect. The first wiring insertion hole 212 penetrates the head holding portion 211 and the Z2 side of the holder member 210.

The second correction plate 280 is accommodated in the head holding portion 211. The second correction plate 280 is formed from a plate-like member fixed to the surface of the Z1 side of the holder member 210, and is arranged such that surface direction of the liquid ejecting surface 20*a*, that is, the direction that includes the first direction X and the second direction Y is the surface direction. In the embodiment, the second correction plate 280 is formed in a shape able to be accommodated in the head holding portion 211, and, specifically, is formed by notching a region facing the first accommodation portion 215 and the second accommodation portion 216 from the substantially rectangular plate-like members.

The second correction plate 280 has a size that covers the liquid ejecting surface 20*a* of all of the head main bodies 200, that is, the nozzle plate 20, in plan view with respect to the liquid ejecting surface 20*a*. The second correction plate 280 is accommodated by and adhered to the head holding portion 211 by the adhesive. Naturally, the head holding portion 211 is preferably fixed to the holder member 210 by a fixing unit such as a screw without using the adhesive, or is preferably fixed to the holder member by being interposed between the holder member 210 and another member (for example, such as a head main body 200).

The second wiring insertion hole 282 that communicates with the first wiring insertion hole 212 provided in the holder member 210 is formed in the second correction plate 280. The first wiring insertion hole 212 and the second wiring insertion hole 282 become one communication hole by communicating. The wiring substrate 121 of the head main body 200 held in the head holding portion 211 is drawn to the Z2 side of the holder member 210 via the first wiring insertion hole 212 and the second wiring insertion hole 282, and the drawn end portion of the wiring substrate 121 is connected to the circuit substrate 220.

The opening 281 penetrating in the third direction Z is provided in the second correction plate 280. The opening 281 has an opening shape of an extent to which the protrusion 217 provided on the holder member 210 is inserted. The protrusion 217 inserted in the opening 281 is bonded to the case member 40 of the head main body 200, and the first connection flow channel 213 and the second connection flow channel 214 opened in the top surface of the protrusion 217 penetrate the introduction port 44 of the head main body 200.

In this way, the second connection flow channel 214 is extended linearly along the third direction Z in the holder member 210. The opening 281 penetrating in the third direction Z is provided in the second correction plate 280. By the protrusion 217 in which the second connection flow channel 214 is opened being inserted in the opening 281 along the third direction Z, it is possible for the second connection flow channel 214 to communicate with the introduction port 44 of the head main body. According to the opening 281 in the second correction plate with such a structure, since the opening is preferably formed as a through hole along the third direction Z, working of the second correction plate 280 is easy. That is, it is not necessary to provide the opening 281 inclined with respect to the third direction Z similarly to the second connection flow channel 214.

The second correction plate 280 is formed from a material with a higher rigidity than the holder member 210, for example, a metal plate or the like, and corrects distortion or torsion in the plane including the first direction X and the second direction Y of the holder member 210 by bonding to the holder member 210. In other words, even if distortion or torsion occurs during manufacturing or during heating of the holder member 210, it is possible to maintain a state in which distortion or torsion of the holder member 210 is corrected by bonding the second correction plate 280 to the holder member 210 in a state in which the distortion or torsion of the holder member 210 is maintained. In so doing, it is possible to improve the flatness of the surface of the Z1 side to which the head main body 200 of the holder member 210 is bonded, and suppress shifting of the landing position of the ink on the recording sheet S.

The second correction plate 280 as described above has a size that covers the all of the nozzle plates 20 that are the liquid ejecting surfaces 20*a* of the head main bodies 200, and is bonded to the holder member 210. That is, since the second correction plate 280 is adhered to the holder member 210 that holds all of the head main bodies 200, it is possible to more reliably correct distortion or torsion during manufacturing or the like. It is possible for the rigidity of the recording head 2 to be further improved with the second correction plate 280.

As shown in FIGS. 3, 5, 6, 8 and 28, the fixing plate 260 that covers the opening of the head holding portion 211 is provided on the surface of the Z1 side of the holder member 210 in which the second correction plate 280 and the head main bodies 200 are held in the head holding portion 211.

The fixing plate 260 is a member to which the head main body 200 is fixed. In the embodiment, the fixing plate 260 is formed by folding a plate-like member, and is provided with a nozzle surface forming portion 263 provided on the liquid ejecting surface 20*a* and a folded portion 261 provided by bending a portion of the outer edge of the nozzle surface forming portion 263 to the Z2 side in the third direction Z.

The second exposure opening portion 262 that exposes the liquid ejecting surface 20*a* of the head main body 200 is formed in the nozzle surface forming portion 263 of the fixing plate 260. Four second exposure opening portions 262 are formed so as to independently expose the liquid ejecting surface 20*a* of each head main body 200.

The fixing plate 260 is bonded to the Z1 side in the third direction Z that is the opposite side to the communication plate 15 of the compliance substrate 45 of the head main body 200. The fixing plate 260 seals the compliance portion 49 and suppresses ink from attaching to the compliance portion 49.

The part facing the holder member 210 in the nozzle surface forming portion 263 of the fixing plate 260 and the folded portion 261 are fixed to the holder member 210 by a fixing unit such as an adhesive or a screw. That is, the plurality of head main body 200 is accommodated in the head holding portion 211 of the holder member 210 in a state of being fixed to the fixing plate 260.

For each head main body 200 fixed to the fixing plate 260, the surface of the Z2 side of the case member 40 is adhered to the surface of the Z1 side of the second correction plate 280 with an adhesive. The adhesive functions as a seal that suppresses ink from leaking from the introduction port 44 of the case member 40 and the boundary between the first connection flow channel 213 and the second connection flow channel 214 communicating with the introduction port 44.

The configuration preferably separates the head main body 200 and the second correction plate 280 without adhering the head main body 200 to the second correction plate 280.

When the head main body 200 and the second correction plate 280 are adhered as in the embodiment, the two types of components, head main body 200 and second correction plate 280, are arranged between the holder member 210 and the fixing plate 260. Accordingly, it is necessary that the depth in the third direction Z of the head holding portion 211 in which the components are accommodated be designed with a dimensional tolerance taking the head main body 200 and the second correction plate 280 into consideration.

Meanwhile, examples of a configuration that separates the head main body 200 and the second correction plate 280 include a configuration in which surface of the Z2 side of the head main body 200 is adhered to the surface of the Z1 side of the holder member 210, and the liquid ejecting surface 20*a* side is adhered to the fixing plate 260 in a state in which the introduction port 44 communicates with the first connection flow channel 213 and the second connection flow channel 214. Examples also include a configuration in which the second correction plate 280 is adhered only to the surface of the Z1 side of the holder member 210 and not adhered to the head main body 200.

In the recording head 2 of such a configuration substantially the only component arranged between the holder member 210 and the fixing plate 260 is the head main body 200. Accordingly, the depth in the third direction Z of the head holding portion 211 is preferably designed with a dimensional tolerance taking one type of head main body 200 into consideration. In this way, since it is possible to reduce the dimensional tolerance in the third direction Z by the amount that the second correction plate 280 is reduced as a component in direct contact between the holder member 210 and the fixing plate 260, it is possible for size reductions in the third direction Z of the recording head 2 to be achieved.

Meanwhile, in the holder member 210, the circuit substrate 220, the first correction plate 230, the flow channel member 240, and the cover member 250 are fixed to the surface of the Z2 side in the third direction Z.

As shown in FIGS. 4 and 9 to 13, the circuit substrate 220 includes a substrate 225 along the third direction Z that is a direction perpendicular to the liquid ejecting surface 20*a*, and connection portions 226 that are provided on both surfaces of the substrate 225 and are electrically connected to the wiring substrate 121. The circuit substrate 220 is fixed in a state of being erected on the surface of the Z2 side of the holder member 210. That is, the circuit substrate 220 is fixed to the Z2 side of the holder member 210 in a state in which the direction that includes the first direction X and the third direction Z is the surface direction. The fixing position of the circuit substrate 220 is the approximate center of in the second direction Y of the holder member 210, and is provided at a position corresponding to between two rows of the head main body groups 202. That is, each head main body group 202 is arranged with the circuit substrate 220 interposed.

Wiring substrates 121 having flexibility and drawn from each head main body 200 are respectively electrically connected to the circuit substrate 220. In the embodiment, the wiring substrate 121 of the head main body 200 that configures the first head main body group 202A provided on the Y1 side of the second direction Y of the circuit substrate 220 is connected to the first surface 222 of the Y1 side of the circuit substrate 220. Similarly, the wiring substrate 121 of the head main body 200 that configures the second head main body group 202B provided on the Y2 side in the second direction Y of the circuit substrate 220 is connected to the second surface 223 of the Y2 side of the circuit substrate 220. That is, the wiring substrate 121 of each head main body 200 is connected to both sides of the circuit substrate 220, respectively, without extending over the second direction Y of the circuit substrate 220.

In the embodiment, as shown in FIG. 10, a region L1 to which the wiring substrate 121 drawn from the head main body 200 of the first head main body group 202A is connected and a region L2 to which the wiring substrate 121 drawn from the head main body 200 of the second head main body group 202B is connected are arranged so as at least partially overlap in the second direction Y. Because connection of the circuit substrate 220 and the wiring substrate 121 is performed on both of the first surface 222 and the second surface 223 of the circuit substrate 220, even in a case in which portions of the head main body 200 overlap in the second direction Y and portions of the regions L1 and L2 connected to the circuit substrate 220 of the wiring substrate 121 overlap one another in the second direction Y, it is possible for connection of the wiring substrate 121 of the head main body 200 and the circuit substrate 220 to be easily performed.

In contrast, for example, in a case of connecting the wiring substrates 121 of all of the head main bodies 200 to only one surface of the circuit substrate 220, the wiring substrates 121 interfere with each other. Therefore, in order that the connection parts of the wiring substrates 121 not interfere with one another, it is necessary to change the part at which the wiring substrate 121 is connected to the circuit substrate 220 to a different position in the third direction Z, and the circuit substrate 220 increases in size in the third direction Z. In the embodiment, because the wiring substrate 121 connects to both surfaces of the circuit substrate 220, it is possible to decrease the size of the circuit substrate 220 in the third direction Z.

The arrangement in which the region L1 to which the wiring substrate 121 drawn from the head main body 200 of the first head main body group 202A is connected and the region L2 to which the wiring substrate 121 drawn from the head main body 200 of the second head main body group 202B is connected at least partially overlap is because a wiring substrate 121 with a wide width in the first direction X is used in the second direction Y. In a case of using a wiring substrate 121 with a narrow width in the first direction X, the connection parts of the wiring substrate 121 to the circuit substrate 220 are not at positions overlapping each other in the second direction Y.

However, because, in recent years, there is demand for a head main body 200 with increased nozzles in which numerous nozzle openings are provided or with increased density in which the nozzle openings are arranged at a high density, the number of wirings accompanying the increase in nozzles is increased, along with size reductions being achieved accompanying the increased density of the nozzle openings. Accordingly, narrowing the width in the first direction X of the wiring substrate 121 is difficult, and the width in the first direction X of the wiring substrate 121 is substantially approximately the same as the width in the first direction X of the head main body 200.

Because arranging is possible such that the wiring substrates 121 connected to the first surface 222 and the second surface 223 of the wiring substrate 121 partially overlap, it is possible to freely design the amount that the head main bodies 200 adjacent in the first direction X overlap in the second direction Y. Accordingly, it is possible for the number of nozzle openings 21 at the same position in the second direction Y of the head main bodies 200 adjacent in the first direction X to be increased, and it is possible to reduce deterioration of the printing quality at joins in the first direction X of the head main bodies 200.

Figure 13:
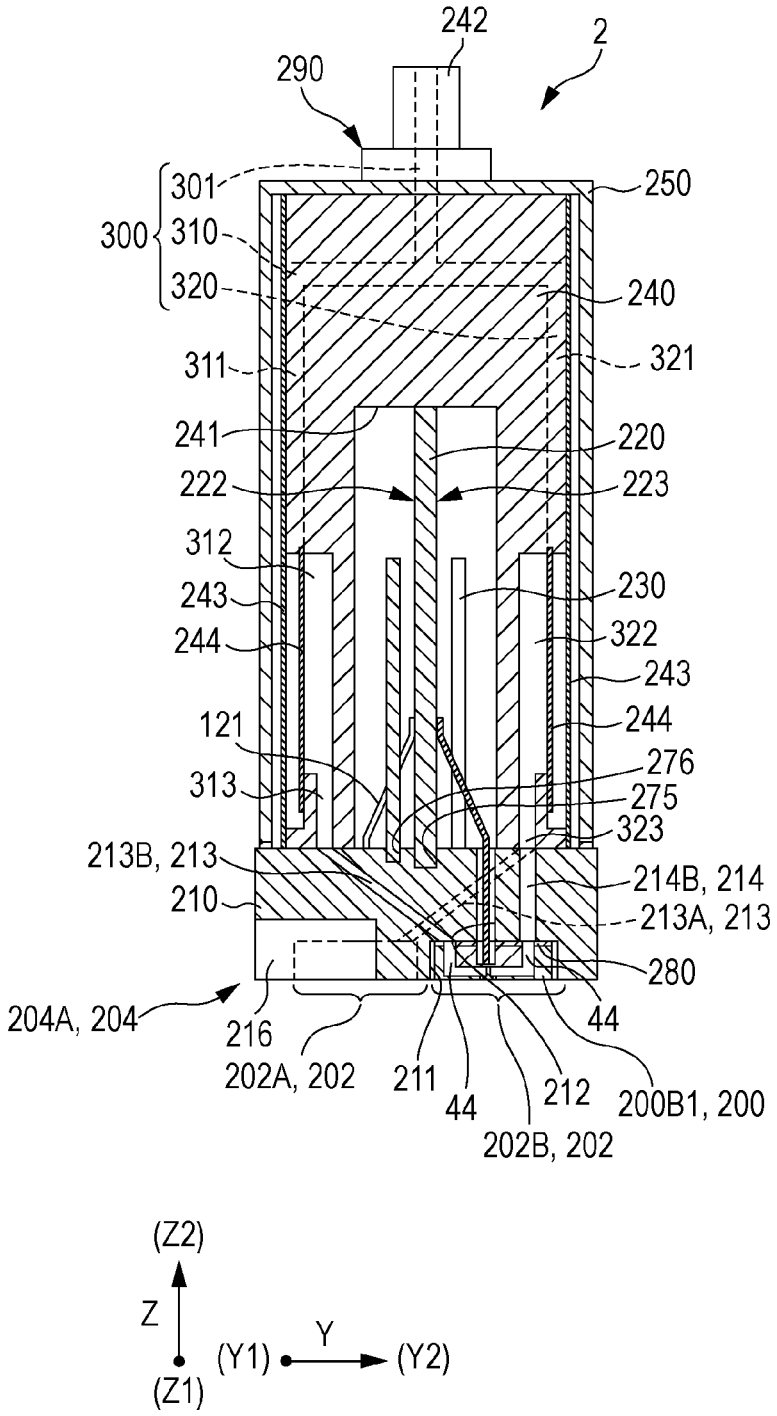
FIG. 13 is a cross-sectional view taken along line XIII-XIII in FIGS. 7 to 9.

As shown in FIGS. 12 and 13, the regions L1 and L2 to which the wiring substrates 121 of the circuit substrate 220 are connected are provided further to the opposite side to the liquid ejecting surface 20*a* in the third direction Z than the surface to which the flow channel 300 of the flow channel member 240 of the holder member 210 is connected. In so doing, when connecting the wiring substrate 121 and the circuit substrate 220 with a heat seal or the like, there is no interference with the parts to which the flow channel 300 of the holder member 210 is connected, and it is possible to easily and reliably connect the wiring substrate 121 and the circuit substrate 220.

Since the circuit substrate 220 is erected perpendicular with respect to the liquid ejecting surface 20*a*, it is possible for the region occupied by the circuit substrate 220 to be reduced in the surface direction of the liquid ejecting surface 20*a*. In so doing, it is possible for the size of the recording head 2 to be reduced in the surface direction of the liquid ejecting surface 20*a*.

In the circuit substrate 220, a connector 221 that is an example of an electronic component is provided on the opposite side to the holder member 210 in the third direction Z, that is, the end portion of the Z2 side. The connector 221 of the circuit substrate 220, in the embodiment, extends the circuit substrate 220 to the Z2 side between two flow channel members 240, and is provided on each of the surface of the Y1 side and the surface of the Y2 side of the extended end portion. A controller is connected to the connector 221 via an external wiring, not shown. In so doing, a signal or the like from the controller is supplied to the circuit substrate 220 via the connector 221, and supplied from the circuit substrate 220 to the head main body 200 via the wiring substrate 121. A connector exposure hole 251 for exposing the connector 221 to the outside is provided in a region corresponding to the connector 221 in the cover member 250, and an external wiring is connected to the exposed connector 221 by the connector exposure hole 251.

As shown in FIGS. 10 to 13, the first correction plate 230 has a planar shape, and is a member for correction the holder member 210. Specifically, the first correction plate 230 includes a correction main body portion 231 having a plane that includes the first direction X and the third direction Z, an opening unit 233 provided in the correction main body portion 231 and in which the wiring substrate 121 is inserted, and leg portions 232 provided on both sides in the first direction X of the opening portion 233.

The first correction plate 230 is fixed to the surface of the Z2 side of the holder member 210, and is arranged so as to oppose each of both sides of the circuit substrate 220. In the embodiment, a set of the first correction plates 230 is fixed to the surface of the Z2 side of the holder member 210 with the circuit substrate 220 interposed. Two or more sets of first correction plates 230 are preferably included.

As shown in FIG. 11, the first correction plate 230 extends over the connection portion 226 of the circuit substrate 220 in the third direction Z that is direction perpendicular to the liquid ejecting surface 20*a*. The first correction plate 230 referred to here extending over the connection portion 226 refers to the position in the third direction Z of the correction main body portion 231 and the leg portion 232 overlapping at least the position in the third direction Z of the connection portion 226 in plan view of the circuit substrate 220. In other words, a straight line along the third direction Z passes through at least a portion of the correction main body portion 231 and the leg portion 232 and a portion of the connection portion 226. In the embodiment, the correction main body portion 231 spans the entire width in the first direction X of the connection portion 226, and overlaps in the third direction Z. Since the size that extends over the connection portion 226 is formed to be the entire width in the first direction X of the connection portion 226, it is possible for the correction main body portion 231 to strengthen the correction of the holder member 210. The correction main body portion 231 preferably does not necessarily extend over the connection portion 226 of the circuit substrate 220.

By providing the opening portion 233 in the correction main body portion 231, it is possible to reduce the size of the recording head 2 in the third direction Z compared to a case of using the first correction plate 230 not having the opening portion 233.

Naturally, in a case of using the first correction plate not having the opening portion 233, the connection portion 226 of the circuit substrate 220 should be bonded by the wiring substrate 121 being detoured so as to exceed the apex of the Z2 side of the first correction plate in the third direction Z. That is, the connection portion 226 of the circuit substrate 220 should be arranged further to the Z2 side in the third direction Z than the first correction plate 230, and the size of the circuit substrate 220 in the third direction Z increases.

In the embodiment, since the correction main body portion 231 extends over the connection portion 226, it is possible for the wiring substrate 121 to be connected to the connection portion 226 through the opening portion 233. That is, since at least a portion of the connection portion 226 overlaps the correction main body portion 231, it is possible to reduce the size of the circuit substrate in the third direction Z of the circuit substrate 220. In so doing, it is possible to achieve size reductions in the third direction Z of the recording head 2.

The first correction plate 230 has a smaller area than the circuit substrate 220, and is arranged with a space with the circuit substrate 220 on both surface sides of the circuit substrate 220. The first correction plate 230 has an opening portion 233 in which the wiring substrate 121 is able to be inserted at a position facing the connection portion 226 that connects the circuit substrate 220 and the wiring substrate 121 in the second direction Y. The opening portion 233 is formed by forming a concave notch from the end portion of the Z1 side fixed to the holder member 210 of the first correction plate 230 to partway along the Z2 side. In the embodiment, the first correction plate 230 has a shorter length than the first direction X of the holder member 210, and the two first correction plates 230 are arranged on the end portion side on the X1 side and the X2 side in the first direction X of each of the holder members 210. Specifically, the first correction plate 230 provided further to the Y1 side than the circuit substrate 220 is provided on the end portion side of the X1 side with respect to the holder member 210, and is formed with a length that does not reach the wiring substrate 121 of the head main body 200A2 on the X2 side. In other words, only one opening portion 233 in which the wiring substrate 121 of the head main body 200A1 is inserted is provided in the first correction plate 230 of the Y1 side, and the wiring substrate 121 of the head main body 200A2 on the X2 side is connected to the circuit substrate 220 on the X2 side that is the outside of the first correction plate 230. The first correction plate 230 provided further on the Y2 side is provided on the end portion side of the X2 side with respect to the holder member 210, and is formed with a length that does not reach the head main body 200B1 on the X1 side. In other words, only one opening portion 233 in which the wiring substrate 121 of the head main body 200B2 is inserted is provided in the first correction plate 230 of the Y2 side, and the wiring substrate 121 of the head main body 200A1 on the X1 side is connected to the circuit substrate 220 on the X1 side that is the outside of the first correction plate 230. The first correction plates 230 provided on the Y1 side and the Y2 side are provided with a portion opposing one another in the second direction Y in the center portion of the first direction X of the holder member 210.

That is, the two first correction plates 230 are provided spanning approximately the entire first direction X of the holder member 210 overlapping in the second direction Y.

The first correction plate 230 is formed from a material with a higher rigidity than the holder member 210, for example, a metal plate or the like, and corrects warping in the third direction Z of the holder member 210 by bonding to the holder member 210. In other words, even if warping occurs during manufacturing or during heating of the holder member 210, it is possible to maintain a state in which warping of the holder member 210 is corrected by bonding the first correction plate 230 to the holder member 210 in a state in which the warping of the holder member 210 is corrected. In so doing, the flatness of the surface of the Z1 side to which the head main body 200 of the holder member 210 is bonded is improved, and a recording head 2 in which shifting of the landing position of the ink on the recording sheet S is suppressed and ejection quality is improved is obtained.

The first correction plate 230 is arranged on both sides of the circuit substrate 220 so as to oppose the circuit substrate 220. In so doing, the first correction plate 230 not only corrects distortion or torsion during manufacturing, but also contributes to the improving the rigidity of the recording head 2.

The method of manufacturing the recording head 2 that is able to correct warping of the holder member 210 includes, with respect to the holder member 210 to which the fixing plate 260 is not fixed, the surface of the Z1 side in the third direction Z that is the surface of the side to which the fixing plate 260 of the holder member 210 is fixed, for example, being mounted on a member able to ensure flatness, such as ordinarily placed on, and being fixed to the first correction plate 230 such that the first correction plate 230 is pressed to the holder member 210 side. In so doing, it is possible to correct warping occurring in the mold of the holder member 210.

Although the first correction plate 230 is not formed with a length spanning the entire first direction X of the holder member 210 with one plate as described above, by arranging two first correction plates 230 shifted from one another in the first direction X, it is possible to form the two first correction plates 230 spanning approximately the entire first direction X of the holder member 210 by overlapping in the second direction Y, and it is possible to effectively correct warping of the holder member 210. Naturally, although forming the length of one first correction plate 230 spanning approximately the entire first direction X of the holder member 210 is considered, an extra region for forming the opening portion 233 becomes necessary, along with two opening portions 233 for inserting the wiring substrate 121 in the first correction plate 230 becoming necessary, and the size of the holder member 210 increases in the first direction X. In the embodiment, by providing one opening portion 233 for each of the two first correction plate 230, extra region on the first correction plate 230 becomes unnecessary, and it is possible to reduce the size of the holder member 210 in the first direction X.

As shown in FIG. 10, the circuit substrate 220 includes a connector 221 portion as an example of the electronic component as described above. The width that is the dimension of the connector 221 in the direction in which the set of first correction plates 230 are opposed, that is, the second direction Y, is W1. In the second direction Y, the interval between the circuit substrate 220 and the first correction plate 230 is W2.

The width W1 of the connector 221 is larger than the interval W2 between circuit substrate 220 and the first correction plate 230. As shown in FIG. 11, the connector 221 is arranged at a position that the first correction plate 230 is not facing from the circuit substrate 220. That is, in plan view with respect to the circuit substrate 220, the connector 221 is arranged at a position not overlapping the first correction plate 230 from the circuit substrate 220. In the embodiment, in the third direction Z, the connector 221 is arranged further to the Z2 side than the first correction plate 230.

In this way, even in a case in which the width W1 of the connector 221 is greater than the interval W2, by arranging the connector 221 further to the Z2 side than the first correction plate 230, it is possible for the first correction plate 230 to be arranged in close contact with the circuit substrate 220 such that the interval W2 is shorter than the width W1. In other word, it is not necessary to separate the first correction plate 230 from the circuit substrate 220 in the second direction Y by the width W1 or more so as not to interfere with the connector 221. Accordingly, it is possible to reduce the size in the second direction Y of the recording head 2.

Examples of the electronic component include condensers, transistors, and integrated circuits, in addition to the above-described connector 221. The dimensions of the connector 221 and the interval between the circuit substrate 220 and the first correction plate 230 are not limited to those described above.

As described above, the circuit substrate 220 and the first correction plate 230 are fixed in a state of being erected on the surface of the Z2 side of the holder member 210. Specifically, as shown in FIGS. 4 and 12, a circuit substrate fixing portion 275 as a concavity in which the circuit substrate 220 is inserted and a correction plate fixing portion 276 is provided as a concavity in which the first correction plate 230 is inserted are provided in the surface of the Z2 side of the holder member 210.

The circuit substrate fixing portion 275 is formed to be long along the first direction X, and formed with a width approximately the same as the width in the first direction X of the circuit substrate 220. The circuit substrate fixing portion 275 is positioned at the approximate center of the holder member 210 in the second direction Y.

The end portion of the Z1 side in the third direction Z of the circuit substrate fixing portion 275 is inserted in the circuit substrate fixing portion 275. By inserting the circuit substrate 220 in the circuit substrate fixing portion 275, the circuit substrate 220 is fixed to the holder member 210 in a state of being erected along the third direction Z.

The correction plate fixing portion 276 is formed to be long along the first direction X, and formed with a width approximately the same as the width in the first direction X of the leg portion 232 of the first correction plate 230. In the embodiment, since there are two leg portions 232 of the first correction plate 230, two correction plate fixing portions 276 are arranged along the first direction X for one first correction plate 230. The two correction plate fixing portions 276 arranged in parallel in the first direction X are provided on both sides in the second direction Y with the circuit substrate fixing portion 275 interposed.

The end portion of the Z1 side in the third direction Z of the leg portion 232 is inserted in the correction plate fixing portion 276. By the leg portion 232 being inserted in the correction plate fixing portion 276, the first correction plate 230 is fixed to the holder member 210 in a state of being erected along the third direction Z. The depth of the correction plate fixing portion 276 is made to an extent at which the opening portion 233 is able to be opened in the surface of the Z2 side of the holder member 210 in a state in which the leg portion 232 is inserted in the correction plate fixing portion 276, and the wiring substrate 121 is able to be inserted.

The first correction plate 230 and the circuit substrate 220 are fixed to the holder member 210 so as to follow the first connection flow channel 213 inclined with respect to the third direction Z.

That is, as shown in FIG. 12, in plan view that includes the second direction Y that is the direction in which the first connection flow channel 213 is extended and the third direction Z, the distance of the first connection flow channel 213 from the surface of the Z1 side of the holder member 210 becomes longer from the outside towards the center in the second direction Y. Meanwhile, the circuit substrate 220 positioned further to the center side in the second direction Y than the first correction plate 230 is inserted in the circuit substrate fixing portion 275 of the holder member 210 that is deeper to the Z1 side than the first correction plate 230.

By providing the first connection flow channel 213 inclined in this way in the holder member 210, it is possible for the region able to form the circuit substrate fixing portion 275 to be made larger than the correction plate fixing portion 276 in the central part in the second direction Y. In other words, the circuit substrate fixing portion 275 is easily formed without interfering with the first connection flow channel 213.

In so doing, it is possible to form the circuit substrate fixing portion 275 deeper than the correction plate fixing portion 276, and possible to deeply insert the circuit substrate 220. In so doing, since the connection portion 226 of the circuit substrate 220 approaches the Z1 side, it is possible for the wiring substrate 121 connected to the connection portion 226 to be shortened. In particular, in a case of the wiring substrate 121 being formed as a flexible cable, although expensive, since it is possible to shorten the wiring substrate 121, it is possible for costs according to the wiring substrate 121 to be reduced. Naturally, the first correction plate 230 and the circuit substrate 220 are preferably formed in the holder member 210 so as to follow the first connection flow channel 213.

As shown in FIGS. 9 and 11 to 13, the flow channel member 240 supplies ink introduced from the liquid storage unit 4 to the head main body 200, and a flow channel 300 that is an example of the second flow channel is provided in the interior thereof.

The flow channel member 240 of the embodiment is provided one at a time with respect to two head main bodies 200 that are in close contact in the second direction Y. That is, a flow channel member 240 shared by the head main body 200 on the X1 side of the first head main body group 202A and the head main body 200 on the X1 side of the second head main body group 202B and the flow channel member 240 shared by the head main body 200 on the X2 side of the first head main body group 202A and the head main body 200 on the X2 side of the second head main body group 202B are provided.

The flow channel members 240 are arranged on both sides of the circuit substrate 220 extending over the circuit substrate 220 in the second direction Y. In the embodiment, the flow channel members 240 are continuously provided extending over the circuit substrate 220 and the two first correction plates 230 in the second direction Y. Specifically, the flow channel member 240 has approximately the same width as the width of the holder member 210 in the second direction Y, and a concavity 241 opened to the surface of the Z1 side is formed in the center portion in the second direction Y. The concavity 241 is formed with a width at which the circuit substrate 220 and the two first correction plates 230 are able to be inserted, and deeper than the height from the surface of the Z2 side of the holder member 210 in the third direction Z to the end portion of the Z2 side of the circuit substrate 220 (excluding to the part at which the connector 221 is provided). In so doing, by inserting the circuit substrate 220 and the two first correction plates 230 in the concavity 241 of the flow channel member 240, fixing on both sides of the circuit substrate 220 and the two first correction plates 230 to the surface of the Z2 side of the holder member 210 is possible.

The flow channel 300 is provided in the interior such a flow channel member 240. The flow channel 300 is provided with an introduction path 301 to which the supply tube 8 (refer to FIG. 1) is connected, a first liquid flow channel 310 provided on the Y1 side of the circuit substrate 220 and branching in two from the introduction path 301, and a second liquid flow channel 320 provided on the Y2 side of the circuit substrate 220.

The introduction path 301 is provided opened to the front end of the supply needle 242 provided projecting to the surface of the Z2 side in the third direction Z of the flow channel member 240. The supply needle 242 is a location having a needle shape that extends along the direction that intersects the liquid ejecting surface 20*a*. In the embodiment, the supply needle 242 follows the third direction Z orthogonal to the liquid ejecting surface 20*a*. By providing the supply needle 242 so as to intersect the liquid ejecting surface 20*a*, it is possible for the dimension in the in-plane direction of the liquid ejecting surface 20*a* to be reduced. The term "in-plane direction" refers to an arbitrary direction composed of only the first direction X that includes the liquid ejecting surface 20*a*, only the second direction Y, or the first direction X and the second direction Y.

The exposure portion 290 which exposes the supply needle 242 to the outside of the cover member 250 is provided in the cover member 250. By connecting the supply tube 8 to the supply needle 242 exposed from the exposure portion 290, the supply tube 8 and the introduction path 301 communicate. The exposure portion 290 will be described in detail later.

The first liquid flow channel 310 and the second liquid flow channel 320 are provided respectively communicating with the two introduction ports 44 provided on each head main body 200. Specifically, the first liquid flow channel 310 is provided with a first communication path 311 that communicates with the introduction path 301, a first liquid reservoir portion 312 that communicates with the first communication path 311, and two first supply paths 313 that communicate with the first liquid reservoir portion 312.

A portion of the first communication path 311 and the first liquid reservoir portion 312 have a concave shape opened to surface of the Y1 side that is a side surface of the flow channel member 240, that is, the surface of the opposite side to the circuit substrate 220. The portion of the first communication path 311 and opening part of the first liquid reservoir portion 312 is sealed by a film 243.

A filter 244 for removing foreign materials such as dust or bubbles is provided in the first liquid reservoir portion 312, and the ink introduced from the first communication path 311 to the first liquid reservoir portion 312 is supplied from the first liquid reservoir portion 312 to the two first supply paths 313 by passing through the filter 244.

For the flow channel member 240 on the X1 side in the first direction X of the two flow channel members 240, the first liquid reservoir portion 312 extends in the first direction X so as to extend over the two head main body 200A1 on the X1 side of the first head main body group 202A and the head main body 200B1 on the X1 side of the second head main body group 202B arranged in parallel in the first direction X. Two first supply paths 313 are provided in parallel in the first direction X, and the two first supply paths 313 are opened to the surface of the Z1 side of the flow channel member 240. Here, these are referred to as first supply paths 313*a* and 313*b*, respectively. One first supply path 313*a* is connected to the introduction port 44 on the Y1 side of the head main body 200A1 via the second connection flow channel 214A. The other first supply path 313*b* is connected to the introduction port 44 on the Y1 side of the head main body 200B1 via the first connection flow channel 213B formed in the holder member 210.

The second liquid flow channel 320 is provided with a second communication path 321 that communicates with the introduction path 301, a second liquid reservoir portion 322 that communicates with the second communication path 321, and two second supply paths 323 that communicate with the second liquid reservoir portion 322.

A portion of the second communication path 321 and the second liquid reservoir portion 322 have a concave shape provided opened to surface of the Y2 side that is a side surface of the flow channel member 240, that is, the surface of the opposite side to the circuit substrate 220. The portion of the second communication path 321 and opening part of the second liquid reservoir portion 322 is sealed by a film 243.

A filter 244 for removing foreign materials such as dust or bubbles is provided in the second liquid reservoir portion 322, and the ink introduced from the second communication path 321 to the second liquid reservoir portion 322 is supplied from the second liquid reservoir portion 322 to the two second supply paths 323 by passing through the filter 244.

For the flow channel member 240 on the X1 side in the first direction X of the two flow channel members 240, the second liquid reservoir portion 322 extends in the first direction X so as to extend covering the two head main body 200A1 on the X1 side of the first head main body group 202A and the head main body 200B1 on the X1 side of the second head main body group 202B arranged in parallel in the first direction X. Two second supply paths 323 are provided in parallel in the first direction X, and the two second supply paths 323 are opened to the surface of the Z1 side of the flow channel member 240. Here, these are referred to as first supply paths 323*a* and 323*b*, respectively. One second supply path 323*a* is connected to the introduction port 44 on the Y2 side of the head main body 200A1 via the first connection flow channel 213A. The other second supply path 323*b* is connected to the introduction port 44 on the Y2 side of the head main body 200B1 via the second connection flow channel 214B formed in the holder member 210.

The flow channel member 240 on the X2 side in the first direction X from the two flow channel members 240 includes the same configuration. That is, the flow channel member 240 includes a first supply path 313*a* that communicates with the introduction port 44 on the Y1 side of the head main body 200A2, a first supply path 313*b* that communicates with the introduction port 44 on the Y2 side of the head main body 200B2, a second supply path 323*a* that communicates with the introduction port 44 on the Y2 side of the head main body 200A2, and a second supply path 323*b* that communicates with the introduction port 44 on the Y2 side of the head main body 200B2.

The first connection flow channel 213 that is an example of the first flow channel and the second connection flow channel 214 are provided in the holder member 210 with respect to one head main body 200. In the embodiment, because four head main bodies 200 are fixed to the holder member 210, a total of eight first connection flow channels 213 and second connection flow channels 214 are provided.

Specifically, the second connection flow channel 214A that communicates with the introduction port 44 on the Y1 side of the head main body 200A1 on the X1 side of the first head main body group 202A extends to the Y1 side of the circuit substrate 220 in a straight line along the third direction Z and communicates with the first supply path 313*a*. The first connection flow channel 213A that communicates with the introduction port 44 on the Y2 side of the head main body 200A1 extends in a straight line along a direction inclined with respect to the third direction Z. The opening on the Z2 side that is the ink entrance of the first connection flow channel 213A is further to the Y2 side in the second direction Y than the circuit substrate 220, and the opening on the Z1 side that is the ink exit is further to the Y1 side in the second direction Y than the circuit substrate 220. In other words, the first connection flow channel 213A is provided inclined from the Y2 side connected to the second supply path 323*a* with respect to the circuit substrate 220 toward the Y1 side of the circuit substrate 220 on which the head main body 200A1 is provided. In so doing, it is possible to easily connect the second supply path 323*a* provided on the Y2 side of the circuit substrate 220 and the introduction port 44 on the Y2 side of the head main body 200A1 provided on the Y1 side via the first connection flow channel 213A. Although the first connection flow channel 213A of the embodiment is provided inclined with respect to the third direction Z, the first connection flow channel 213A is not particularly limited thereto and is preferably configured by a vertical flow path provided along the third direction Z and a horizontal flow path provided along the second direction Y. However, by providing the first connection flow channel 213A inclined as in the embodiment, it is possible for one component to be formed by forming the holder member 210, and it is possible for costs to be reduced by reducing the number of components compared to a case of providing the horizontal flow channel and the like.

Similarly, the second connection flow channel 214B that communicates with the introduction port 44 on the Y2 side of the head main body 200B1 on the X1 side of the second head main body group 202B extends to the Y2 side of the circuit substrate 220 in a straight line along the third direction Z and communicates with the second supply path 323. The first connection flow channel 213B that communicates with the introduction port 44 on the Y1 side of the head main body 200B1 extends in a straight line along a direction inclined with respect to the third direction Z. The opening on the Z2 side that is the ink entrance of the first connection flow channel 213B is further to the Y1 side in the second direction Y than the circuit substrate 220, and the opening on the Z1 side that is the ink exit is further to the Y2 side in the second direction Y than the circuit substrate 220. In other words, the first connection flow channel 213B is provided inclined from the Y1 side connected to the first supply path 313*b* with respect to the circuit substrate 220 toward the Y2 side of the circuit substrate 220 on which the head main body 200B1 is provided. In so doing, it is possible to easily connect the first supply path 313*b* provided on the Y1 side of the circuit substrate 220 and the introduction port 44 on the Y1 side of the head main body 200B1 provided on the Y2 side via the first connection flow channel 213B. Although the first connection flow channel 213B of the embodiment is provided inclined with respect to the third direction Z, similarly to the first connection flow channel 213A, the first connection flow channel 213B is preferably configured by a vertical flow path provided along the third direction Z and a horizontal flow path provided along the second direction Y.

Because the flow channel members 240 provided corresponding to the head main body 200A2 on the X2 side on the first head main body group 202A and the head main body 200B2 on the X2 side of the second head main body group 202B have the same configuration as the above-described flow channel member 240, overlapping description will not be made.

As described above, for the first connection flow channel 213 and the second connection flow channel 214 connected to one head main body 200, the width of the part connected to the head main body 200 in the second direction Y that is the transport direction is narrower than the width of the part connected to the flow channel 300. In other words, it is possible for the interval between the two nozzle rows arranged in parallel in the second direction Y to be narrowed, and it is difficult for shifting of the landing position of the ink ejected from the two nozzle rows to arise.

As shown in FIGS. 11 and 12, in the embodiment, the two first connection flow channels 213 connected to the head main body 200A1 and the head main body 200B1 are arranged so as to cross one another in a case of being viewed from the first direction X. Accordingly, it is possible to achieve size reductions by reducing the space in the second direction Y that accommodates the two first connection flow channels 213. The same applies to the two first connection flow channels 213 of the head main body A2 and the head main body B2.

As shown in FIGS. 8 and 12 to 14B, in the holder member 210, a first accommodation portion 215 notched in a convex shape in the interval 203 between the head main bodies 200 arranged in parallel in the first direction X is provided in each head main body group 202. That is, the first accommodation portion 215 is provided in the holder member 210 corresponding to the first interval 203A of the first head main body group 202A and the second interval 203B of the second head main body group 202B.

The first accommodation portion 215 is provided open to one surface in the second direction Y along with opening to the surface of the Z1 side of the holder member 210. That is, the first accommodation portion 215 provided in the first interval 203A of the first head main body group 202A opens to the side surface of the Y1 side of the holder member 210. The first accommodation portion 215 provided in the second interval 203B of the second head main body group 202B provided on the Y2 side opens to the side surface of the Y2 side of the holder member 210. In the embodiment, the head main body group 202 is configured by two head main bodies 200, because one interval 203 is provided, one first accommodation portion 215 is provided for each head main body group 202. Naturally, in a case where the head main body group 202 is configured by 3 or more head main bodies 200, because two or more intervals 203 are formed, two or more first accommodation portions 215 are preferably provided for each head main body group 202. The first accommodation unit 215 is formed with a depth that does not interfere with the first connection flow channel 213. That is, by providing the first connection flow channel 213 inclined with respect to the third direction Z, it is possible to form the first accommodation portion 215 on the Z1 side of the first connection flow channel 213. In contrast, when the first connection flow channel 213 is provided so as to pass through the Z1 side of the holder member 210, it is difficult to provide the first accommodation portion 215. Naturally, in a case where the first accommodation portion 215 interferes with the first connection flow channel 213, the first connection flow channel 213 is preferably provided in a portion of the first accommodation portion 215 by the part formed in the interior being projected.

By arranging the first head main body group 202A and the second head main body group 202B shifted from one another in the first direction X in the holder member 210, the gap 204 is provided in the first direction X between the end portion of the first head main body group 202A and the second head main body group 202B. That is, the gap 204 is provided on the X1 side of the first head main body group 202A and the X2 side of the second head main body group 202B, respectively. In the embodiment, the gap 204 provided on the X1 side of the first head main body group 202A is referred to as the gap 204A and the gap 204 provided on the X2 side of the second head main body group 202B is referred to as the gap 204B.

A second accommodation portion 216 notched in a concave shape is provided in each gap 204. The second accommodation portion 216 is provided open to one surface in the first direction X and one surface in the second direction Y along with opening to the surface of the Z1 side of the holder member 210. That is, the second accommodation portion 216 provided in the gap 204A on the Y1 side is provided open to the side surface of the Y1 side and the side surface of the X2 side of the holder member 210. The second accommodation portion 216 provided in the gap 204B on the Y2 side is provided open to the side surface of the Y2 side and the side surface of the X1 side of the holder member 210. That is, the second accommodation portion 216 provided in the gap 204A opposes the head main body 200B1 of the second head main body group 202B in the second direction Y, and the second accommodation portion 216 provided in the gap 204B opposes the head main body 200A2 of the first head main body group 202A in the second direction Y.

In the first accommodation portion 215 and the second accommodation portion 216, although described in detail later, in the embodiment, at least a portion of the head-internal roller 630 of the roller unit 610 is accommodated.

The recording head 2, as shown in FIGS. 2A and 2B, is mounted to the carriage 3 so that the liquid ejecting surface 20*a* side projects further than the carriage 3 toward the recording sheet S side.

As described above, the plurality of head main bodies 200, the circuit substrate 220, and the flow channel members 240 that supply ink to the head main bodies 200 are held in the holder member 210. On the Z2 side of the holder member 210, the cover member 250 that accommodates the circuit substrate 220 and the flow channel member 240 and the like are provided.

As shown in FIGS. 3, 6, 7, 11 to 13, 15, and 17A to 17E, the cover member 250 is integrated with the holder member 210, and is a member that accommodates the circuit substrate 220 and the flow channel member 240 in the interior. That is, the cover member 250 is integrated with the holder member 210, and is a member that is able to form an internal space 259 with a size able to accommodate the circuit substrate 220 and the flow channel member 240.

In the embodiment, the cover member 250 is opened to the Z1 side in the third direction Z, and is formed in a box shape having a bottom portion on the Z2 side. The internal space 259 is formed by the opening in the Z1 side of the cover member 250 being sealed by the Z2 side surface of the holder member 210.

The cover member 250 includes a seal part 253 that comes into contact with the holder member 210, and a rigid part 254 with a higher Young's modulus than the seal part 253.

The seal part 253 comes in contact with the holder member 210 and is a part formed from a different material with a higher Young's modulus than the rigid part 254, described later. The seal part 253 is elastically deformed by being pushed to the holder member 210 side by the cover member 250, is embedded in the gap at the boundary between the cover member 250 and the holder member 210, and has an action of preventing infiltration of ink into the internal space 259.

The rigid part 254 is a part that substantially forms the internal space 259 along with the holder member 210, and is formed from a material with a higher Young's modulus than the seal part 253. By forming the rigid part 254 with such a material, it is possible for the rigidity of the cover member 250 to be improved, and it is possible to protect the circuit substrate 220 and the flow channel member 240 accommodated in the internal space 259.

The rigid part 254 is opened to the Z1 side in the third direction Z, and is formed in a box shape having a bottom portion on the Z2 side. Specifically, the rigid part 254 is orthogonal to the first direction X and the second direction Y, includes the four side surface 255 that connects the seal part 253 and a ceiling 256 provided on the Z2 side in the third direction Z connecting all of the side surfaces 255, and is formed as a substantially rectangular parallelepiped shape overall. Since not only the side surface 255 but also the ceiling 256 is included, it is possible for the strength of the cover member 250 to be improved.

In the embodiment, although the cover member 250 is formed in a box shape, the form is not limited thereto. For example, the holder member 210 is preferably formed in a box shape opened to the Z2 side, and the cover member 250 is preferably formed as a plate-like member that seals the opening.

The seal part 253 is provided on the end portion opened to the Z1 side in the third direction Z of the rigid part 254, that is, on a site that comes in contact with the Z2 side of the holder member 210 if the seal part 253 is not provided. The seal part 253 and the rigid part 254 are formed by two-color molding. As described above, if the rigid part 254 is formed from a material with a higher Young's modulus than the seal part 253, although not particularly limited, it is possible to use a resin material as the rigid part 254 and to use an elastomer as the elastic material for the seal part 253.

The seal part 253 formed by two-color molding has a contour that accommodates the circuit substrate 220 and the flow channel member 240 in plan view with respect to the liquid ejecting surface 20*a*, in the embodiment, in plan view seen from the third direction Z. The contour of the seal part 253 according to the embodiment matches the opening shape in the Z1 side of the rigid part 254 and has an annular substantially rectangular shape. That is, the seal part 253 is configured from two long side portions 253*a* and two short side portions 253*b*. The long side portions 253*a* are parts that extend in parallel in the first direction X among seal part 253, and two are arranged in parallel in the second direction Y. The short side portions 253*b* are parts shorter than the long side portions 253*a* that extend in parallel in the second direction Y among the seal part 253, and two are arranged in parallel in the first direction X.

The circuit substrate 220 and the flow channel member 240 being accommodated in the contour refers to the circuit substrate 220 and the flow channel member 240 being arranged on the inside of the contour of the seal part 253 in plan view.

In the contour of the seal part 253, at least the part that intersects the second direction Y that is the transport direction in which the recording sheet S is transported forms at least the outermost side of recording head 2. In the contour, the part that intersects the second direction Y refers to the part including a component that intersects the second direction Y in plan view. In the embodiment, the long side portions 253*a* that extend in the first direction X orthogonal to the second direction Y is the part that intersects the second direction Y.

The long side portions 253*a* that are a portion of the contour of the seal part 253 forming the outermost side of the recording head 2 refers to the long side portions 253*a* configuring a portion of the overall contour of the recording head 2 in a cross-section that includes the seal part 253 that is a cross-section parallel to the liquid ejecting surface 20*a*. In other words, in at least the second direction Y, a component that configures the recording head 2 is not present further to the outside than the long side portions 253*a*.

Although in the invention at least the part that intersects the second direction Y forms the outermost side of the recording head 2, a part that does not intersect the second direction Y from the contour of the seal part 253 also preferably forms the outermost side of the recording head 2.

In the embodiment, the part that does not intersect the second direction Y, that is, the short side portions 253*b* parallel to the second direction Y also form the seal part 253 so as to form the outermost side of the recording head 2.

Specifically, in plan view, the contour of the holder member 210 and the cover member 250 configure the overall contour of the recording head 2. That is, the side surface of the holder member 210 (that is, the side surface orthogonal to the first direction X and the second direction Y) and the side surface 255 of the cover member 250 configure the outermost side of the recording head 2. The seal part 253 is formed in an annular form on the end surface of the Z1 side of the side surface 255 of the cover member 250.

By forming the cover member 250 in this way, the seal part 253 is configures the outermost side of the overall contour of the recording head 2 formed by the holder member 210 and the cover member 250 in cross-section parallel to the liquid ejecting surface 20*a*.

As described above, in the recording head 2 according to the embodiment, the seal part 253 is formed on the cover member 250. In this way, the boundary part between the holder member 210 and cover member 250 is sealed by the seal part 253, and it is possible for infiltration of ink from the boundary part to the internal space 259 to be more reliably suppressed. In so doing, it is possible to protect the electronic components such as the circuit substrate 220 that configure the recording head 2.

The cover member 250 includes a seal part 253 and a rigid part 254 formed by two-color molding. According to the two-color molding, it is possible to form the seal part 253 so as to fall within the width thereof, even for the end surface of the Z1 side of the side surface 255 with a narrow width. In so doing, if the contour of the recording head 2 in plan view is prescribed by the cover member 250 and the holder member 210 having a rigid part 254 with high rigidity, it is possible to provide the seal part 253 further to the outside than the contour thereof without protruding.

Assuming a case where the seal part 253 is substituted by a separate seal member to the rigid part 254 and not two-color molding, the width of the seal member is matched to the width of the side surface 255 of the rigid part 254. When sealing is to be achieved by pinching such a seal member with the surface of the Z2 side of the holder member 210 and the end surface of the Z1 side of the side surface 255 of the rigid part 254, the side surface 255 is shifted from the seal member in order to narrow the width of the seal member, it is difficult to ensure sealing. By widening the width of the seal member wider than the width of the side surface 255, shifting of the side surface 255 from the seal member is suppressed, when reliable sealing is to be achieved, the size in the at least the second direction Y of the recording head 2 increases by the amount the width of the seal member is widened.

In the recording head 2 according to the embodiment, because the seal portion 253 is formed integrally with the rigid part 254 by two-color molding as described above, since the seal part 253 becomes larger than the external shape of the rigid part 254, it is possible for size increases in the recording head 2 to be suppressed.

In the recording head 2 according to the embodiment, in the seal part 253, at least the long side portions 253*a* that intersect the second direction Y that is the transport direction form the overall contour of the recording head 2. That is, it is possible for the size of the recording head 2 in the second direction Y to be reduced.

Examples of a form in which the long side portions that intersect the second direction Y do not form the overall contour of the recording head 2 include a configuration in which another member that configures the recording head 2 is provided further to the outside than the seal part 253 in the second direction Y. In such a form, the size of the recording head 2 increases by the amount of the other member provided in the second direction Y.

In the recording head 2 according to the embodiment, since the other member that configures the recording head 2 is not present further to the outside than the seal part 253 as in the form, it is possible to suppress size increases in the recording head 2 in the second direction Y.

In particular, in the recording head 2 according to the embodiment, the short side portions 253*b*, and not only the long side portions 253*a* that intersect the second direction Y, also form the contour of the outermost side of the recording head 2. Accordingly, it is possible for size increases in the first direction X of the recording head 2 to be suppressed.

Figure 17A:
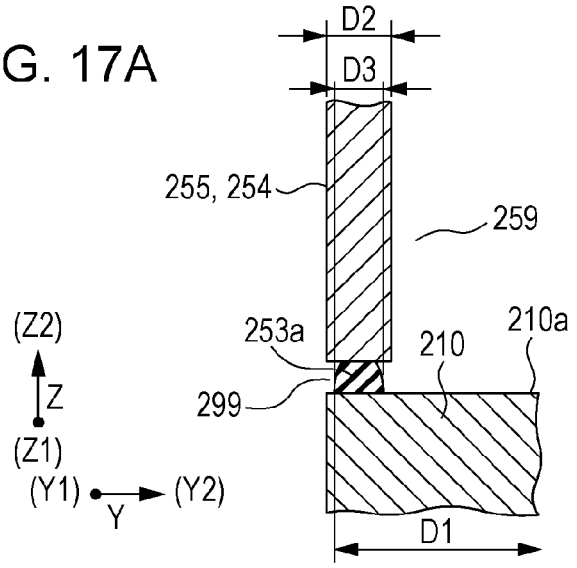
FIGS. 17A to 17E are main portion cross-sectional views showing the rigid parts of the cover member.

As shown in FIG. 17A, the thickness D1 of the part that contacts the seal part 253 and the holder member 210 is thicker than the thickness D2 of the part that contacts the seal part 253 and the rigid part 254.

The part that contacts the seal part 253 and the holder member 210 that the seal part 253 among the holder member 210 is able to contact. In the embodiment, the part that contacts the seal part 253 and the holder member 210 is the surface 210*a* of the cover member 250 side of the holder member 210. The thickness D1 of the surface 210*a* is the thickness (thickness in the second direction Y shown in the same drawing) in the first direction X or the second direction Y of the surface 210*a*.

The part that contacts the seal part 253 and the rigid part 254 is a part the seal part 253 among the rigid part 254 is able to contact. In the embodiment, the part is the end surface of the Z1 side of the side surface 255 that configures the rigid part 254. The thickness D2 of the end surface is the thickness (thickness in the second direction Y shown in the same drawing) in the first direction X or the second direction Y.

The thickness D1 is thicker than the thickness D2. That is, the thickness D1 of the contact part with the holder member 210 that comes in contact with the seal part 253 is thicker than the thickness D2 of the contact part of the seal part 253 and the rigid part 254 integrated by the two-color molding. In other words, as the range the seal part 253 is able to contact, the end surface of the rigid part 254 is narrower, and the surface 210*a* of the holder member 210 is wider.

In this way, since the seal part 253 is provided by two-color molding on the rigid part 254 with the thickness D2 relatively thinner than the thickness D1, it is possible for the seal part 253 and the rigid part 254 to be precisely fixed. Since the seal part 253 comes into contact with respect to the holder member 210 with the thickness D1 relatively thicker than the thickness D2, positioning of the seal part 253 and the holder member 210 is easily performed.

Assuming a case in which seal part 253 is provided on the holder member 210 with two-color molding, because the seal part 253 should match the end surface of the rigid part 254 with the narrow thickness D2, positioning becomes difficult.

The thickness of the seal part 253 refers to the maximum thickness in the first direction X or the second direction Y of the seal part 253. In the embodiment, because front end part on the holder member 210 side of the seal part 253 expands in width due to elastic deformation, the thickness D3 becomes the maximum thickness.

The thickness D3 of the seal part 253 becomes thinner than the thickness of the side surface 255 of the rigid part 254. That is, the elastically deformed seal part 253 does not protrude in the internal space 259 of the cover member 250. Since the seal part 253 does not protrude to the internal space 259 side that is the inside of the cover member 250, it is possible for a wide volume in which the internal space 259 that accommodates the circuit substrate 220 and the flow channel member 240 to be secured.

Figure 17B:
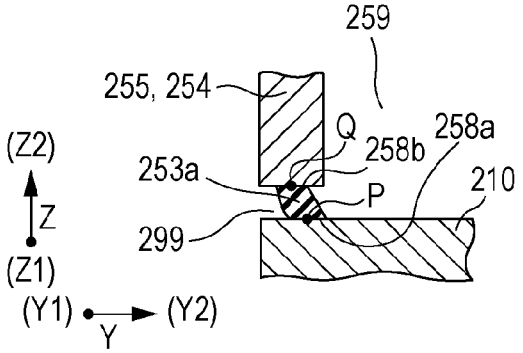
Figure 17C:
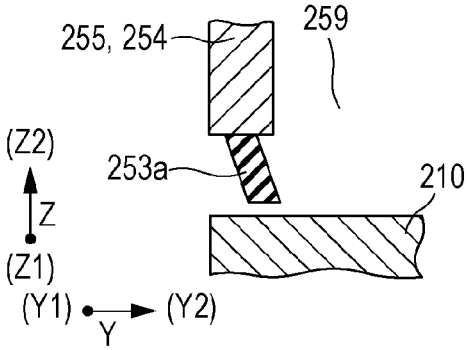

Here, FIGS. 17B and 17C show modification examples of the seal part 253. As shown in FIG. 17B, in the seal part 253, the center P in the thickness direction from among the contact portions 258*a* of the seal part 253 and the holder member 210 is further to the inside of the cover member 250 than the center Q in the thickness direction from among the contact portions 258*b* of the seal part 253 and the side surface 255 of the rigid part 254.

The contact portion 258*a* refers to a part that contacts the seal part 253 and the holder member 210. The thickness direction of the contact part 258*a* is the first direction X or the second direction Y. If the long side portion 253*a*, the thickness direction of the contact portion 258*a* is the second direction Y that intersects the long side portion 253*a*, and if the short side portion 253*b*, the thickness direction of the contact portion 258*a* is the first direction X that intersects the short side portion 253*b*. The center P is the center position in the thickness direction (thickness in the second direction Y shown in the same drawing) of the contact portion 258*a*.

The contact portion 258*b* refers to the part that contacts the side surface 255 of the rigid part 254 of the seal part 253. The thickness direction of the contact part 258*b* is the first direction X or the second direction Y. If the long side portion 253*a*, the thickness direction of the contact portion 258*a* is the second direction Y that intersects the long side portion 253*a*, and if the short side portion 253*b*, the thickness direction of the contact portion 258*a* is the first direction X that intersects the short side portion 253*b*. The center P is the center position in the thickness direction (thickness in the second direction Y shown in the same drawing) of the contact portion 258*a*.

As described above, the cover member 250 in which the seal part 253 is provided through two-color molding is integrated by being pressed to the holder member 210 side. That is, the seal part 253 is interposed by the holder member 210 and the cover member 250, and pressed. Although the seal part 253 is elastically deformed in this way, by setting the positional relationship between the center P and the center Q as described above, even if the seal part 253 expands in width by elastically deforming, it is possible for protruding further to the outside than the cover member 250 to be suppressed.

Since protruding of the seal part 253 further to the outside of the cover member 250 in the first direction X and the second direction Y is suppressed, it is possible for size increases in the first direction X and the second direction Y of the recording head 2 to be suppressed.

Examples of forms of the seal part 253 and the rigid part 254 such as the positional relationship between the center P and the center Q are given in FIG. 17C. That is, the front end of the holder member 210 side of the seal part 253 is inclined to the internal space 259 side that is the inside of the cover member 250. By interposing the seal part 253 with the holder member 210 to the cover member 250, it is possible to maintain the positional relationship between the center P and the center Q shown in FIG. 17B.

Figure 17D:
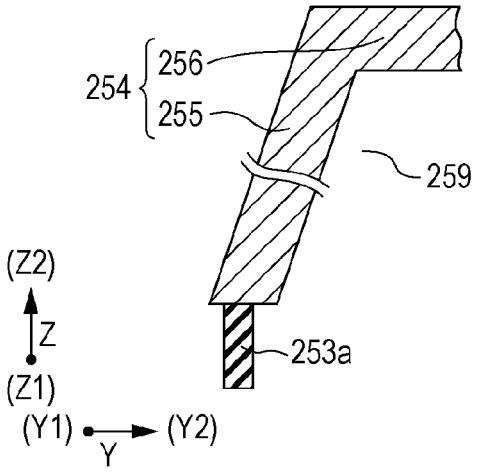
Figure 17E:
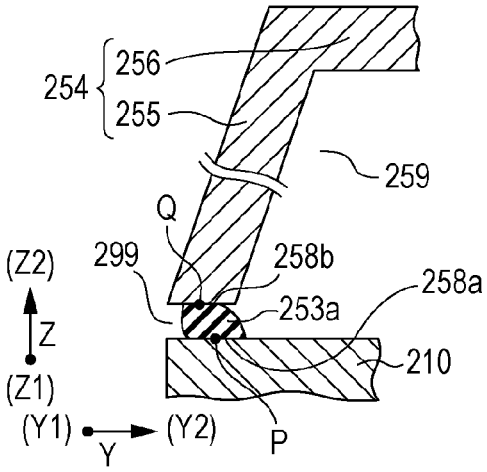

Furthermore, FIG. 17D shows a modification example of the seal part 253. As shown in the drawing, the side surface 255 that configures the rigid part 254 is inclined toward the outside of the cover member 250 from the ceiling 256 to the seal part 253. As shown in FIG. 17E, when the seal part 253 is interposed by the cover member 250 and the holder member 210 in such a form, a state is attained in which the side surface 255 side of the seal part 253 is inclined by a force being applied to the outside, and a state is attained in which the holder member 210 side of the seal part 253 is positioned on the internal space 259 side. Even for a seal part 253 according to such a modification example, similarly to FIG. 17B, it is possible for the positional relationship between the center P and the center Q to be maintained.

For the cover member 250 shown in FIG. 17D, since the opening portion widens from the Z2 side towards the Z1 side, removing the mold during two-color molding is easy.

Figure 18:
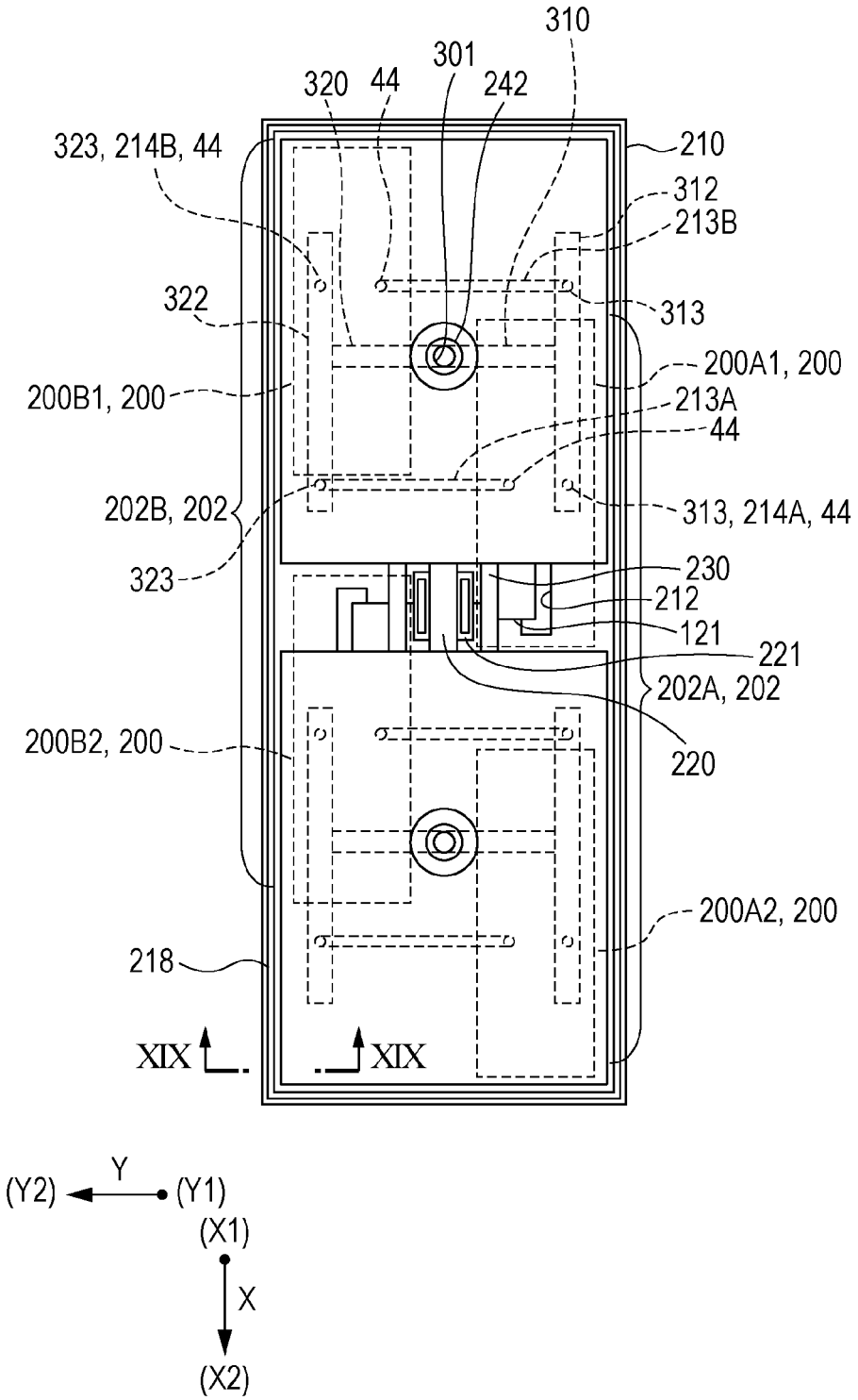
FIG. 18 is a plan view showing the recording head according to a modification example.
Figure 19:
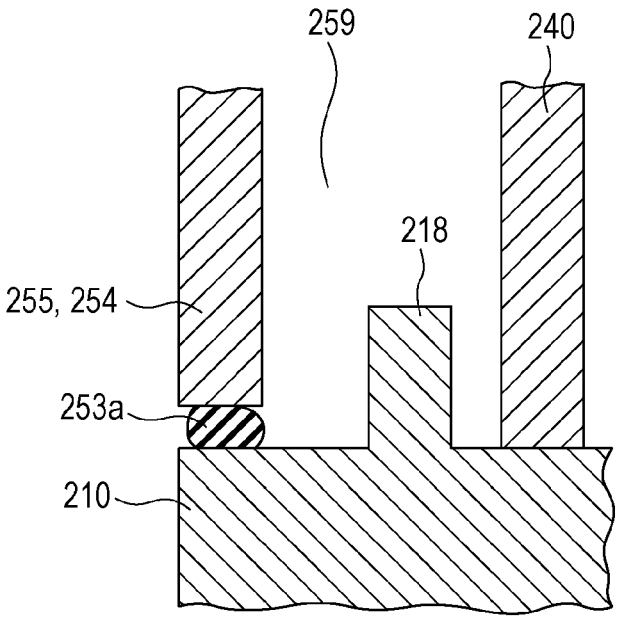
FIG. 19 is a cross-sectional view taken along the line XIX-XIX in FIG. 18.
Figure 19:
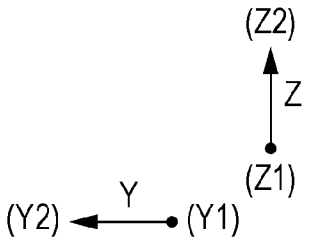

Furthermore, FIGS. 18 and 19 show modification examples of the seal part 253. FIG. 18 is a plan view showing the recording head according to the modification example, and FIG. 19 is a cross-sectional view along the line XIX-XIX As shown in FIG. 18, the holder member 210 includes a regulating portion 218 that regulates the infiltration of ink to the inside of the cover member 250 form the outside of the cover member 250. The regulating portion 218 according to the embodiment is provided on the surface of the Z2 side of the holder member 210, that is, the surface that comes in contact with the seal part 253, and protrudes further toward the Z2 side in the third direction Z than the surface. The regulating portion 218 is accommodated in the cover member 250 and is arranged further to the outside than the circuit substrate 220 and the flow channel member 240. In the embodiment, the regulating portion 218 is formed in an annular shape so as to surround the circuit substrate 220.

By forming the regulating portion 218, in the unlikely event that ink from the seal part 253 should infiltrate to the internal space 259 side, infiltration of the ink is suppressed by the regulating portion 218, and it is possible for ink to be suppressed from reaching the circuit substrate 220.

Figure 20A:
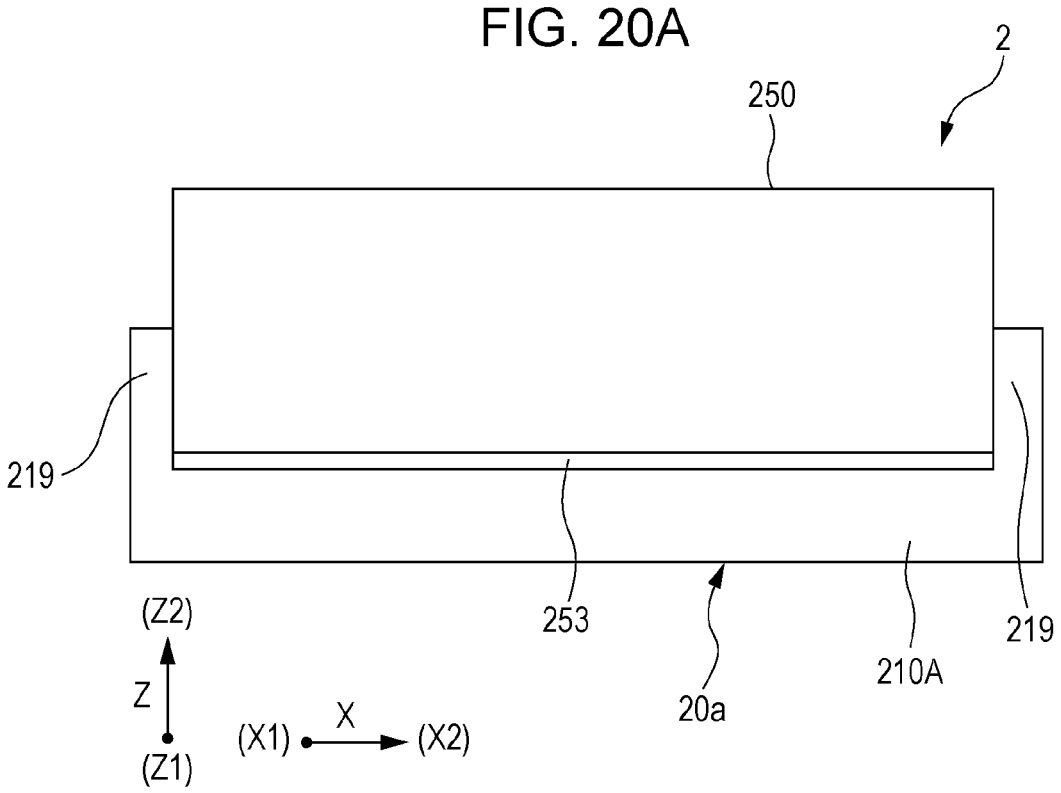
FIGS. 20A and 20B are a schematic side view and a schematic plan view of a recording head according to the modification example.
Figure 20B:
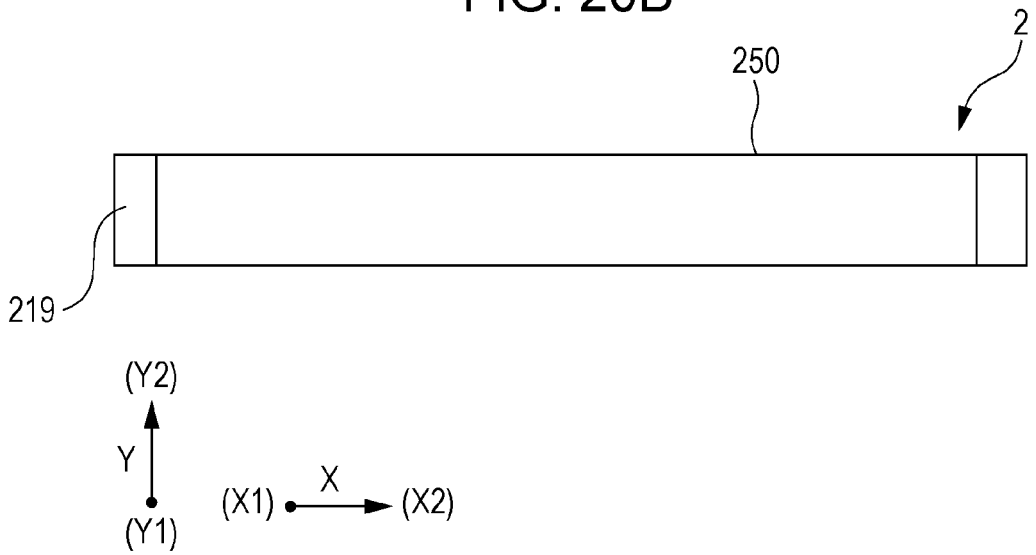

FIGS. 20A and 20B show a modification example of the holder member. FIGS. 20A and 20B are a schematic side view and a schematic plan view of a recording head according to a modification example.

The cover member 250 has a rectangular shape in plan view as described above, and the seal part 253 is formed in an annular shape having a rectangular contour as described above (refer to FIG. 15 and the like).

On the other hand, in the holder member 210A, a guide portion 219 that guides the cover member 250 is provided on the rectangular short side part, in the embodiment, the short side part parallel to the second direction Y. Specifically, in the holder member 210A, guide portions 219 extended along the third direction Z are provided on each of both ends in the first direction X.

The intervals between the guide portions 219 on both ends have approximately the same width in the first direction X of the cover member 250. That is, the cover member 250 bonded to the Z2 side of the holder member 210A and both ends of the guide portion 219 are in contact or there is some play present between the holder member 210A and the guide portion 219.

According to such a guide portion 219, simply by the cover member 250 facing from the Z2 side in the third direction Z towards the Z1 side and fitting between the two guide portions 219, it is possible to bond the cover member 250 with respect to the holder member 210 at a predetermined position. By providing the guide portions 219, positioning the holder member 210 and the cover member 250 is easy, and it is possible to more reliably seal between the holder member 210 and the cover member 250 with the seal part 253.

The width in the second direction Y of the guide portion 219 becomes approximately the same width as the width in the second direction Y of the cover member 250. That is, in a case where the liquid ejecting surface 20*a* is seen in plan view, in the second direction Y, the guide portion 219 configures the contour of the outermost side of the recording head 2. Accordingly, it is possible for the size increases in the recording head 2 in the second direction Y to be avoided.

It is preferable that the Young's modulus of the holder member 210 be higher than the Young's modulus of the rigid part 254 of the cover member 250. In so doing, it is possible for the rigidity of the holder member 210 to be improved. Since the holder member 210 is a member that holds a plurality of head main bodies 200, it is possible for each head main body 200 to be more strongly fixed, and it is possible for the flatness of the liquid ejecting surface 20*a* of each head main body 200 to be suppressed from worsening. Since the holder member 210 may not be formed with a material capable of two-color molding, the material selection increase, and it becomes easy to form the holder member 210 according to the application object.

Both of the circuit substrate 220 and the first correction plate 230 are accommodated in the internal space 259 formed by the cover member 250 and the holder member 210. In so doing, compared to a case where only the circuit substrate 220 is accommodated by the cover member 250, it is possible to reduce the size of the recording head 2.

The exposure portion 290 will be described in detail using FIGS. 3, 4, 7, 15, and 16.

As shown in the drawings, a supply needle 242 having an introduction path 301 that is a second flow channel is provided on the surface facing the cover member 250 of the flow channel member 240, that is, the surface of the Z2 side.

The annular seal member 270 is inserted in the supply needle 242. The seal member 270 is formed from an elastic material such as an elastomer.

Meanwhile, the exposure portion 290 which exposes the supply needle 242 to the outside of the cover member 250 is provided in the cover member 250. The exposure portion 290 has a configuration able to supply ink to the flow channel member 240 via the supply needle 242 by the supply needle 242 being exposed to the outside of the cover member 250. Specifically, the exposure portion 290 is provided with a side wall portion 291 and a ceiling portion 292.

The side wall portion 291 surrounds the outer periphery in the peripheral direction of the supply needle 242, and includes a side surface 291*a* extended along the third direction Z that is the direction in which the supply needle 242 extends. In the embodiment, the side wall portion 291 is formed in a cylindrical shape so as to surround the supply needle 242 on the surface of the opposite side to the internal space 259 of the cover member 250, that is, the surface of the Z2 side. The inner surface of the side wall portion 291 formed in a cylindrical shape becomes the side surface 291*a* extending along the third direction Z that is the direction in which the supply needle 242 extends.

The ceiling portion 292 connects to the side wall portion 291, and is a site at which the insertion hole 293 that is an opening by which the supply needle 242 is exposed is provided. In the embodiment, the ceiling portion 292 is a plate-like site formed so as to cover the opening of the cylindrical side wall portion 291. The insertion hole 293 corresponds to the opening of the exposure portion 290. The diameter of insertion hole 293 is formed larger than the diameter of the outer periphery in the peripheral direction of the supply needle 242. That is, the insertion hole 293 is formed at a size in which the supply needle 242 is inserted, and has a shape that does not contact the outer periphery in the peripheral direction of the supply needle 242 and the insertion hole 293.

According to such an exposure portion 290, by the cover member 250 being attached to the holder member 210 holding the flow channel member 240, the supply needle 242 is exposed to the outside of the cover member 250 via the insertion hole 293.

The side wall portion 291 provided at the periphery of the supply needle 242 forms an interval between the side surface 291*a* and the supply needle 242 able to accommodate the seal member 270. This gap is the seal accommodating portion 294.

The seal accommodating portion 294 is formed slightly smaller than the outer shape of the seal member 270. In the embodiment, in plan view, the seal member 270 is formed in a ring shape in which the supply needle 242 is inserted, the seal accommodating portion 294 is formed in a slightly smaller circular shape than the outer shape of the seal member 270.

The seal member 270 in which the supply needle 242 is inserted is inserted in the seal accommodating portion 294 of the cover member 250. The seal member 270 contacts the seal accommodating portion 294 only in the peripheral direction. Because the seal accommodating portion 294 is formed in a circular shape slightly smaller than the seal member 270, the seal member 270 is accommodated in the seal accommodating portion 294 by being compressed in the peripheral direction. In so doing, between the side wall portion 291 and the supply needle 242 is sealed with the seal member 270.

By providing the seal member 270 in the seal accommodating portion 294, even if ink overflows and proceeds to inside the insertion hole 293 when attaching or removing the supply tube 8 from the supply needle 242, it is possible for ink to be suppressed from reaching the internal space 259 of the cover member 250 by the seal member 270.

The seal member 270 is interposed by the side wall portion 291 and the supply needle 242, a force that compressing in the peripheral direction acts thereupon. That is, the force does not act in the third direction Z that is a direction perpendicular to the liquid ejecting surface 20*a*. Accordingly, the residual stress arising in the seal member 270 is suppressed from acting in the third direction Z with respect to the entire recording head 2. In so doing, it is possible for deformation of the liquid ejecting surface 20*a* to be suppressed.

The notch portion 295 in which a portion of the side wall portion 291 and the ceiling portion 292 is notched is formed in the exposure portion 290. The notch portion 295 is provided further to the front end side of the supply needle 242 than the part that comes in contact with the seal member 270 from among the side wall portion 291, that is, on the Z2 side in the third direction Z. That is, as shown in FIG. 16, the notch portion 295 is provided further to the Z2 side in the third direction Z than the seal member 270, and the notch portion 295 and the seal member 270 do not overlap in the third direction Z.

In the embodiment, the exposure portion 290 includes the ceiling portion 292. In a case of including such a ceiling portion 292, the notch portion 295 is preferably provided from the ceiling portion 292 spanning to the part that comes in contact with the seal member 270 from the side wall portions 291. As referred to here, the wording "up to the part that comes in contact with the seal member 270 from among the side wall portion 291" does not include the part that comes in contact with the seal member 270.

In the embodiment, the notch portion 295 is provided continuously from the ceiling portion 292 spanning up to the part that comes in contact with the seal member 270 of the side wall portion 291, along with being notched in the ceiling portion 292 from the insertion hole 293 up to the outer edge portion of the ceiling portion 292. The notch portion 295, in the embodiment, is notched in the second direction Y that is the short side direction of the recording head 2.

A groove portion 296 that includes the exposure portion 290 on the inside is formed in the cover member 250. Specifically, the groove portion 296 is provided with a first groove portion 296*a* and a second groove portion 296*b* formed in the surface of the Z2 side of the ceiling 256 of the cover member 250. The first groove portion 296*a* is formed in a circular shape that includes the exposure portion 290 in the interior. The second groove portion 296*b* is continuous with the first groove portion 296*a* and is formed in a straight line to the boundary of the side surface 255 and the ceiling 256. The direction in which the second groove portion 296*b* is the direction going from Y2 to Y1 in the second direction Y that is the same direction as the direction in which the notch portion 295 extends.

As described above, ink that overflows from the supply needle 242 is suppressed from reaching the internal space 259 of the cover member 250 by the seal member 270. The overflowing ink attaches to the seal accommodating portion 294, the side wall portion 291, and the ceiling portion 292.

When ink attached to the seal accommodating portion 294 in this way exceeds a fixed amount, there is concern of flowing out to the outside of the exposure portion 290, that is, to the ceiling 256 or the side surface 255 of the cover member 250. However, by providing the notch portion 295 in the exposure portion 290, ink is guided to the notch portion 295. The direction the ink flows in is the direction in which the notch portion 295 extends. That is, according to the notch portion 295, it is possible to control the flow of ink overflowing from the supply needle 242 in a specified direction. Even if the insertion hole 293 that is the opening of the exposure portion 290 is larger than the diameter of the outer periphery of the supply needle 242, by providing the notch portion 295, it is possible for ink to escape from the seal accommodating portion 294 to the outside.

In the embodiment, the direction in which the notch portion 295 extends is the direction from Y2 toward Y1 in the second direction Y. This direction is a direction not facing the connector exposure hole 251 in which the circuit substrate 220 is exposed. Accordingly, it is possible for ink overflowing from the exposure portion 290 not to flow out towards the connector exposure hole 251. Even in the unlikely case of ink overflowing form the exposure portion 290, since it is possible for ink flowing into the connector exposure hole 251 to be suppressed, it is possible to suppress ink form reaching the circuit substrate 220.

The notch portion 295 is provided further to the Z2 side in the third direction Z than the seal member 270. According to such a notch portion 295, the seal member 270 reliably contacts the side surface 291*a* of the side wall portion 291, and the seal member 270 does not contact the notch portion 295 in which a portion of the side wall portion 291 is notched. Accordingly, it is possible for ink infiltrating from the insertion hole 293 of the exposure portion 290 to the seal accommodating portion 294 to be discharged to the outside of the cover member 250 via the notch portion 295 without infiltrating to the internal space 259.

Since the exposure portion 290 includes the ceiling portion 292 connected to the side wall portion 291, when the seal member 270 is attached, the seal member 270 is easily positioned on the cover member 250. Because the exposure portion 290 is further provided with the ceiling portion 292, compared to a form configured by the side wall portion 291 only, it is possible for the rigidity to be improved.

In the third direction Z that is a direction perpendicular to the liquid ejecting surface 20*a*, the seal member 270 and the ceiling portion 292 are separated, and the seal member 270 and the flow channel member 240 contact one another.

According to such a configuration, since there is a gap on the Z2 side that is at least one surface in the third direction Z of the seal member 270, it is possible for residual stress arising in the third direction Z in the liquid ejecting surface 20*a* to be more reliably suppressed.

It is possible to perform positioning of the seal member 270 with respect to the needle-like supply needle 242. That is, it is possible to perform positioning of the seal member 270 just by inserting the seal member 270 in the needle-like supply needle 242. Assuming a case in which the surface of the Z2 side of the seal member 270 contacts the ceiling portion 292, although it is necessary to position the seal member 270 in the seal accommodating portion 294 of the cover member 250, the seal member 270 should be arranged in the seal accommodating portion 294 of the interior of the cover member 250. Compared to such a form, it is possible for positioning of the seal member 270 to be easily performed in a configuration in which the surface of the Z2 side of the seal member 270 is separated from the ceiling portion 292 and contacts the flow channel member 240.

In the embodiment, the exposure portion 290 is accommodated in the groove portion 296. Accordingly, ink flows out from the exposure portion 290 by controlling the flow of ink with the notch portion 295 and is further guided through the groove portion 296 to the side surface of the cover member 250. In this way, on the ceiling 256 of the cover member 250, even if ink overflows from the supply needle 242, the direction the ink flows out is controlled by the notch portion 295 of the exposure portion 290 and the groove portion 296. Accordingly, it is possible to more reliably suppress ink overflowing from the supply needle 242 from infiltrating an unintended region, for example, the connector exposure hole 251.

Although, the ink guided to the side surface 255 of the cover member 250 moves towards the holder member 210 along the third direction Z, the seal part 253 is provided between the cover member 250 and the holder member 210. Because the ink is suppressed from infiltrating from between the cover member 250 and the holder member 210 to the internal space 259 by the seal part 253, it is possible to protect the circuit substrate 220 accommodated in the internal space 259.

As shown in FIGS. 17A, 17B, and 17E, the seal part 253, cover member 250, and holder member 210 preferably include a concavity 299 in which the seal part 253 is recessed slightly more to the internal space 259 side than the side surface 255. It is possible for ink running down the side surface 255 to be collected in such a concavity 299. That is, it is possible for ink to be suppressed from running off from the concavity 299 to the Z1 side of the third direction Z. In so doing, for example, it is possible for ink to be suppressed from attaching to the liquid ejecting surface 20*a* and the like.

The concavity 299 that accommodates the ink does not protrude further to the outside than the side surface 255 in the in-plane direction of the liquid ejecting surface 20*a* of the recording head 2. That is, it is possible for size increases in the in-plane direction of the liquid ejecting surface 20*a* to be suppressed by the seal part 253 protruding further to the outside than the side surface 255.

The seal part 253 is preferably recessed to the internal space 259 side to the extent that the above-described concavity 299 is formed. That is, the seal part 253 forming the contour of the outermost side of the recording head 2 also includes a form that includes such a concavity 299 and substantially forms the contour of the outermost side in the recording head 2 in a cross-section that includes the seal part 252, that is a cross-section parallel to the liquid ejecting surface 20*a*.

Figure 21A:
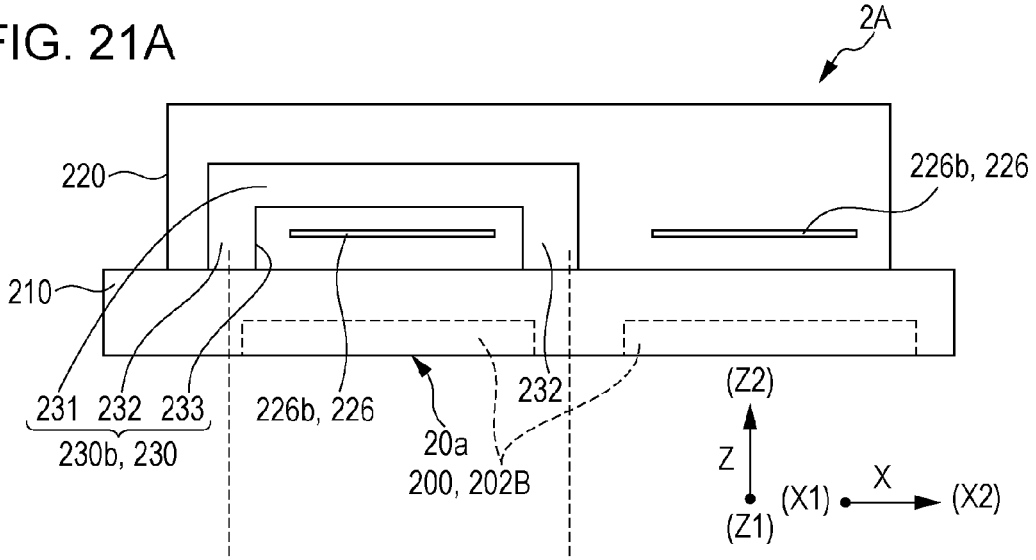
FIGS. 21A to 21C are side views and a plan view showing the first correction plate and the circuit substrate fixed to the holder member.
Figure 21B:
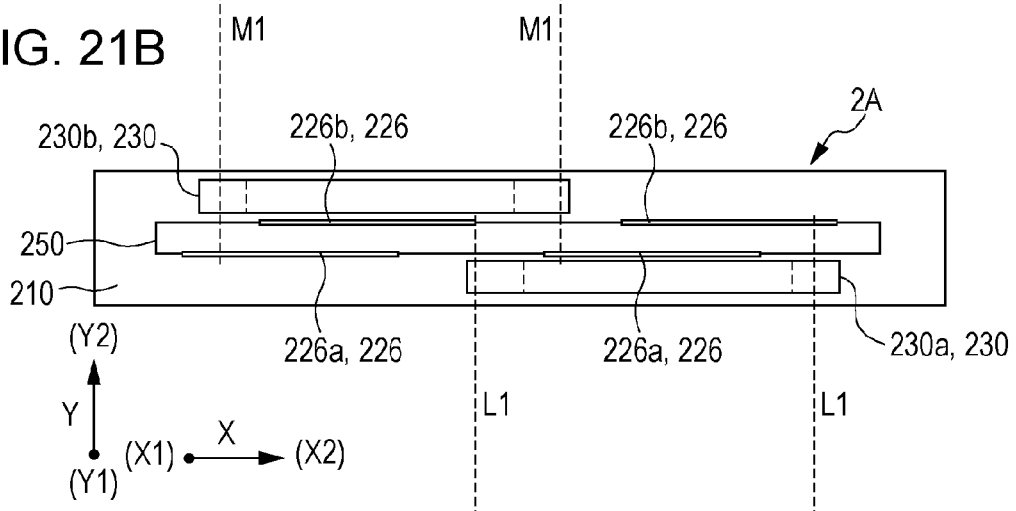
Figure 21C:
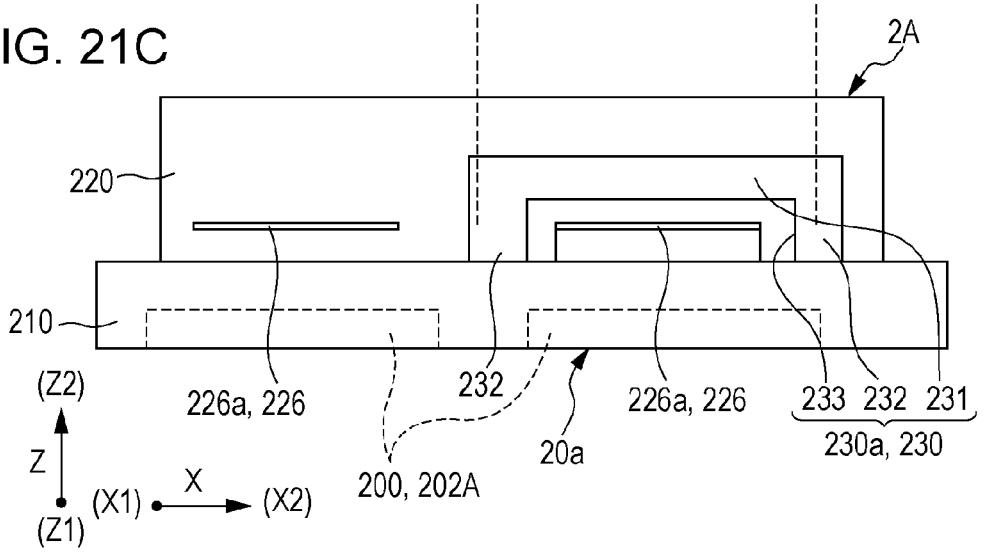

The configuration of the first correction plate 230 and the circuit substrate 220 of the recording head 2 according to the embodiment will be described in detail using FIGS. 21A to 21C. FIGS. 21A to 21C are a side view and a plan view showing the first correction plate and the circuit substrate fixed to the holder member. FIG. 21A is a side view from the second head main body group 202B side, that is, of the Y2 side in the second direction Y, FIG. 21B is a plan view, and FIG. 21C is a side view from the first head main body group 202A side, that is, of the Y1 side in the second direction Y. In the same drawings, the flow channel member 240, the cover member 250, and the wiring substrate 121 are not shown.

The recording head 2 according to the embodiment includes first correction plate 230 that includes a correction main body portion 231, an opening portion 233, and leg portions 232 arranged on both sides in the first direction X of the opening portion 233. Among the two plates that interpose the circuit substrate 220 in the second direction Y, the first head main body group 202A side is referred to as the first correction plate 230*a* and the second head main body group 202B side is referred to as the first correction plate 230*b*.

A connection portion 226 is provided on both surfaces of the circuit substrate 220. Among each connection portion 226, the connection portion 226 provided on the surface of the Y1 side in the second direction Y is referred to as the first connection portion 226*a*, and the connection portion 226 provided on the surface of the Y2 side is referred to as the second connection portion 226*b*.

The first connection portion 226*a* is connected to the wiring substrate 121 of the head main body 200 that configures the first head main body group 202A, and the second connection portion 226*b* is connected to the wiring substrate 121 of the head main body 200 that configures the second head main body group 202B.

The leg portion 232 of one first correction plate 230*a* from the set of first correction plates 230 is arranged at a position that overlaps the second connection portion 226*b* in the first direction X, and does not overlap the first connection portion 226*a*. The dotted line L1 shown in FIGS. 21B and 21C indicates the leg portion 232 overlapping the second connection portion 226*b* in the first direction X.

The leg portion 232 of the other first correction plate 230*b* from the set of first correction plates 230 is arranged at a position that overlaps the first connection portion 226*a* in the first direction X, and does not overlap the second connection portion 226*b*. The dotted line M1 shown in FIGS. 21A and 21B indicates the leg portion 232 overlapping the second connection portion 226*b* in the first direction X.

As indicated by the dotted lines L1 and M1, by arranging the leg portions 232 of the first correction plate 230*a* and the first correction plate 230*b*, respectively, as described above with respect to the first connection portion 226*a* and the second connection portion 226*b*, one X1 side from among the two first connection portions 226*a* and one X2 side from among the two second connection portion 226*b* are not arranged on the inside of the opening portion 233 of the first correction plate 230 in plan view.

In the recording head 2 according to the embodiment, as indicated by the dotted line L1 and M1, the leg portions 232 of the first correction plate 230*a* and the first correction plate 230*b*, respectively are arranged as described above with respect to the first connection portion 226*a* and the second connection portion 226*b*. In so doing, because it becomes unnecessary to arrange the leg portions 232 of the first correction plate 230 on the outside in the first direction X of all of the first connection portion 226*a* and on the outside in the first direction X of all of the second connection portion 226*b*, it is possible to reduce the size in the first direction X by the same amount.

Although not specifically depicted, in plan view of the circuit substrate 220, a recording head with a form in which the first connection portion and the second connection portion overlap one another, and the width of the leg portions 232 in the first direction X is narrower than the width of the opening portion 233 in the first direction X is preferable.

According to the recording head with such a form, since the first connection portion and the second connection portion overlap one another, it is possible for the interval of the head main bodies 200 lined up in the first direction X to be narrowed. In so doing, it is possible to achieve size reductions in the first direction X of the recording head. It is possible to arrange the second head main body group 202B connected to the second connection portion via the wiring substrate 121 overlapping the first head main body group 202A connected to the first connection portion via the wiring substrate 121 in the first direction X. Since the width of the leg portion 232 is narrower than the width of the opening portion 233, it is possible to reduce the size in the first direction X.

Naturally, a recording head with a form in which the first connection portion and the second connection portion do not overlap one another in plan view of the circuit substrate 220 is also preferable. A recording head with a form in which the width of the leg portions 232 in the first direction X is at least as wide as the width of the opening portion 233 in the first direction X is also preferable.

Figure 22:
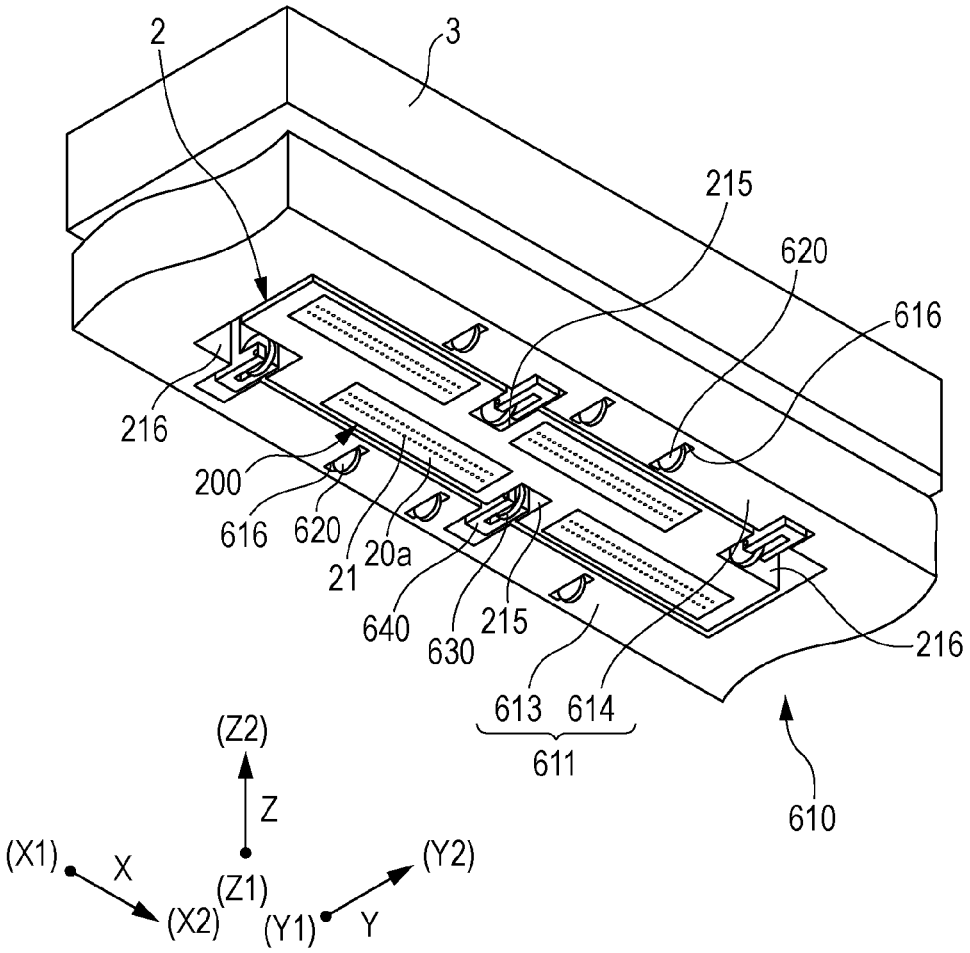
FIG. 22 is a perspective view of the recording head and the roller unit.
Figure 23:
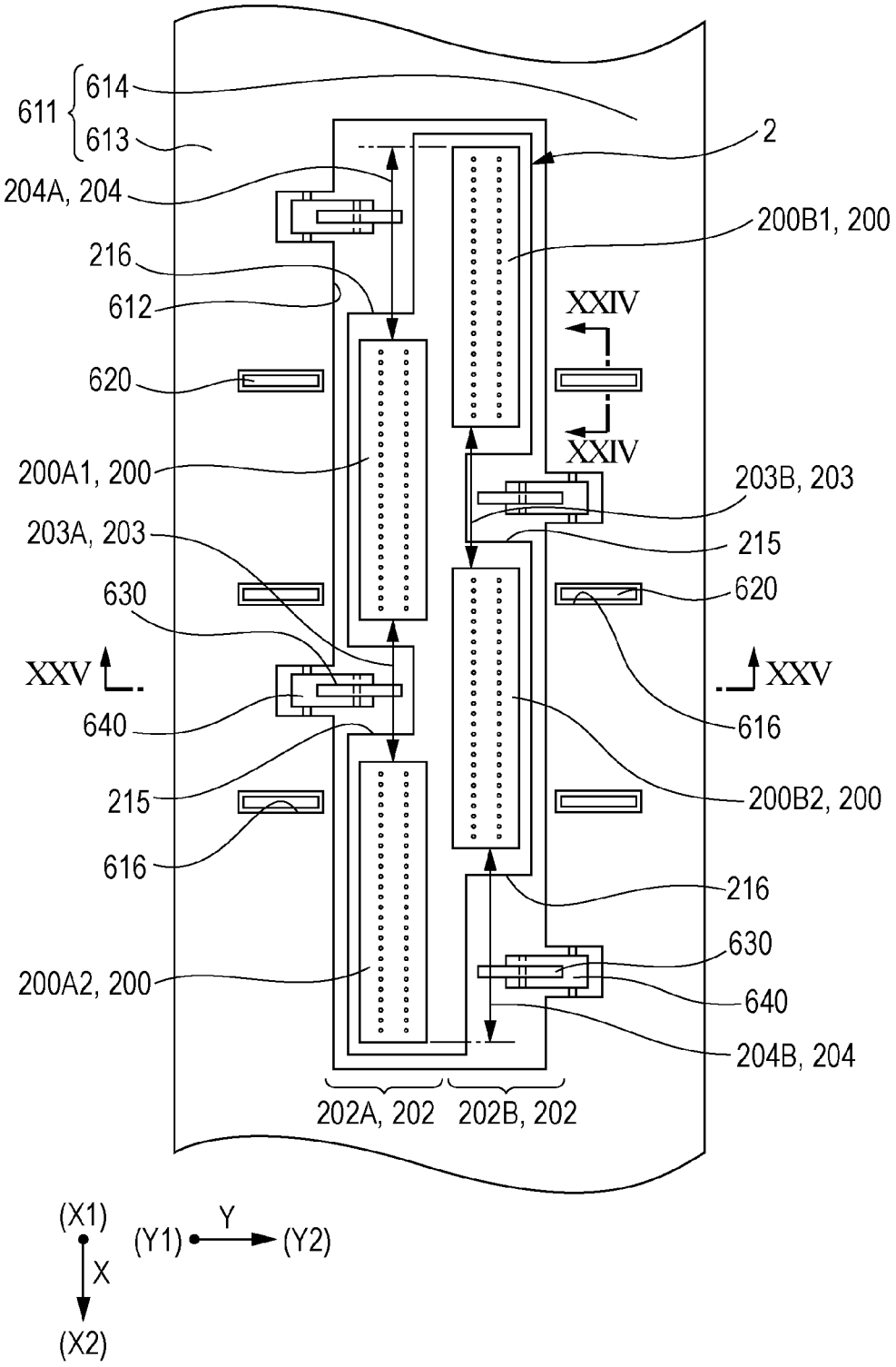
FIG. 23 is a plan view of the liquid ejecting surface side of the recording head and the roller unit.
Figure 24:
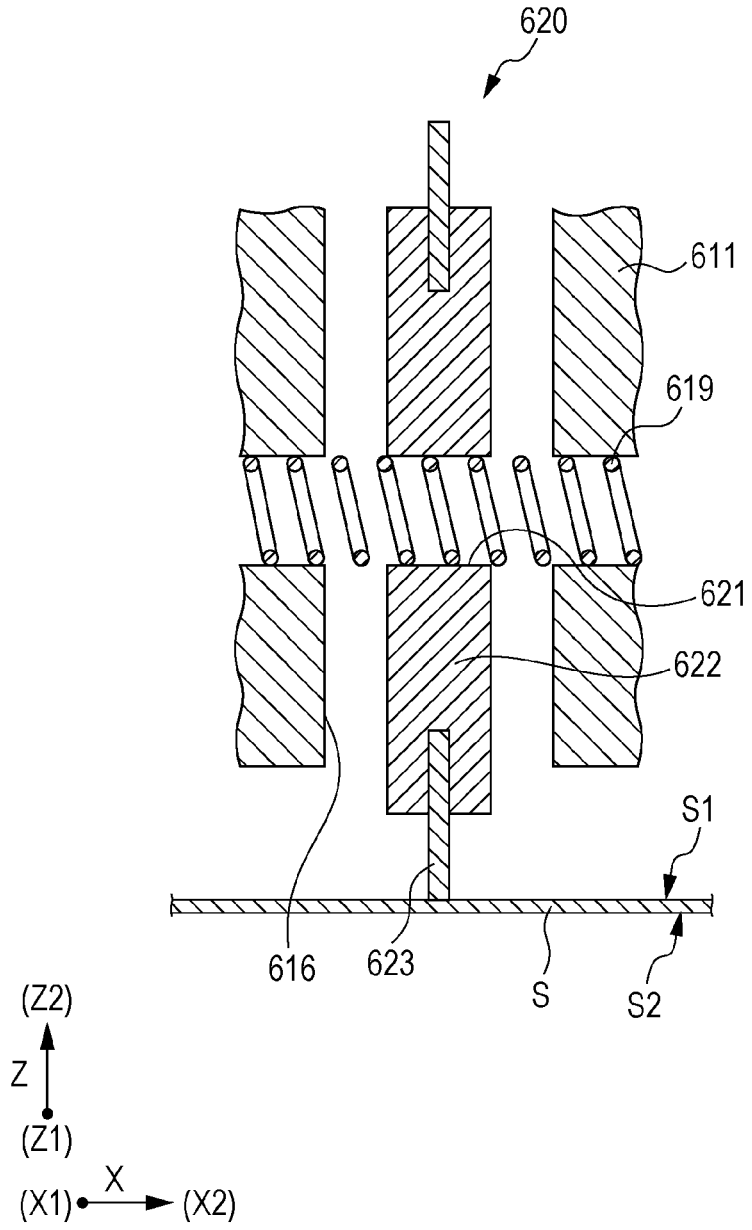
FIG. 24 is a cross-sectional view taken along the line XXIV-XXIV in FIG. 22.
Figure 25:
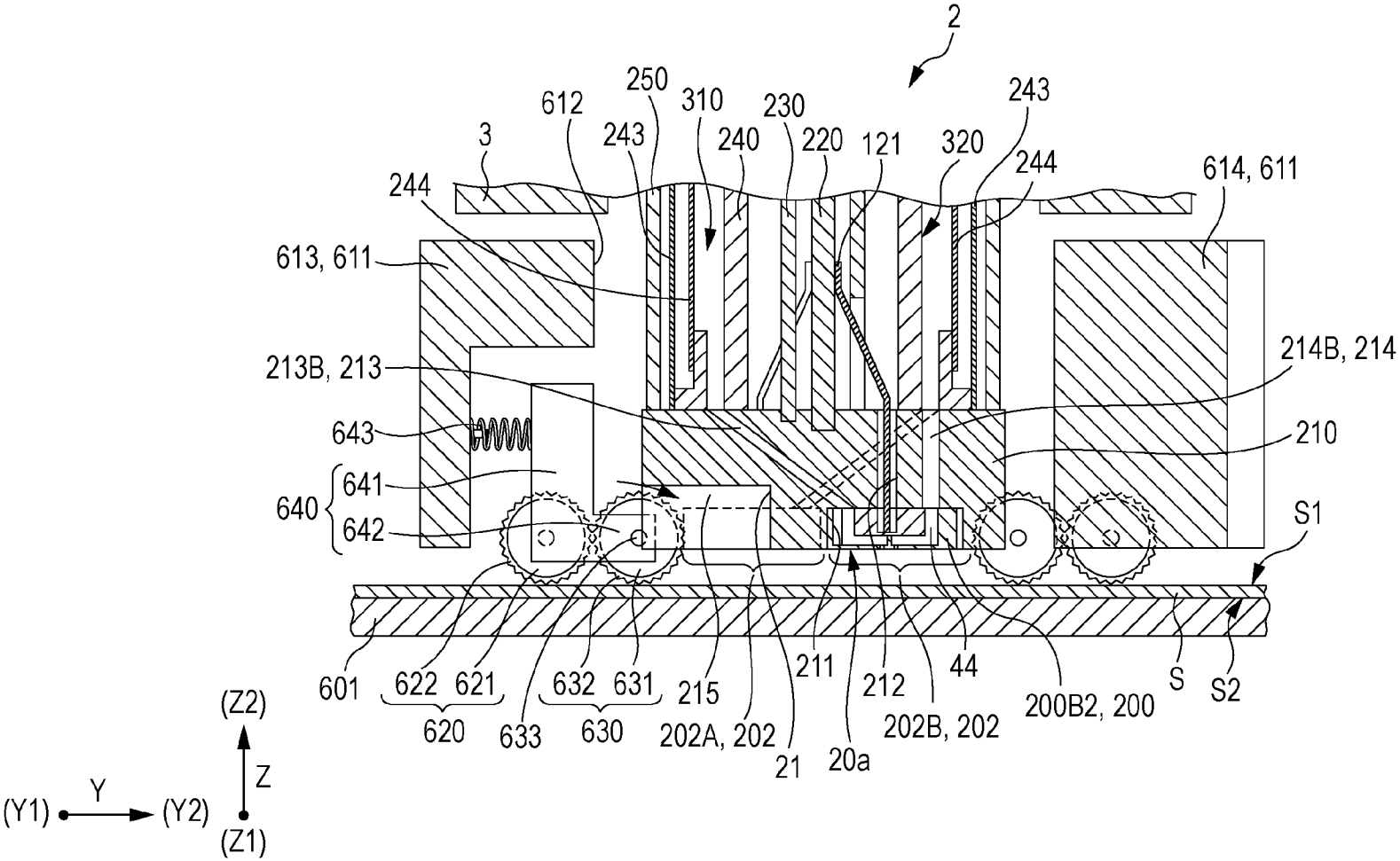
FIG. 25 is a cross-sectional view taken along the line XXV-XXV in FIG. 22.

The recording unit 610 will be described with reference to FIGS. 1 to 2B, and FIGS. 22 to 25. FIG. 22 is a perspective view of a recording head and a roller unit, and FIG. 23 is a plan view of the liquid ejecting surface side of the recording head and the roller unit. FIG. 24 is a cross-sectional view taken along line XXIV-XIV in FIG. 23, and FIG. 25 is a cross-sectional view taken along the line XXV-XXV in FIG. 23.

The roller unit 610 is provided with a frame 611 to be fixed to the apparatus main body 7, and a head-external roller 620 and a head-internal roller 630 that are provided in the frame 611.

The frame 611 is arranged between the carriage 3 and the landing surface S1 of the recording sheet S and includes a head opening portion 612 in which the liquid ejecting surface 20*a* side of the recording head 2 is able to be inserted. That is, the frame 611 has an annular structure that surrounds the recording head 2 in a case of being viewed from the third direction Z. The frame 611, in the embodiment, is provided with a first frame portion 613 provided further to the Y1 side in the second direction Y than the recording head 2, and a second frame portion 614 provided on the Y2 side, and the first frame portion 613 and the second frame portion 614 are provided continuous on both end portions in the first direction X. In so doing, the head opening portion 612 is formed between the first frame portion 613 and the second frame portion 614. The frame 611 is not limited to an annular structure, and, for example, the first frame portion 613 and the second frame portion 614 are preferably separately provided. However, as shown in the embodiment, by using a frame 611 having an annular structure, it is possible for the rigidity of the frame 611 to be improved.

A head-external roller 620 and a head-internal roller 630 are provided in the first frame portion 613 and the second frame portion 614. The head-external roller 620, as shown in FIG. 24, is pivotally supported by a spring 619 that is a biasing unit in which both ends are fixed to the frame 611. Specifically, the head-external roller 620 is provided with a base portion 622 provided with a spring insertion hole 621 in which the spring 619 is inserted, and a roller portion 623 provided spanning in the peripheral direction of the outer periphery of the base portion 622. Concavities and convexities are repeatedly provided along the peripheral direction on the outer periphery of the roller portion 623. That is, the head-external roller 620 of the embodiment is a so-called star wheel. Naturally, the head-external roller 620 is not limited to a star wheel, and is preferably a rubber roller or the like. Such a head-external roller 620 is accommodated in the head-external roller holding portion 616 having a concave shape open to the surface of the Z1 side of the frame 611 in a state in which at least a portion of the roller portion 623 protrudes further to the recording sheet S side than the surface of the Z1 side of the frame 611.

The head-external roller 620 is arranged on the outside of the recording head 2 in the second direction Y that is the transport direction of the recording sheet S. That is, the head-external roller 620, when viewed in plan view from the third direction Z as shown in FIG. 23, is arranged at a position not overlapping at least the liquid ejecting surface 20*a* of the recording head 2.

In the embodiment, one head-external roller 620 is provided between the first accommodation portion 215 and the second accommodation portion 216 in the first direction X and between the two first accommodation portion 215. That is, three head-external rollers 620 are provided at each of the first frame portion 613 and the second frame portion 614.

The head-internal roller 630, as shown in FIG. 25, is held by an arm 640 that is pivotally supported to be rotatable in the frame 611. The arm 640 is provided with a first arm portion 641 that extends in the third direction Z, and a second arm portion 642 provided continuously on the end portion of the Z1 side of the first arm portion 641 and that extends in the second direction Y. The end portion of the opposite side to the end portion continuous with the first arm portion 641 of the second arm portion 642 is provided projecting in the head opening portion 612 of the frame 611. The head-internal roller 630 is pivotally supported to be rotatable by the rotation shaft 633 in the end portion of the second arm portion 642 projected into the head opening portion 612. The head-internal roller 630, similarly to the head-external roller 620, is provided with a base portion 631 and a roller portion 632, and concavities and convexities are repeatedly formed in the peripheral direction on the outer periphery of the roller portion 632. That is, the head-internal roller 630 of the embodiment is a so-called star wheel. Naturally, the head-internal roller 630 is not limited to a star wheel, and is preferably a rubber roller or the like.

For the arm 640 that pivotally supports the head-internal roller 630, the end portion of the Z1 side of the first arm portion 641 is pivotally supported to be rotatable on the frame 611. An arm biasing spring 643 that is a biasing unit that biases the end portion of the Z2 side of the first arm portion 641 in the second direction Y is provided between the end portion of the Z2 side of the first arm portion 641 and the frame 611. Because the arm 640 is provided to be rotatable, by biasing the arm 640 in the second direction Y with the arm biasing spring 643, the head-internal roller 630 provided on the end portion of the second arm portion 642 is biased in the third direction Z towards the recording sheet S side. In other words, the direction the arm biasing spring 643 biases the arm 640 is a different direction to the third direction Z that is a direction orthogonal to the landing surface S1. Naturally, if the biasing direction of the arm biasing spring 643 is a direction different to the third direction Z, there is no particular limitation thereto, and the direction is preferably the first direction X, or is any in-plan direction that includes the first direction X and the second direction Y. The arm biasing spring 643 preferably biases in an inclined direction that includes a third direction Z component and a first direction X and a second direction Y component. Since the head-internal roller 630 is biased via the arm 640, it is possible for the size in the third direction Z of the roller unit 610 to be reduced in the first accommodation portion 215 and the second accommodation portion 216 compared to a case of biasing the head-internal roller 630 with the same structure as the head-external roller 620. Accordingly, it is possible to arrange the recording head 2 approaching the landing surface S1 of the recording sheet S along with reducing the size of the recording head 2 in the third direction Z. Since the head-external roller 620 is biased directly in the third direction Z without interposing the arm 640 as in the head-internal roller 630, it is possible to reduce costs by reducing the number of components. Since the arm 640 is not provided in the head-external roller 620, a space for providing the arm 640 in the first frame portion 613 and the second frame portion 614 becomes unnecessary and it is possible for the width in the second direction Y of the first frame portion 613 and the second frame portion 614 to be reduced, and the interval between two head-external rollers 620 arranged interposing the recording head 2 in the second direction Y to be reduced, and to stably hold the recording sheet S between the two head-external rollers 620.

One head-internal roller 630 is provided in the first frame portion 613 and second frame portion 614 with respect to each interval 203 and gap 204 between the recording heads 2. That is, two head-internal rollers 630 are provided in the first frame portion 613 and two head-internal rollers 630 are provided in the second frame portion 614. The head-internal roller 630 is provided projecting in the head opening portion 612 by the arm 640. Accordingly, for the head-internal roller 630, at least a portion of the head-internal roller 630 is provided opposing the interval 203 and the gap 204 of the recording head 2. The wording providing at least a portion of the head-internal roller 630 and the recording head 2 opposing in the third direction Z refers to at least a portion of the head-internal roller 630 overlapping the recording head 2 when the head-internal roller 630 is projected on the recording head 2 in the third direction Z. The head-internal roller 630 overlapping the recording head 2 refers to overlapping the surface of the liquid ejecting surface 20*a* of the recording head 2. That is, on the Z2 side of the recording head 2, even if the recording head 2 is extended so as to oppose the head-external roller 620 in the third direction Z, it is not said that the head-external roller 620 opposes the recording head 2 in the third direction Z. In the embodiment, the head-internal roller 630 is provided so that the rotation shaft 633 opposes the recording head 2 in the third direction Z. The head-internal roller 630 and the head-external roller 620 are provided so as to at least partially oppose one another in the axial direction of the rotation shaft 633, that is, in the first direction X. In so doing, the width in the second direction Y of the first frame portion 613 and the second frame portion 614 is narrowed, and it is possible for size reductions in the ink jet recording apparatus 1 to be achieved. Naturally, the head-internal roller 630 is not limited thereto, and the head-internal roller 630 is preferably arranged at a position at which the rotation shaft 633 does not oppose the recording head 2 in the third direction Z. The head-internal roller 630 and the head-external roller 620 are preferably provided at a position not opposing one another in the first direction X.

In this way, by providing the head-internal roller 630 such that at least a portion opposes the recording head 2 in the third direction Z, it is possible for the interval between the two head-internal rollers 630 provided on both sides in the second direction Y that is the transport direction of the recording head 2 to be narrowed. Accordingly, it is possible for the distance the recording sheet S is pushed by the head-internal roller 630 to be made smaller on both sides of the recording head 2 in the second direction Y. That is, in a case in which only the head-external roller 620 is provided without providing the head-internal roller 630, because the head-external roller 620 is provided in a region not opposing the recording head 2 in the third direction Z, the distance the head-external roller 620 pushes the recording sheet S in the second direction Y becomes wider than the width in the second direction Y of the recording head 2. In contrast, in the embodiment, on both sides in the second direction Y of the recording head 2, because the recording sheet S is pushed by the head-internal roller 630 arranged further to the recording head 2 than the head-external roller 620, the interval of the head-internal roller 630 becomes narrower in the second direction Y of the recording head 2. Accordingly, the interval of the head-internal roller 630 on both sides in the second direction Y of the recording head 2 becomes shorter, and it is possible for floating and the like of the recording sheet S held between the head-internal roller 630 to be suppressed. Because ink lands on the landing surface S1 of the recording sheet S between the two head-internal rollers 630 in the second direction Y, by suppressing floating of the recording sheet S between the head-internal rollers 630, it is possible to suppress shifting of the landing position of ink on the recording sheet S from arising. In the embodiment, by providing the rotation shaft 633 of the head-internal roller 630 so as to oppose the recording head 2 in the third direction Z, it is possible to further shorten the distance of the head-internal roller 630 by which the recording sheet S is pushed on both sides in the second direction Y of the recording head 2 and it is further possible for the posture of the recording sheet S to be stabilized. Naturally, even the head-internal roller 630 is arranged so that the rotation shaft 633 is outside of the region opposing the recording head 2 in the third direction Z, it is possible to shorten the distance in the second direction Y between the head-internal rollers 630 compared to the head-external rollers 620.

In the embodiment, by providing the head-external roller 620 between the head-internal rollers 630 adjacent to one another in the first direction X, it is possible for the recording sheet S to be pushed with the narrow interval in the first direction X by the head-external roller 620 and the head-internal roller 630. Accordingly, it is possible to suppress floating of the recording sheet S between head-internal rollers 630 adjacent to each other in the first direction X, and to suppress shifting of the landing position of ink on the recording sheet S from arising, compared to a case of providing only the head-internal roller 630.

In the embodiment, the first accommodation portion 215 is provided in the interval 203 of the holder member 210, and the second accommodation portion 216 is provided in the gap 204. Therefore, the head-internal roller 630 of the embodiment is at least partially accommodated in the first accommodation portion 215 and the second accommodation portion 216. That is, in a case of being viewed from the first direction X, at least a portion of the head-internal roller 630 is arranged at a position overlapping in the first accommodation portion 215. In this way, by accommodating at least a portion of the head-internal roller 630 in the first accommodation portion 215 and the second accommodation portion 216, it is possible for the liquid ejecting surface 20*a* of the recording head 2 to be arranged approaching the landing surface S1 of the recording sheet S. Accordingly, high speed printing is possible by suppressing shifting in the landing position of ink ejected from the recording head 2. Naturally, in a case of arranging on the outside without accommodating the head-internal roller 630 in the first accommodation portion 215 and the second accommodation portion 216, it is necessary to arranged the recording head 2 separated from the recording sheet S in the third direction Z in opposing the head-internal roller 630 with the recording head 2 in the third direction Z. Therefore, the liquid ejecting surface 20*a* of the recording head 2 and the landing surface S1 of the recording sheet S are separated, shifting of the landing position of the ink occurs and high speed printing becomes difficult.

It is possible for the first accommodation portion 215 that accommodates at least a portion of the head-internal roller 630 to be formed by providing the first connection flow channel 213 inclined with respect to the third direction Z, as described above. Accordingly, the head-internal roller 630 is provided between a part of the side connected to the flow channel 300 of the first connection flow channel 213 and the liquid ejecting surface 20*a* of the recording head 2, in the third direction Z. In this way, since the first connection flow channel 213 and the second connection flow channel 214 are formed in the holder member 210, it is possible to protect the first connection flow channel 213 and the second connection flow channel 214 from the head-external roller 620 and the head-internal roller 630, compared to a case of forming the first connection flow channel 213 and the second connection flow channel 214 with a tube or the like outside the holder member 210.

In the embodiment, the head-internal roller 630 is held in the frame 611, and the frame 611 is fixed to the apparatus main body 7 of the ink jet recording apparatus 1. Therefore, by the carriage 3 to which the recording head 2 is mounted being raised in the third direction Z, the head-internal roller 630 relatively moves to the outside of the first accommodation portion 215 and the second accommodation portion 216. Accordingly, when the maintenance unit 400 performs maintenance of the recording head 2, it is possible for maintenance to be easily performed in a short time without the head-internal roller 630 interfering.

Embodiment 2

The second correction plate 280 of the recording head 2 according to the Embodiment 1 is provided with an opening 281 in which the protrusion 217 provided with the first connection flow channel 213 and the second connection flow channel 214 is inserted. Although the opening 281 is does not configure the flow channel through which ink flows, there is no limitation to such a form, and the second correction plate 280 preferably configures the ink flow channel.

Figure 29:
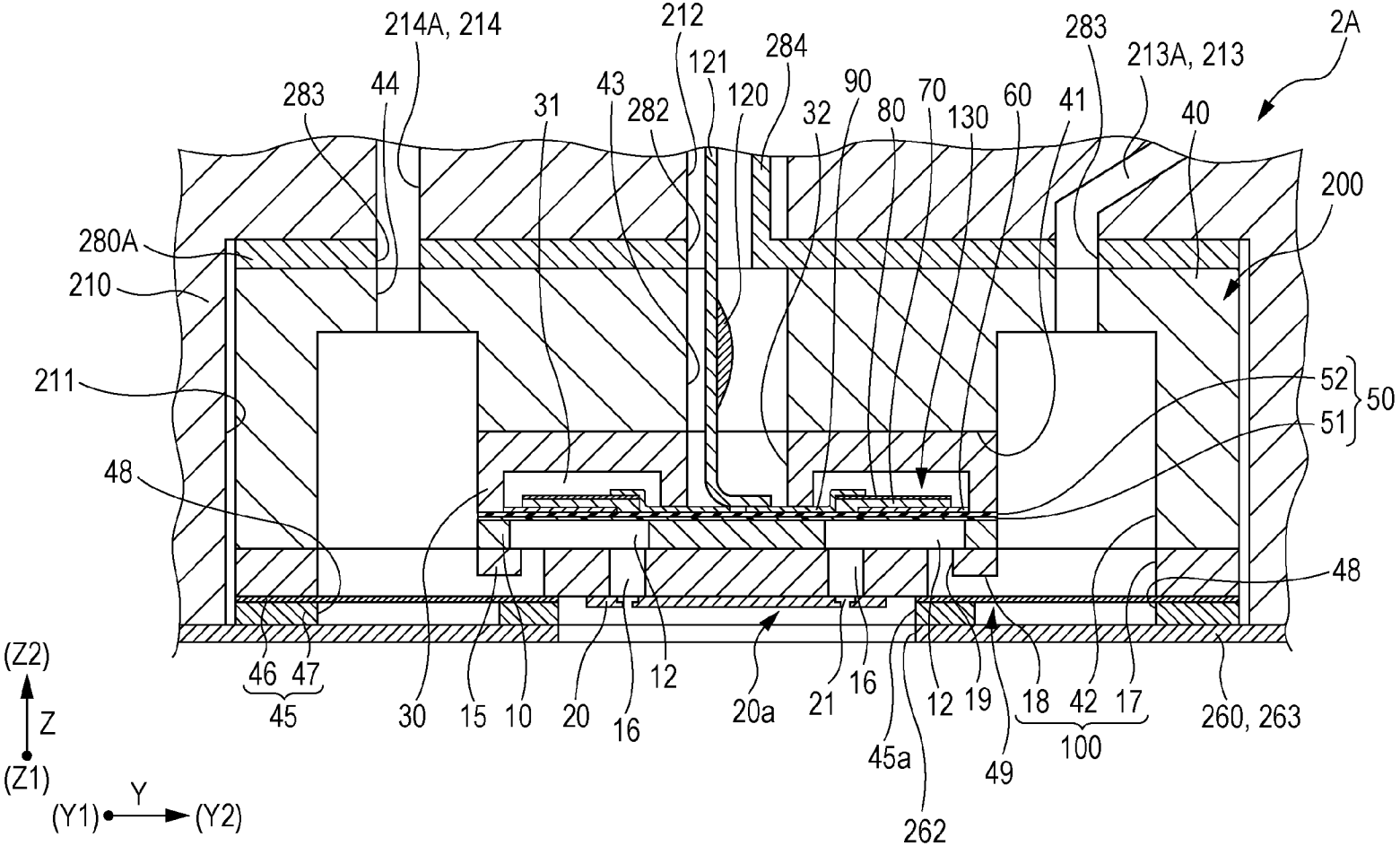
FIG. 29 is an enlarged cross-sectional view of the main portions of the head main body, second correction plate, and holder member according to the Embodiment 2.

FIG. 29 is an enlarged cross-sectional view of the main portions of the head main body, second correction plate, and holder member 210 according to the Embodiment 2. The same like element as Embodiment 1 are given the like reference symbols and overlapping description will not be made.

The second correction plate 280A of the recording head 2A according to the embodiment configures the ink flow channel. Specifically, a through hole 283 that penetrates along the third direction Z, and that configures a portion of the ink flow channel is provided. The surface of the Z1 side of the second correction plate 280A is adhered to the Z2 side of the head main body 200, and the surface of the Z2 side is adhered to the surface of the Z1 side of the holder member 210.

By the second correction plate 280A being adhered to the holder member 210 and the head main body 200, the communication hole 283 communicates with the introduction port 44 of the head main body 200 and the first connection flow channel 213 and the second connection flow channel 214 of the holder member 210.

By forming the second correction plate 280A from a material having conductivity, for example, a metal, it is possible for ink to be grounded via the second correction plate 280A. That is, when supplied from the first connection flow channel 213 and the second connection flow channel 214 to the manifold 100 of the head main body 200, ink contacts the communication hole 283 of the second correction plate 280A. If the second correction plate 280A is formed sufficiently large, the second correction plate 280A exhibits a grounding function with respect to the ink.

The second correction plate 280A preferably grounds the recording head 2A or another member that configures the ink jet recording apparatus 1. In the embodiment, the second correction plate 280A is grounded by electrically contacting the circuit substrate 220. Specifically, the second correction plate 280A includes a plate spring portion 284 projected in the second wiring insertion hole 282.

The plate spring portion 284 projects to the inside of the second wiring insertion hole 282, and is formed folded to the Z2 side in the third direction Z. Although not shown in the drawings, the plate spring portion 284 extends to the Z2 side, similarly to the wiring substrate 121, is inserted in the first wiring insertion hole 212 and drawn up to the surface of the Z2 side of the holder member 210, and electrically connected to the circuit substrate 220.

According to the second correction plate 280A with such a configuration, the ink supplied from the first connection flow channel 213 and the second connection flow channel 214 to the manifold 100 of the head main body 200 contacts the communication hole 283 of the second correction plate 280A so as to be grounded.

According to the recording head 2A of such a form, since the ink is grounded via the second correction plate 280A, it is possible to suppress charging of the ink, and possible to suppress a lowering of the printing quality due to the charge. Since it is possible for correction of the holder member 210 of the recording head 2 and charging of the ink to be realized with the second correction plate 280A, it is possible to achieve cost reductions by reducing the number of components.

Other Embodiments

Above, although embodiments of the invention have been described, the basic configuration of the invention is not limited to the above.

For example, in the above-described Embodiment 1, although the first correction plate 230 is configured with a shorter width than the width of the holder member 210 in the first direction X, there is no limitation to such a form. If both sides of the circuit substrate 220 have a planar shape opposing one another, the size, thickness and the like thereof are not particularly limited.

Although the recording head 2 according to the Embodiment 1 is provided with the first correction plate 230 and the second correction plate 280, there is no limitation to such a form. That is, the recording head 2 is preferably provided with at least a first correction plate 230, and is preferably a recording head of a form in which the second correction plate 280 is not provided.

Although the recording head 2 according to the Embodiment 1 is provided with the second correction plate 280 with a planar shape parallel to the liquid ejecting surface 20*a*, and is preferably not necessarily parallel to the liquid ejecting surface 20*a*. The second correction plate 280 is not necessarily limited to a case of being formed from a material with a higher rigidity than the holder member 210, and is preferably formed from a material with the same or lower rigidity as the holder member 210. Although the second correction plate 280 has a size that covers the liquid ejecting surface of all of the head main bodies 200 in plan view of the liquid ejecting surface 20*a*, there is no limitation thereto.

Although the thickness D1 of the part that contacts the seal part 253 and the holder member 210 is thicker than the thickness D2 of the part that contacts the seal part 253 and the rigid part 254, there is no limitation thereto.

Although the thickness D2 of the seal part 253 becomes thinner than the thickness D3 of the rigid part 254, there is no limitation thereto. Although, in the seal part 253, the center P in the thickness direction of the contact portions 258*a* of the seal part 253 and the holder member 210 is further to the inside of the cover member 250 than the center Q in the thickness direction of the contact portions 258*b* of the seal part 253 and the rigid part 254, there is no limitation thereto.

Although the seal part 253 is formed in an annular rectangle form, there is no limitation thereto, and the actions and effects of the invention are exhibited with an arbitrary shape matching the cover member 250. Although the seal part 253 and the rigid part 254 are provided on the cover member 250, there is no limitation to such a form, and the seal part 253 and the rigid part 254 are preferably provided on the holder member 210 side.

In plan view with respect to the liquid ejecting surface 20*a*, the contour of the seal part 253 is preferably formed on the outermost side of the recording head 2 in at least the first direction X, and it is not necessary to provide the seal part 253 itself on the plane parallel with respect to the liquid ejecting surface 20*a*. The seal part 253, for example, is preferably provided on a plane inclined with respect to the liquid ejecting surface 20*a*.

Although the regulating portion 218 is provided on the holder member 210, there is no limitation thereto, and the regulating portion is preferably not provided. The regulating portion 218 is preferably integrated with the holder member 210 or is preferably a separate member.

Although the recording head 2 according to Embodiment 1 is provided with an exposure portion 290, there is no limitation to such a form. For example, a form in which an opening that exposes the supply needle 242 to the cover member 250 is provided is preferably used. That is, an exposure portion 290 of a form in which the side wall portion 291 that configures the exposure portion 290, the ceiling portion 292, and the notch portion 295 are not provided is preferably used.

Although the recording head 2 according to Embodiment 1 is provided with a seal part 253 through two-color molding between the holder member 210 and the cover member 250, there is no limitation to such a form. For example, a seal material formed from an annular flexible material of another member not with two-color molding is preferably used.

Although in the recording head 2 according to Embodiment 1 the Young's modulus of the holder member 210 is higher than the Young's modulus of the rigid part 254 of the cover member 250, there is no limitation to such a form.

In the above-described Embodiment 1, although one recording head 2 is provided on the carriage 3, there is no particular limitation thereto, and, for example, two or more recording heads 2 are preferably provided on the carriage 3.

In the above-described Embodiment 1, although a configuration in which one type of ink is ejected from one recording head 2 is given as an example, there is no particular limitation thereto, and a different ink is preferably ejected for each nozzle row.

In the above-described Embodiment 1, although the arrangement direction of the head main body 200 of the recording head 2 is the first direction X when mounted to the ink jet recording apparatus 1, there is no particular limitation thereto. For example, the arrangement direction of the head main bodies 200, that is, the arrangement direction of the nozzle openings 21 is preferably a direction inclined with respect to the first direction X of the ink jet recording apparatus 1. That is, the head main body 200 that configures the head main body group 202 is preferably arranged in a direction inclined with respect to the axial direction of the carriage shaft. Similarly, although the arrangement direction of the head main body group 202 is the second direction Y, there is no limitation thereto, and for example, the arrangement direction of the head main body group 202 is preferably a direction inclined with respect to the second direction Y.

In the above-described Embodiment 1, although using a thin film piezoelectric actuator 130 as the pressure generating unit that generates pressure changes in the pressure generating chamber 12 is described, it is possible to use a thick film-type piezoelectric actuator formed by a method such as applying a green sheet, a vertical vibration-type piezoelectric actuator that contracts and expands in the axial direction by a piezoelectric material and an electrode forming material being alternately layered or the like. It is possible to use a pressure generating unit in which a heating element is arranged in the pressure generating chamber, and ejects liquid droplets from the nozzle openings through bubbles generated by the heat of the heat generating element, or a so-called electrostatic actuator or the like that generates static electricity between the diaphragm and an electrode, and ejects liquid droplets from the nozzle openings by deforming the diaphragm through electrostatic force.

In the embodiments, although description was given exemplifying an ink jet type recording apparatus as an example of a liquid ejecting apparatus and an ink jet type recording head as an example of a liquid ejecting head, the invention is widely aimed at liquid ejecting apparatuses in general and it is naturally possible to apply the invention to liquid ejecting heads ejecting liquids other than ink. Examples of other liquid ejecting heads include a variety of recording heads that are used in an image recording apparatus, such as a printer; color material ejecting heads used to manufacture color filters, such as liquid crystal displays; electrode material ejecting heads used to form electrodes, such as organic EL displays and field emission displays (FED), biological organic substance ejecting heads used to manufacture bio-chips, and the like, and it is possible to apply the invention to liquid ejecting heads and liquid ejecting apparatuses provided with these liquid ejecting heads.

What is claimed is:

1. A liquid ejecting head comprising:

a first head main body that ejects liquid droplets from a liquid ejecting surface;

a wiring substrate electrically connected to the first head main body;

a holder member to which a plurality of head main bodies, including the first head main body, are fixed, and that includes a flow channel to the first head main body, and a wiring through hole through which the wiring substrate passes;

a circuit substrate that includes a substrate and connection portions electrically connected to the wiring substrate, wherein the connection portions are provide on both surfaces of the substrate and the substrate is perpendicular to a liquid ejecting surface of the plurality of head main bodies;

a set of first correction plates facing each other with respect to each of both surfaces of the substrate of the circuit substrate for correcting warping of the holder member; and a cover member that accommodates the circuit substrate fixed to the holder member and the first correction plates.

2. The liquid ejecting head according to claim 1, wherein the first correction plates each include a correction main body portion that extends over the connection portions in a direction perpendicular to the liquid ejecting surface, and an opening portion provided in the correction main body portion and through which the wiring substrate passes.

3. A liquid ejecting apparatus comprising the liquid ejecting head according to claim 2.

4. The liquid ejecting head according to claim 1, wherein each head main body includes a nozzle row following a first direction on the liquid ejecting surface, the plurality of head main bodies are arranged in a first head main body group are spaced with a first interval in the first direction and in a second head main body group are spaced with a second interval in the first direction and are arranged at different positions in a second direction orthogonal to the first direction on the liquid ejecting surface, and the plurality of head main bodies are further arranged wherein any of the head main bodies of the first head main body group are arranged at a position at which the second interval is provided in the first direction and any of the head main bodies of the second head main body group are arranged at a position at which the first interval is provided in the first direction, the first correction plate includes leg portions arranged on both sides of the opening portion in the first direction, and fixed to the holder member, the connection portion includes a first connection portion connected to the head main body that configures the first head main body group and a second connection portion connected to the head main body that configures the second head main body group, the leg portion of one first correction plate of the set of first correction plates is arranged at a position that overlaps the second connection portion and does not overlap the first connection portion in the first direction, and the leg portion of another first correction plate of the set of first correction plates is arranged at a position that overlaps the first connection portion and does not overlap the second connection portion in the first direction.

5. The liquid ejecting head according to claim 4, wherein the first connection portion and the second connection portion overlap one another in plan view of the circuit substrate, and the width of the leg portion in the first direction is narrower than the width of the opening portion in the first direction.

6. A liquid ejecting apparatus comprising the liquid ejecting head according to claim 5.

7. A liquid ejecting apparatus comprising the liquid ejecting head according to claim 4.

8. The liquid ejecting head according to claim 1, further comprising:

a second correction plate that is planar shaped, parallel to the liquid ejecting surface, more rigid than the holder member, and adhered to the holder member, wherein the second correction plate has a size that covers all of the liquid ejecting surface of the head main body on the surface parallel the liquid ejecting surface.

9. The liquid ejecting head according to claim 8, further comprising:

a fixing plate to which the plurality of head main bodies are adhered, and adhered to the holder member, wherein the head main body and the second correction plate are separated.

10. A liquid ejecting apparatus comprising the liquid ejecting head according to claim 9.

11. The liquid ejecting head according to claim 8, wherein the head main bodies each include a liquid introduction port arranged at different position to one another in the second direction, the holder member includes a first connection flow channel that intersects the liquid ejecting surface and communicates with the introduction port of one of the head main bodies of the plurality of head main bodies, and a second connection flow channel extending in a direction perpendicular to the liquid ejecting surface, and wherein the second correction plate includes an opening that passes through both of the first connection flow channel and the second connection flow channel and penetrates in a direction orthogonal to the liquid ejecting surface.

12. The liquid ejecting head according to claim 11, wherein the first correction plate and the circuit substrate are fixed to the holder member so as to follow the first connection flow channel.

13. A liquid ejecting apparatus comprising the liquid ejecting head according to claim 12.

14. A liquid ejecting apparatus comprising the liquid ejecting head according to claim 11.

15. The liquid ejecting head according to claim 8, wherein the second correction plate configures a flow channel, and a liquid is grounded via the second correction plate.

16. A liquid ejecting apparatus comprising the liquid ejecting head according to claim 15.

17. A liquid ejecting apparatus comprising the liquid ejecting head according to claim 8.

18. The liquid ejecting head according to claim 1, wherein the circuit substrate includes an electronic component with a larger dimension than an interval between the circuit substrate and the first correction plate in a direction in which the set of first correction plates face each other, and the electronic component is arranged at a position at which the first correction plate does not overlap the circuit substrate.

19. A liquid ejecting apparatus comprising the liquid ejecting head according to claim 1.

* * * * *